US006050772A

United States Patent [19]

Hatakeyama et al.

[11] Patent Number: 6,050,772

[45] Date of Patent: Apr. 18, 2000

[54] METHOD FOR DESIGNING A MULTIBLADE RADIAL FAN AND A MULTIBLADE RADIAL FAN

[75] Inventors: Makoto Hatakeyama; Hideki Kawaguchi; Noboru Shinbara; Yoshinori Nakamura; Takeshi Uemura, all of Kitakyushu, Japan

[73] Assignee: Toto Ltd., Kitakyushu, Japan

[21] Appl. No.: 08/817,393

[22] PCT Filed: Aug. 27, 1996

[86] PCT No.: PCT/JP96/02391

§ 371 Date: Apr. 18, 1997

§ 102(e) Date: Apr. 18, 1997

[87] PCT Pub. No.: WO97/08463

PCT Pub. Date: Mar. 6, 1997

[30] Foreign Application Priority Data

Aug. 28, 1995 [JP] Japan ..... 7-240456

[51] Int. Cl.[7] ..... F01D 29/44

[52] U.S. Cl. ..... 415/1; 415/119; 415/204; 415/206; 415/211.1; 415/211.2; 29/888.024; 29/889.4

[58] Field of Search ..... 415/1, 119, 204, 415/206, 208.1, 211.1, 211.2; 29/888.024, 889.4

[56] References Cited

U.S. PATENT DOCUMENTS

| | | | |
|---|---|---|---|
| 4,712,976 | 12/1987 | Hopfensperger et al. | 415/119 |

FOREIGN PATENT DOCUMENTS

| | | | |
|---|---|---|---|
| 466983 | 1/1992 | European Pat. Off. | 415/119 |
| 2444181 | 7/1980 | France | 415/206 |
| 29551 | 8/1964 | Germany | 415/204 |
| 46-10973 | 3/1971 | Japan | 415/119 |
| 52-6112 | 1/1977 | Japan | 415/119 |
| A-01-170798 | 7/1989 | Japan . | |
| 5-231379 | 9/1993 | Japan | 415/204 |

*Primary Examiner*—Christopher Verdier
*Attorney, Agent, or Firm*—Griffin, Butler, Whisenhunt & Szipl, LLP

[57] ABSTRACT

Specifications of the impeller and the scroll type casing of a multiblade radial fan comprising an impeller having numerous radially directed blades circumferentially spaced from each other and a scroll type casing accommodating the impeller are determined so as to make divergence angle of the scroll type casing substantially coincide with divergence angle of the free vortex formed by the air discharged from the impeller.

32 Claims, 29 Drawing Sheets

○ ··· φ58−144 BLADES−t0.5
□ ··· φ75−144 BLADES−t0.5
△ ··· φ75−100 BLADES−t0.5
▽ ··· φ58−144 BLADES−t0.3
◇ ··· φ40−40 BLADES−t0.5
× ··· φ40−120 BLADES−t0.3
⊗ ··· φ90−240 BLADES−t0.5
⊕ ··· φ90−120 BLADES−t0.5

$$\phi = u/v$$
$$\theta = \tan^{-1}(\phi)$$

○ ··· φ58−144 BLADES−t0.5
□ ··· φ75−144 BLADES−t0.5
△ ··· φ75−100 BLADES−t0.5
▽ ··· φ58−144 BLADES−t0.3
◇ ··· φ40−40 BLADES−t0.5
× ··· φ40−120 BLADES−t0.3
⊗ ··· φ90−240 BLADES−t0.5
⊕ ··· φ90−120 BLADES−t0.5

METHOD FOR DESIGNING A MULTIBLADE RADIAL FAN AND A MULTIBLADE RADIAL FAN

TECHNICAL FIELD

The present invention relates to a method for designing a multiblade radial fan and also relates to a multiblade radial fan.

BACKGROUND ART

The radial fan, one type of centrifugal fan, has both its blades and interblade channels directed radially and is thus simpler than other types of centrifugal fans such as the sirocco fan, which has forward-curved blades, and the turbo fan, which has backward-curved blades. The radial fan is expected to come into wide use as a component of various kinds of household appliances.

Quietness of the multiblade radial fan, which has numerous radially directed blades disposed at equal circumferential distance from each other, is heavily affected by the impeller of the multiblade radial fan, compatibility between the impeller and the scroll type casing for accommodating the impeller, and interference between the tongue of the scroll type casing and the blades of the impeller.

The inventors of the present invention proposed design criteria for enhancing the quietness of the impeller of the multiblade radial fan in international application PCT/JP95/00789. No one has ever proposed design criteria for achieving compatibility between the impeller and the scroll type casing accommodating the impeller of the multiblade radial fan, or design criteria for decreasing sound caused by interference between the tongue of the scroll type casing and the blades of the impeller.

DISCLOSURE OF INVENTION

An object of the present invention is to provide design criteria for achieving compatibility between the impeller and the scroll type casing accommodating the impeller of the multiblade radial fan, thereby enhancing the quietness of the multiblade radial fan.

Another object of the present invention is to provide design criteria for decreasing sound caused by interference between the tongue of the scroll type casing and the blades of the impeller of the multiblade radial fan, thereby enhancing the quietness of the multiblade radial fan.

Still another object of the present invention is to provide design criteria for decreasing sound caused by interference between the tongue of the scroll type casing and the blades of the impeller of the multiblade centrifugal fan as generally defined to include the multiblade sirocco fan, the multiblade turbo fan as well as the multiblade radial fan, thereby enhancing the quietness of multiblade centrifugal fans in general.

Another object of the present invention is to provide a method for driving the impeller of the multiblade radial fan under a systematically derived condition of maximum efficiency.

1. Provision of design criteria for achieving compatibility between the impeller and the scroll type casing accommodating the impeller of the multiblade radial fan, thereby enhancing quietness of the multiblade radial fan.

The inventors of the present invention conducted an extensive study and found that there is a definite correlation between the flow coefficient of the impeller under the condition of maximum total pressure efficiency and the specifications of the impeller. The present invention was accomplished based on this finding. An aim of the present invention is therefore to determine the specifications of the impeller and the scroll type casing so as to achieve compatibility between the impeller and the scroll type casing accommodating the impeller under the condition of maximum total pressure efficiency of the impeller, thereby decreasing sound caused by incompatibility between the impeller and the scroll type casing. Moreover, the object of the present invention is to generally decrease sound caused by incompatibility between the impeller and the scroll type casing.

According to the present invention, there is provided a method for designing a multiblade radial fan comprising an impeller having numerous radially directed blades circumferentially spaced from each other and a scroll type casing accommodating the impeller, wherein specification of the impeller and the scroll type casing are determined so as to make the divergence angle of the scroll type casing substantially coincide with the divergence angle of the free vortex formed by the air discharged from the impeller.

According to the present invention, there is provided a method for designing a multiblade radial fan comprising an impeller having numerous radially directed blades circumferentially spaced from each other and a scroll type casing accommodating the impeller, wherein specifications of the impeller and the scroll type casing are determined so as to make the divergence angle of the scroll type casing substantially coincide with divergence angle of the free vortex formed by the air discharged from the impeller under the condition of maximum total pressure efficiency.

According to the present invention, there is provided a multiblade radial fan comprising an impeller having numerous radially directed blades circumferentially spaced from each other and a scroll type casing accommodating the impeller, wherein specifications of the impeller and the scroll type casing are determined so as to make divergence angle of the scroll type casing substantially coincide with divergence angle of the free vortex formed by the air discharged from the impeller.

According to the present invention, there is provided a multiblade radial fan comprising an impeller having numerous radially directed blades circumferentially spaced from each other and a scroll type casing accommodating the impeller, wherein specifications of the impeller and the scroll type casing are determined so as to make divergence angle of the scroll type casing substantially coincide with divergence angle of the free vortex formed by the air discharged from the impeller under the condition of maximum total pressure efficiency.

It is possible to optimize the quietness of the multiblade radial fan by determining the specifications of the impeller and the scroll type casing so as to make the divergence angle of the scroll type casing substantially coincide with the divergence angle of the free vortex formed by the air discharged from the impeller.

It is possible to optimize the quietness of the multiblade radial fan by determining the specifications of the impeller and the scroll type casing so as to make the divergence angle of the scroll type casing substantially coincide with the divergence angle of the free vortex formed by the air discharged from the impeller under the condition of maximum total pressure efficiency.

According to the present invention, there is provided a method for designing a multiblade radial fan, wherein specifications of the impeller and the scroll type casing are determined so as to satisfy the correlation expressed by the formula $\theta_z=\tan^{-1}[0.295\epsilon(1-nt/(2\pi r))(H/H_t)\xi^{1.641}]$ (where $0.75\leqq\epsilon\leqq1.25$, n: number of radially directed blades, t: thickness of the radially directed blades, r: outside radius of the impeller, H: height of the radially directed blades, $H_t$: height of the scroll type casing, ξ: diameter ratio of the impeller, $\theta_z$: divergence angle of the scroll type casing).

According to a preferred embodiment of the present invention, specifications of the impeller and the scroll type casing are determined so as to satisfy the correlation expressed by the formula $3.0°\leqq\theta_z\leqq8.0°$.

According to a preferred embodiment of the present invention, specifications of the impeller and the scroll type casing are determined so as to satisfy the correlation expressed by the formula $0.4\leqq\xi\leqq0.8$.

According to a preferred embodiment of the present invention, specifications of the impeller and the scroll type casing are determined so as to satisfy the correlation expressed by the formula $H/D_1\leqq0.75$ (where $D_1$: inside diameter of the impeller).

According to a preferred embodiment of the present invention, specifications of the impeller and the scroll type casing are determined so as to satisfy the correlation expressed by the formula $0.65\leqq H/H_t$.

According to the present invention, there is provided a multiblade radial fan, wherein specifications of the impeller and the scroll type casing satisfy the correlation expressed by the formula $\theta_z=\tan^{-1}[0.295\epsilon(1-nt/(2\pi r))(H/H_t)\xi^{1.641}]$ (where $0.75\leqq\epsilon\leqq1.25$, n: number of radially directed blades, t: thickness of the radially directed blades, r: outside radius of the impeller, H: height of the radially directed blades, $H_t$: height of the scroll type casing, ξ: diameter ratio of the impeller, $\theta_z$: divergence angle of the scroll type casing).

According to a preferred embodiment of the present invention, specifications of the impeller and the scroll type casing satisfy the correlation expressed by the formula $3.0°\leqq\theta_z\leqq8.0°$.

According to a preferred embodiment of the present invention, specifications of the impeller and the scroll type casing satisfy the correlation expressed by the formula $0.4\leqq\xi\leqq0.8$.

According to a preferred embodiment of the present invention, specifications of the impeller and the scroll type casing satisfy the correlation expressed by the formula $H/D_1\leqq0.75$ (where $D_1$: inside diameter of the impeller).

According to a preferred embodiment of the present invention, specifications of the impeller and the scroll type casing satisfy the correlation expressed by the formula $0.65\leqq H/H_t$.

When specifications of the impeller and the scroll type casing satisfy the correlation expressed by the formula $\theta_z=\tan^{-1}[0.295\epsilon(1-nt/(2\pi r))(H/H_t)\xi^{1.641}]$ (where $0.75\leqq\epsilon\leqq1.25$, n: number of radially directed blades, t: thickness of the radially directed blades, r: outside radius of the impeller, H: height of the radially directed blades, $H_t$: height of the scroll type casing, ξ: diameter ratio of the impeller, $\theta_z$: divergence angle of the scroll type casing), compatibility between the scroll type casing and the impeller is achieved and specific sound level is minimized under the condition of the maximum total pressure efficiency of the impeller. Thus, a multiblade radial fan with optimized quietness, wherein sound is minimized under the condition of the maximum efficiency of the impeller, can be designed by determining the specifications of the impeller and the scroll type casing to satisfy the correlation expressed by the above formula.

2. Provision of design criteria for decreasing sound level caused by interference between the tongue of the scroll type casing and the impeller of the multiblade radial fan, thereby enhancing quietness of the multiblade radial fan, and provision of design criteria for decreasing sound level caused by interference between the tongue of the scroll type casing and the impeller of the multiblade centrifugal fan as generally defined to include the multiblade radial fan, thereby enhancing quietness of multiblade centrifugal fans in general.

Sound caused by interference between the tongue of the scroll type casing and the blades of the impeller (hereinafter called tongue interference sound) is, as shown in FIG. 21, caused by the periodical collision of the air discharged from the interblade channels of the impeller and having uneven circumferential velocity distribution with the tongue of the scroll type casing. Frequency f of the tongue interference sound is expressed by the formula $f=n\times z$ (where n: number of the blades of the impeller, z: revolution speed of the impeller).

As shown in FIG. 22, the circumferential velocity distribution of the air discharged from the interblade channels becomes more uniform as the distance from the impeller increases. It is thought that the manner in which the circumferential velocity distribution of the air discharged from the interblade channels becomes uniform varies with the specifications of the impeller.

The inventors of the present invention conducted an extensive study and found that there is a definite correlation between the manner in which the circumferential velocity distribution of the air discharged from the interblade channels becomes uniform and the specifications of the impeller. The present invention was accomplished based on this finding. An object of the present invention is therefore to determine the specifications of the impeller and the scroll type casing so as to make the air discharged from the interblade channels collide with the tongue of the scroll type casing after the circumferential velocity distribution of the air has become fairly uniform, thereby decreasing the tongue interference sound of the multiblade radial fan, and further, decreasing the tongue interference sound of the multiblade centrifugal fan as generally defined to include the multiblade radial fan.

According to the present invention, there is provided a method for designing a multiblade centrifugal fan comprising an impeller having numerous blades circumferentially spaced from each other and a scroll type casing accommodating the impeller, wherein the tongue of the scroll type casing is located at or outside the radial position where the ratio of the half band width of a jet flow discharged from an interblade channel to the virtual interblade pitch becomes a certain value near 1.

It is possible to make the air discharged from the interblade channels collide with the tongue of the scroll type casing after the circumferential velocity distribution of the air has become fairly uniform by locating the tongue of the scroll type casing at or outside of the radial position where the ratio of the half band width of a jet flow discharged from an interblade channel to the virtual interblade pitch becomes a certain value near 1. Thus, the tongue interference sound of the multiblade centrifugal fan decreases.

According to the present invention, there is provided a method for designing a multiblade centrifugal fan comprising an impeller having numerous blades circumferentially spaced from each other and a scroll type casing accommodating the impeller, wherein the tongue of the scroll type casing is located at or outside the radial position where the ratio of the half band width of a jet flow discharged from an interblade channel to the virtual interblade pitch at a radial position where the half band widths of two adjacent jet flows discharged from two adjacent interblade channels are equal to the virtual interblade pitch becomes a certain value near 1.

It is possible to make the air discharged from the interblade channels collide with the tongue of the scroll type casing after the circumferential velocity distribution of the air has become fairly uniform by locating the tongue of the scroll type casing at or outside of the radial position where the ratio of the half band width of a jet flow discharged from an interblade channel to the virtual interblade pitch at a radial position where the half band widths of two adjacent jet flows discharged from two adjacent interblade channels are equal to the virtual interblade pitch becomes a certain value near 1. Thus, tongue interference sound of the multiblade centrifugal fan decreases.

According to the present invention, there is provided a method for designing a multiblade centrifugal fan comprising an impeller having numerous blades circumferentially spaced from each other and a scroll type casing accommodating the impeller, wherein specifications of the impeller and the scroll type casing are determined so as to satisfy the correlation expressed by the formula $A_\tau+B<10.0$ (where $\tau=b/\delta_3$, $b=(\delta_3-c)(C_4/X)+c$, $c=C\delta_1$, $\delta_1=\{(2\pi r)/n\}-t$, $\delta_3=2\pi(r+X)/n$, $C_d$: tongue clearance, n: number of the blades, t: thickness of the blades, r: outside radius of the impeller, A, B, C, X: constants determined through tests).

It is possible to make the air discharged from the interblade channels collide with the tongue of the scroll type casing after the circumferential velocity distribution of the air has become fairly uniform by determining the specifications of the impeller and the scroll type casing so as to satisfy the correlation expressed by the formula $A_\tau+B<10.0$ (where $\tau=b/\delta_3$, $b=(\delta_3-c)(C_d/X)+c$, $c=C\delta_1$, $\delta_1=\{(2\pi r)/n\}-t$, $\delta_3=2\pi(r+X)/n$, $C_d$: tongue clearance, n: number of the blades, t: thickness of the blades, r: outside radius of the impeller, A, B, C, X: constants determined through tests). Thus, tongue interference sound of the multiblade centrifugal fan decreases.

According to the present invention, there is provided a method for designing a multiblade centrifugal fan comprising an impeller having numerous blades circumferentially spaced from each other and a scroll type casing accommodating the impeller, wherein specifications of the impeller and the scroll type casing are determined so as to satisfy the correlation expressed by the formula $47.09\tau+50.77<10.0$ (where $\tau=b/\delta_3$, $b=(\delta_3-c)(C_d/x)+c$, $X=0.8\delta_2$, $c=0.3\delta_1$, $\delta_1=\{(2\pi r)/n\}-t$, $\delta_2=(2\pi r)/n$, $\delta_3=2\pi(r+X)/n$, $C_d$: tongue clearance, n: number of the blades, t: thickness of the blades, r: outside radius of the impeller).

It is possible to make the air discharged from the interblade channels collide with the tongue of the scroll type casing after the circumferential velocity distribution of the air has become fairly uniform by determining the specifications of the impeller and the scroll type casing so as to satisfy the correlation expressed by the formula $47.09\tau+50.77<10.0$ (where $\tau=b/\delta_3$, $b=(\delta_3-c)(C_d/X)+c$, $X=0.8\delta_2$, $c=0.3\delta_1$, $\delta_1=\{(2\pi r)/n\}-t$, $\delta_2=(2\pi r)/n$, $\delta_3=2\pi(r+X)/n$, $C_d$: tongue clearance, n: number of the blades, t: thickness of the blades, r: outside radius of the impeller). Thus, the tongue interference sound of the multiblade centrifugal fan decreases.

3. Provision of a method for driving the impeller of a multiblade radial fan under a systematically derived condition of maximum efficiency.

The multiblade radial fan is desirably used under the condition of maximum efficiency of the impeller. Conventionally the maximum efficiency of the impeller has been achieved by trial and error. There has been no method for systematically deriving the condition of maximum efficiency of the impeller. Thus, the conventional multiblade radial fan has not always been used under the condition of maximum efficiency of the impeller.

An object of the present invention is to provide a method for driving the impeller of a multiblade radial fan under a systematically derived condition of maximum efficiency.

According to the present invention, there is provided a method for driving the impeller of a multiblade radial fan, wherein the impeller is driven so as to make the flow coefficient $\phi$ equal to $0.295\epsilon(1-nt/(2\pi r))\xi^{1.641}$ (where $0.75\leqq\epsilon\leqq1.25$, n: number of the radially directed blades, t: thickness of the radially directed blades, r: outside radius of the impeller, $\xi$: diameter ratio of the impeller).

According to a preferred embodiment of the present invention, $\xi$ satisfies the formula $0.4\leqq\xi\leqq0.8$.

The total pressure efficiency of the impeller of the multiblade radial fan becomes maximum when the flow coefficient $\phi$ is equal to $0.295\xi(1-nt/(2\pi r))\xi^{1.641}$ (where $0.75\leqq\xi\leqq1.25$, n: number of the radially directed blades, t: thickness of the radially directed blades, r: outside radius of the impeller, $\xi$: diameter ratio of the impeller). Thus, the impeller of the multiblade radial fan can be driven under the condition of maximum efficiency by being driven so as to make the flow coefficient $\phi$ equal to $0.295\epsilon(1-nt/(2\pi r))\xi^{1.641}$.

BRIEF DESCRIPTION OF THE DRAWINGS

In the drawings:

FIG. 2(*b*) is a sectional view taken along line b—b in FIG. 2(*a*).

THE BEST MODE FOR CARRYING OUT THE INVENTION

I. Invention relating to the design criteria for achieving compatibility between the impeller and the scroll type casing accommodating the impeller of the multiblade radial fan.

Preferred embodiments of the present invention will be described.

A. Performance test of the impeller alone

Measurement tests of the total pressure efficiency of the impeller alone were carried out on multiblade radial fans with different diameter ratios.

(1) Test conditions (a) Measuring apparatus

Figure 1:
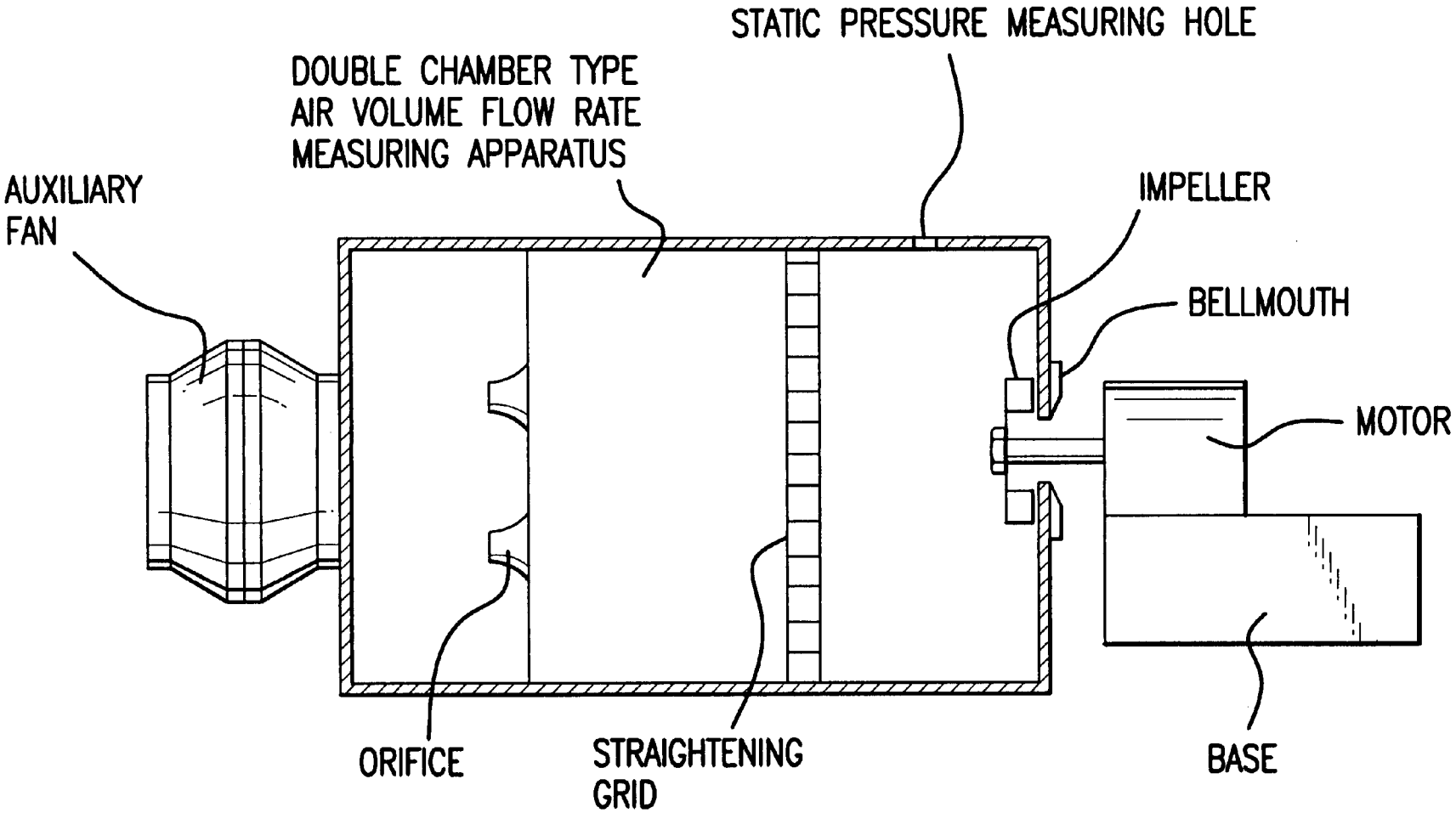
FIG. 1 is a diagram showing the layout of a measuring apparatus for measuring air volume flow rate and static pressure of an impeller used for measuring the efficiency of the impeller alone.

The measuring apparatus is shown in FIG. 1. An impeller was put in a double chamber type air volume flow rate measuring apparatus (product of Rika Seiki Co. Ltd., Type F-401). A motor for driving the impeller was disposed outside of the the air volume flow rate measuring apparatus.

The air volume flow rate measuring apparatus was provided with a bellmouth opposite the impeller. The air volume flow rate measuring apparatus was provided with an air volume flow rate control damper and an auxiliary fan for controlling the static pressure near the impeller. The air flow discharged from the impeller was straightened by a straightening grid.

The air volume flow rate of the impeller was measured using orifices located in accordance with the AMCA standard.

The static pressure near the impeller was measured through a static pressure measuring hole disposed near the impeller.

(b) Tested impellers

Figure 2A:
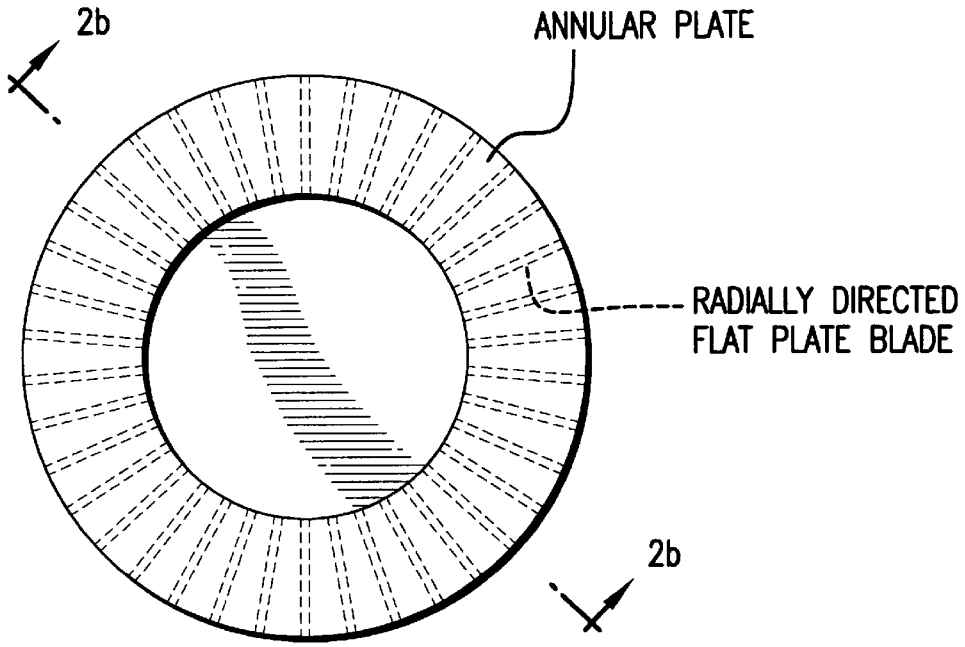
FIG. 2(*a*) is a plan view of a tested impeller.
Figure 2B:
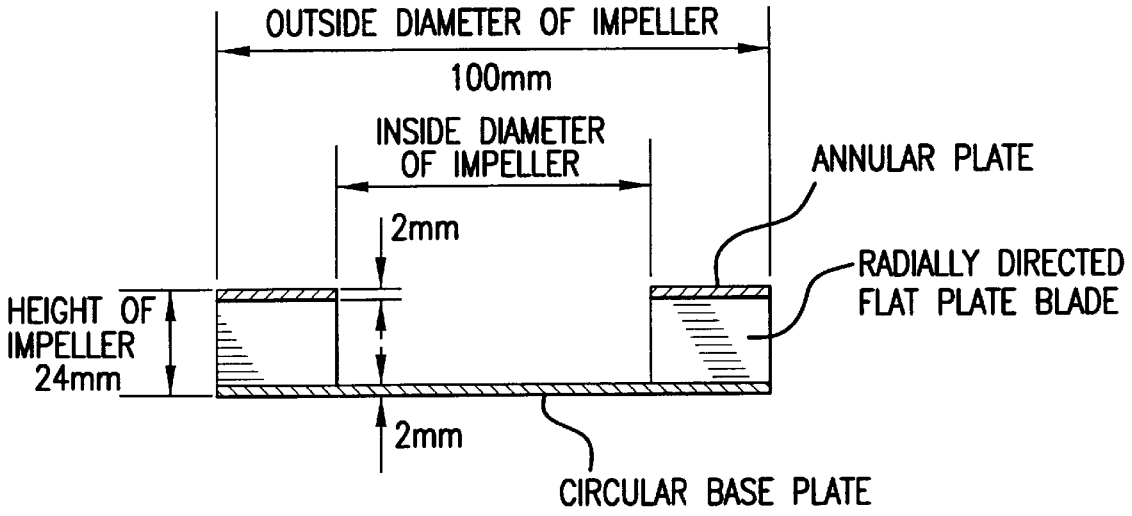
Figure 3:
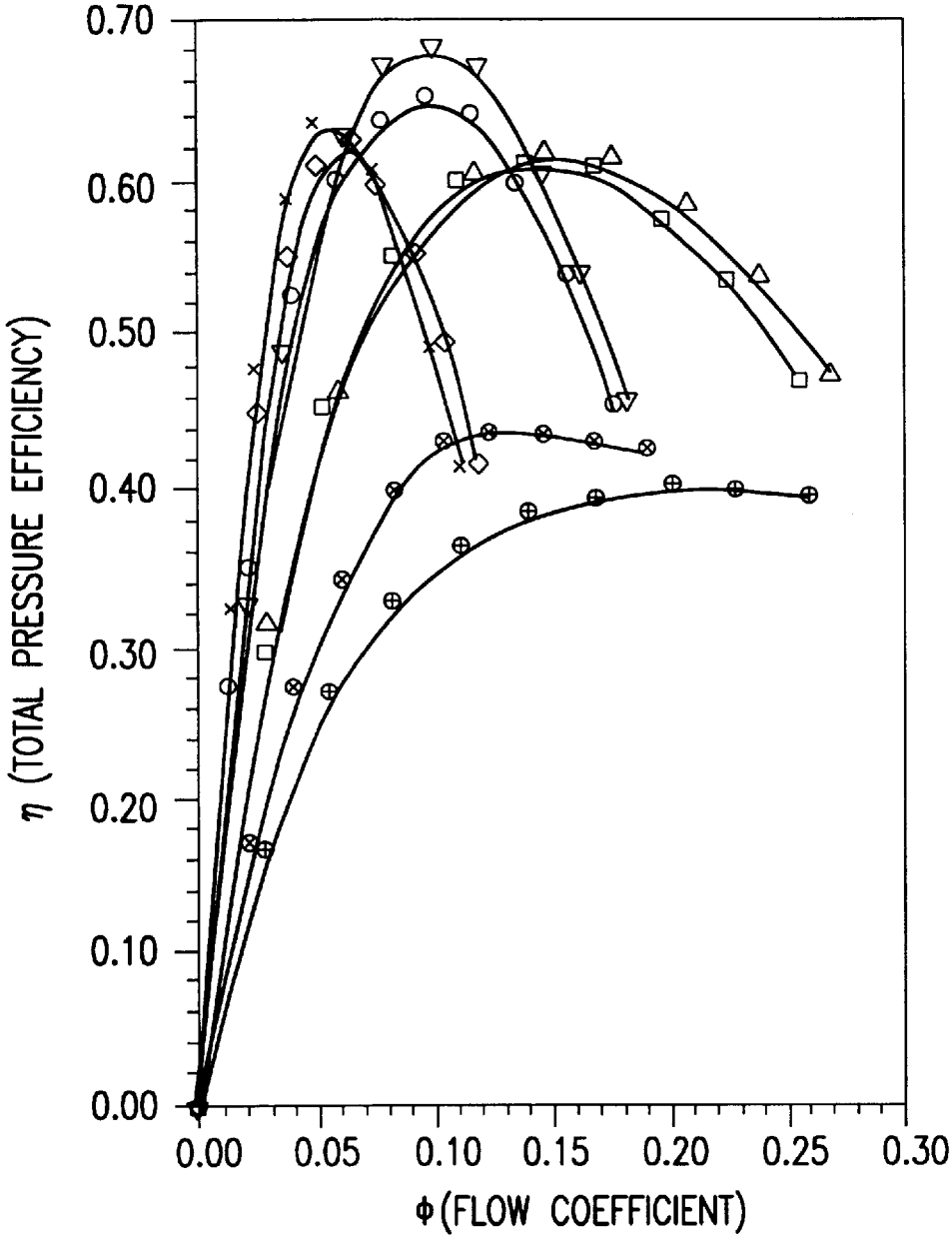
FIG. 3 shows experimentally obtained correlation diagrams between the total pressure coefficient of the impeller alone and the flow coefficient $\phi$.

The outside diameter and the height of all tested impellers were 100 mm and 24 mm respectively. The thickness of the circular base plate and the annular top plate of all tested impellers was 2 mm. Impellers with four different inside diameters were made. Different impellers had a different number of radially directed flat plate blades disposed at equal circumferential distances from each other and different blade thickness. A total of 8 kinds of impellers were made and tested. The particulars of the tested impellers are shown in Table 1, and FIGS. 2(*a*) 2(*b*).

(2) Measurement, Data processing (a) Measurement

The air volume flow rate of the air discharged from the impeller and the static pressure at the outlet of the impeller were measured for each other of the 8 kinds of impellers shown in Table 1 when rotated at the revolution speed shown in Table 1, while the air volume flow rate of the air discharged from the impeller was varied using the air volume flow rate control damper.

(b) Data processing

From the measured value of the air volume flow rate of the air discharged from the impeller and the static pressure at the outlet of the impeller, a total pressure efficiency defined by the following formula was obtained.

$\eta=(P_s+P_v)Q/W$

In the above formula, $\eta$: total pressure efficiency $P_s$: static pressure $P_v$: $(\rho/2)(u^2v^2)$: dynamic pressure $\rho$: density of the air $u=Q/S$: radial velocity of the air at the outlet of the impeller $v=r\omega$: circumferential velocity of the outer periphery of the impeller $S=2\pi rh$: outlet sectional area of the impeller Q: air volume flow rate of the air discharged from the impeller W: power r: outside radius of the impeller h: height of the blade of the impeller $\omega$: angular velocity of revolution (3) Test results Based on the results of the measurements, a correlation between the total pressure efficiency $\eta$ of the impeller alone and the flow coefficient of the impeller $\phi$ expressed by the following formula was obtained for each tested impeller. The correlations are shown in FIG. 43.

$\phi=u/v$

Based on the results of the measurements, a correlation between the total pressure efficiency $\eta$ of the impeller alone and the flow coefficient of the impeller $\phi_x$ based on the outlet sectional area of the interblade channel expressed by the following formula was obtained for each tested impeller. The correlations are shown in FIG. 4.

$\phi_x=u_x/v$

Figure 4:
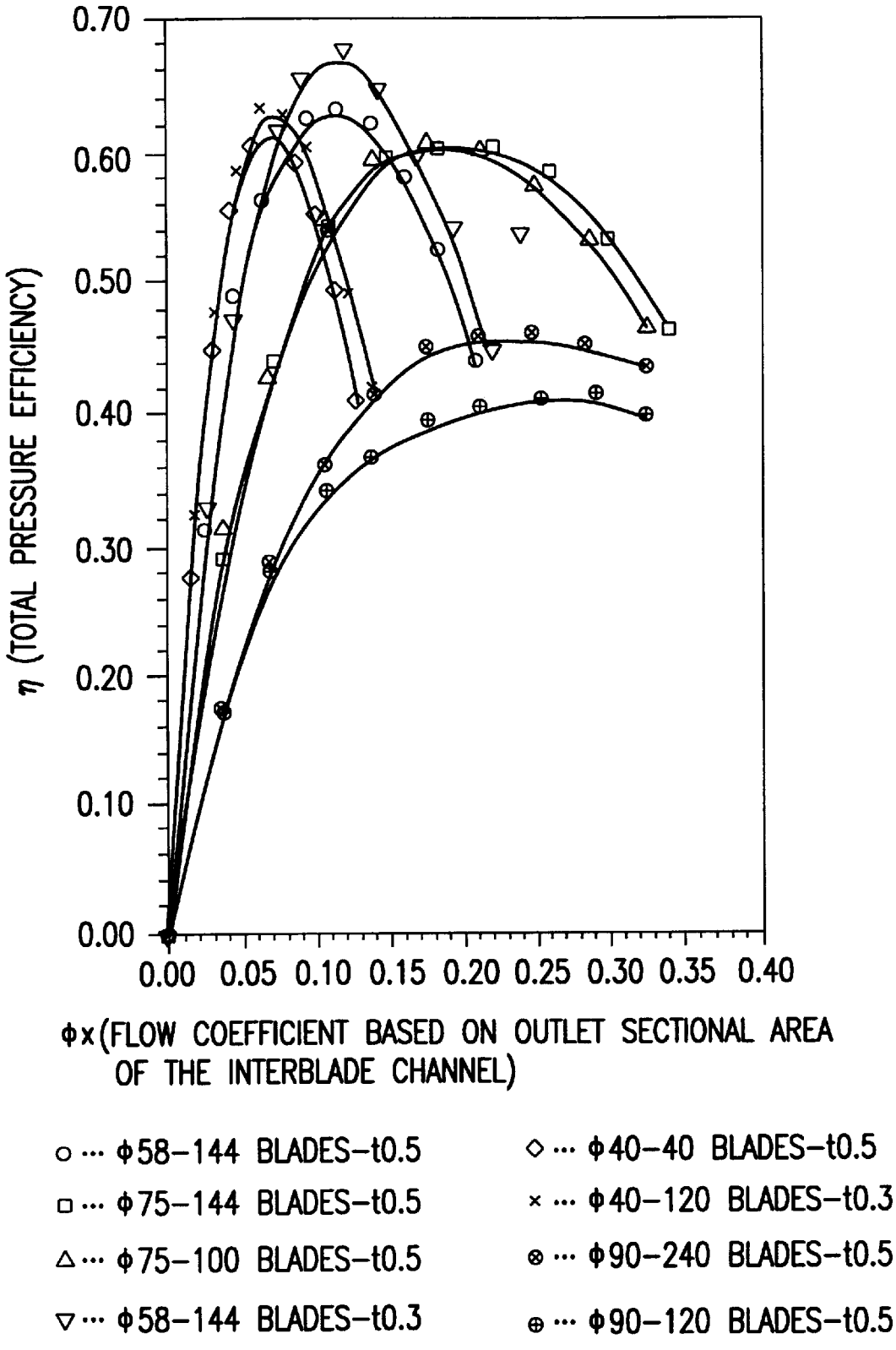
FIG. 4 shows experimentally obtained correlation diagrams between the total pressure coefficient of the impeller alone and the flow coefficient $\phi_x$ based on the outlet sectional area of the interblade channel.

In the above formula, $u_x=Q/S_x$: radial air velocity at the outlet of the impeller based on the outlet sectional area of the interblade channel $S_x=(2\pi r-nt)h$: outlet sectional area of the impeller based on the outlet sectional area of the interblade channel n: number of the radially directed blades t: thickness of the radially directed blades As is clear from FIG. 4, the flow coefficient of the impeller $\phi_x$ based on the outlet sectional area of the interblade channel which gives the maximum value of the total pressure efficiency $\eta$ depends on the diameter ratio of the impeller only and not on the number of the blades or the breadth of the interblade channel.

Figure 5:
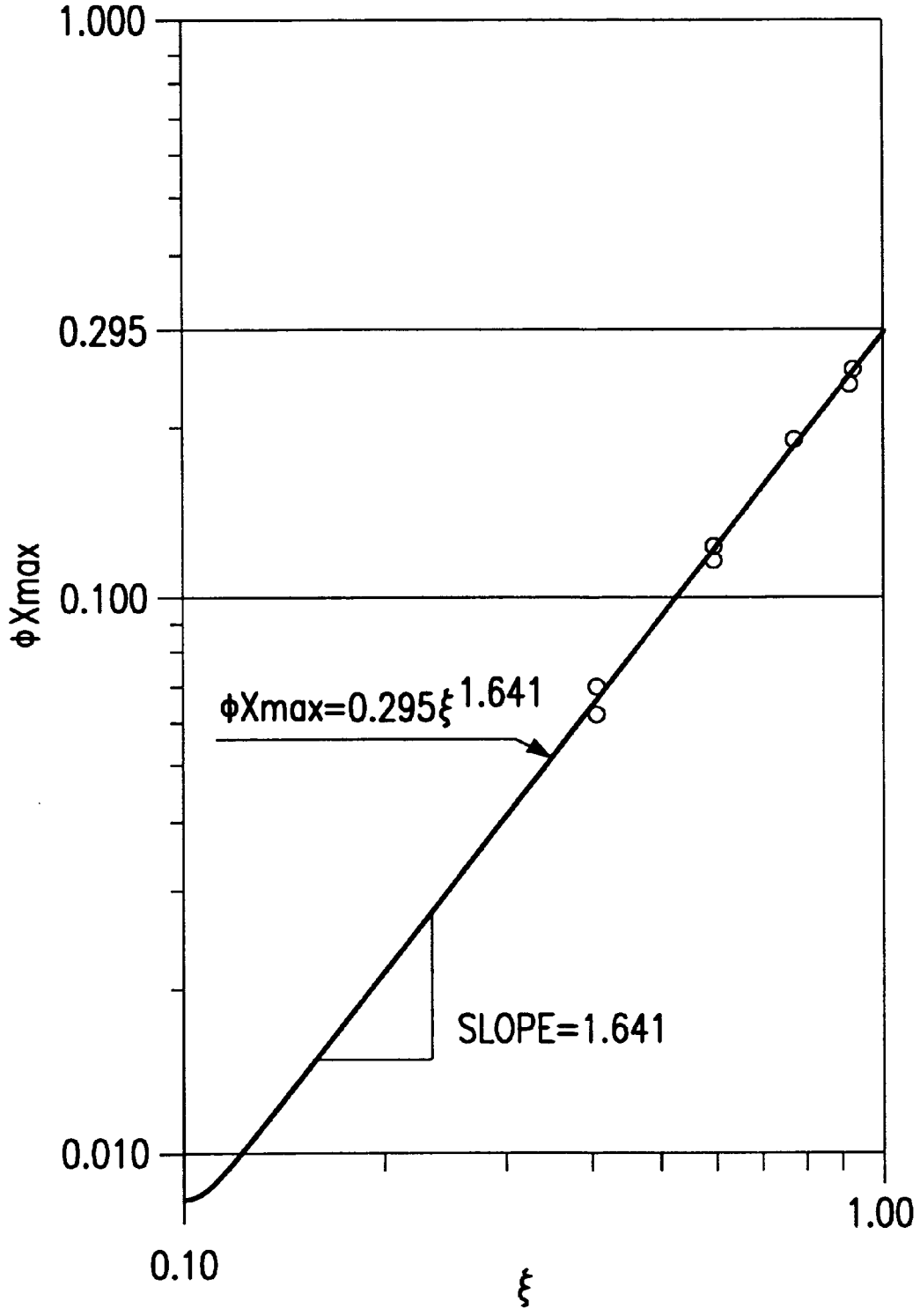
FIG. 5 shows correlation between the diameter ratio $\xi$ of the impeller and the flow coefficient $\phi_{Xmax}$ based on the outlet sectional area of the interblade channel which gives the maximum total pressure efficiency of the impeller alone plotted on a log—log graph.

Correlation between the diameter ratio of the impeller $\xi$ and the flow coefficient $\phi_{Xmax}$ based on the outlet sectional area of the interblade channel which gives the maximum value of the total pressure efficiency $\eta$ was obtained from FIG. 4. FIG. 5 shows the correlation plotted on a log—log graph. As is clear from FIG. 5, the correlation between $\phi_{Xmax}$ and $\xi$ defines a straight line with the inclination of 1.641 on a log—log graph.

As described above, the correlation between $\phi_{Xmax}$ and $\xi$ is expressed by the following formula 1.

$$\phi_{Xmax}=0.295\xi^{1.641} \quad 1$$

In the above formula, $\phi_{Xmax}$: flow coefficient based on the outlet sectional area of the interblade channel which gives the maximum value of the total pressure efficiency $\eta$ $\xi=D_1/D$: diameter ratio of the impeller $D_1$: inside diameter of the impeller D: outside diameter of the impeller $\phi_{max}$ corresponding to $\phi_{Xmax}$ can be derived from formula 1, the definition of $\phi$, i.e. $\phi=u/v$, and the definition of $\phi_x$, *i.e.* $\phi_x=u_x/v$ (where $u_x=Q/S_x$: radial air velocity at the outlet of the impeller based on the outlet sectional area of the interblade channel, $S_x=(2\pi r-nt)h$: outlet sectional area of the impeller based on the outlet sectional area of the interblade channel, n: number of the radially directed blades, t: thickness of the radially directed blades).

$\phi_{max}$ is expressed by the following formula 2.

$$\phi_{\max} = (1 - nt/(2\pi r))\phi_{X\max} \quad 2$$

$$= 0.295(1 - nt/(2\pi r))\xi^{1.641}$$

B. Compatibility between the impeller and the scroll type casing (1) Hypothesis

Figure 6:
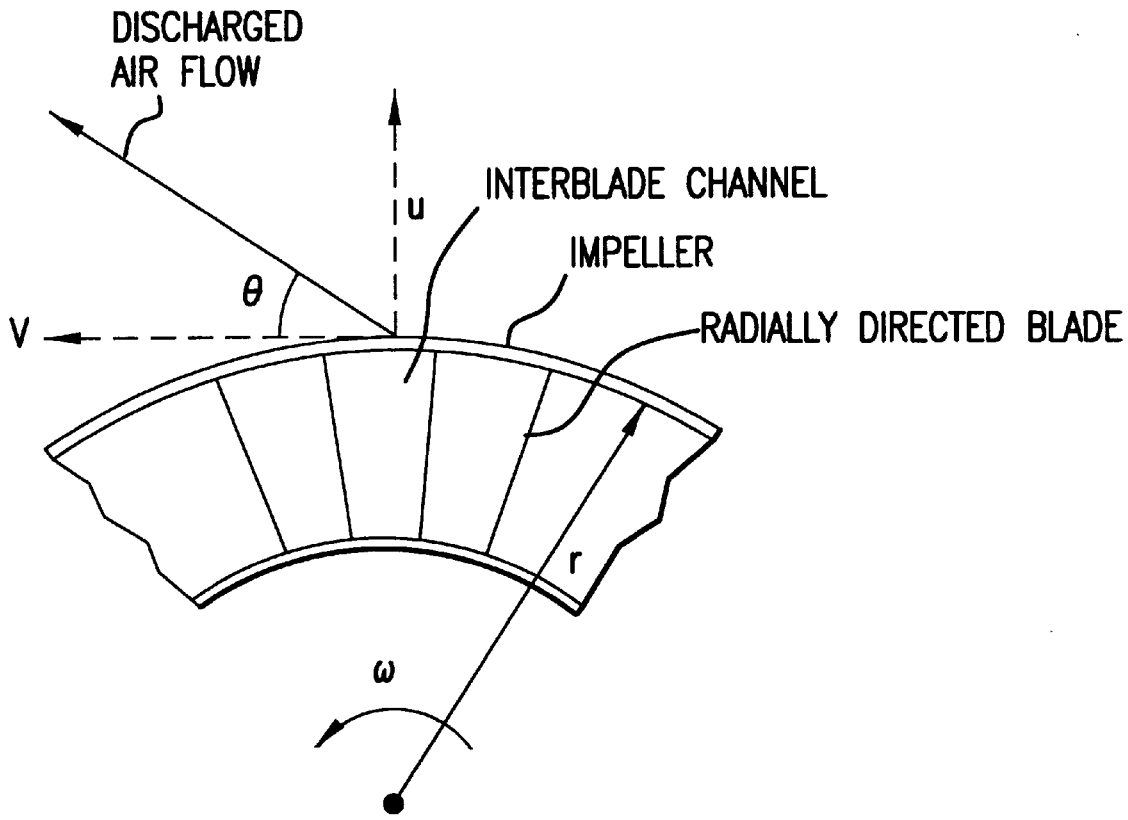
FIG. 6 is an explanatory diagram showing the relation between the flow coefficient $\phi$ and the outlet angle $\theta$ of the air discharged from the impeller.
Figure 7:
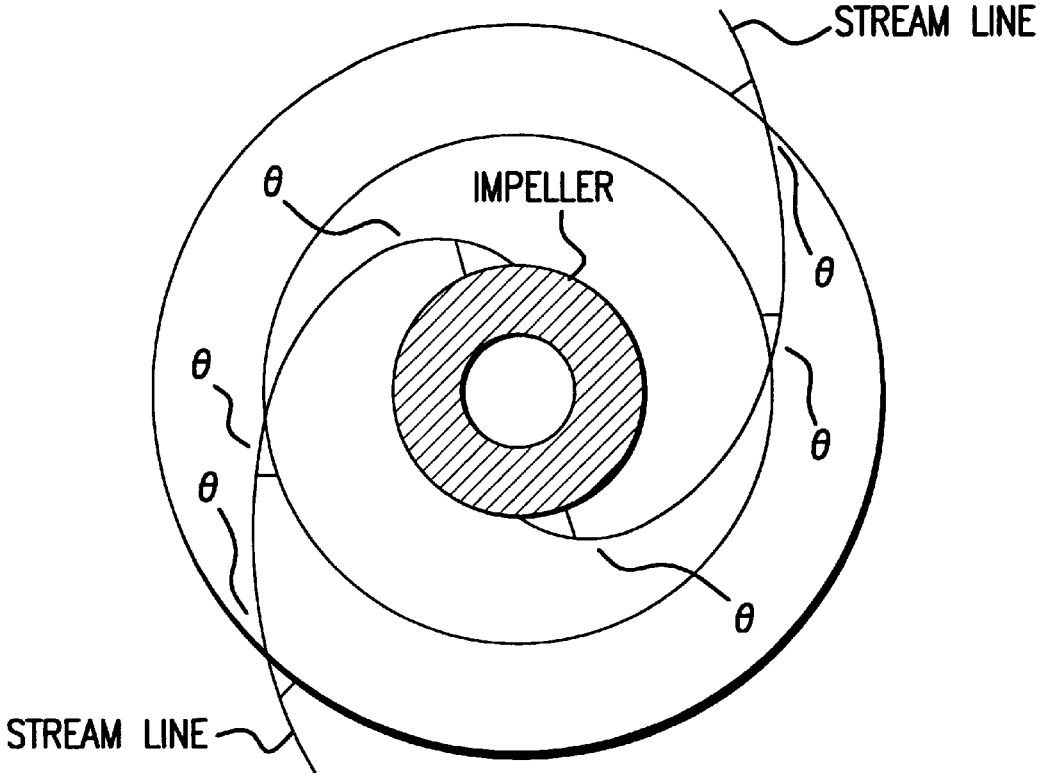
FIG. 7 shows the configuration of the stream line of the air flow discharged from the impeller.

As shown in FIG. 6, flow coefficient $\phi$ ($\phi=u/v$) is the tangent of the outlet angle $\eta$ of the air discharged from the impeller. It is thought that the air discharged from the impeller forms a free vortex. Thus, as shown in FIG. 7, the crossing angle of concentric circle whose center coincides with the rotation center of the impeller and the stream line of the air discharged from the impeller is kept at the outlet angle $\theta$ of the air discharged from the impeller, i.e. $\tan^{-1}\phi$, irrespective of the distance from the rotation center of the impeller. Thus, it is thought that compatibility between the scroll type casing and the impeller is achieved and the quietness of the multiblade radial fan is optimized when the divergence angle $\theta_z$ (logarithmic spiral angle) of the scroll type casing coincides with $\tan^{-1}\phi$.

Based on the aforementioned results of the measurement test of the total pressure efficiency of the impeller alone and the aforementioned discussion about compatibility between the scroll type casing and the impeller, it is thought that a multiblade radial fan with optimized quietness, wherein compatibility between the scroll type casing and the impeller is achieved and the sound level is minimized when the impeller is driven under the condition of the maximum total pressure efficiency, can be designed by setting the divergence angle $\theta_z$ of the scroll type casing at the arctangent of $\phi_{max}$, i.e. $\tan^{-1}\phi_{max}$, obtained by the aforementioned formula 2.

Figure 8:
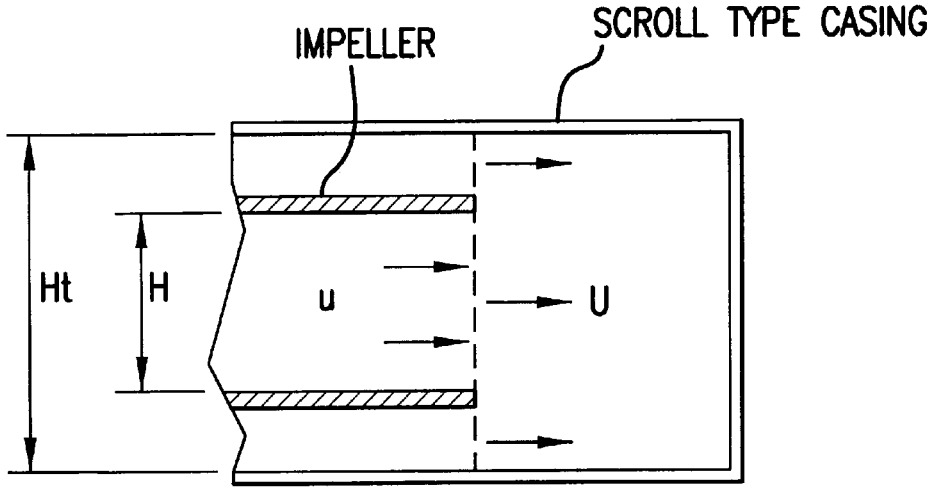
FIG. 8 is an explanatory diagram showing the relation between the radial velocity of the air u at the outlet of the impeller and radial velocity of the air U in the portion of the scroll type casing adjacent to the outlet of the impeller.

As shown in FIG. 8, the height H of the radially directed blades of the impeller is different from the height $H_t$ of the scroll type casing accommodating the impeller. Thus, when the radial air velocity at the outlet of the impeller is u, the radial air velocity U in the portion of the scroll type casing for accommodating the impeller adjacent the outlet of the impeller is $U=u(H/H_t)$. Thus, the flow coefficient $\phi_s$ of the impeller against the scroll type casing is $\phi_s=(H/_t)\ \phi$ (where $\phi$: flow coefficient of impeller alone) and the $\phi_{Smax}$ is $\phi_{Smax}=(H/h_t)\ \phi_{max}$.

From the above, it is thought that a multiblade radial fan with optimized quietness wherein compatibility between the scroll type casing and the impeller is achieved and the sound level is minimized when the impeller is driven under the condition of the maximum total pressure efficiency can be designed by determining the divergence angle $\theta_z$ of the scroll type casing based on the following formula 3.

$$\begin{aligned}\theta_z &= \tan^{-1}\phi_{Smax} \\ &= \tan^{-1}[(H/H_t)\phi_{max}] \\ &= \tan^{-1}[0.295(1-nt/(2_\pi r))(H/H_t)\xi^{1.641}]\end{aligned} \quad 3$$

(2) Confirmation test of compatibility between the scroll type casing and the impeller It was confirmed by measurements that the quietness of the multiblade radial fan is optimized when the divergence angle $\theta_z$ of the scroll type casing satisfies the formula 3.

Figure 9:
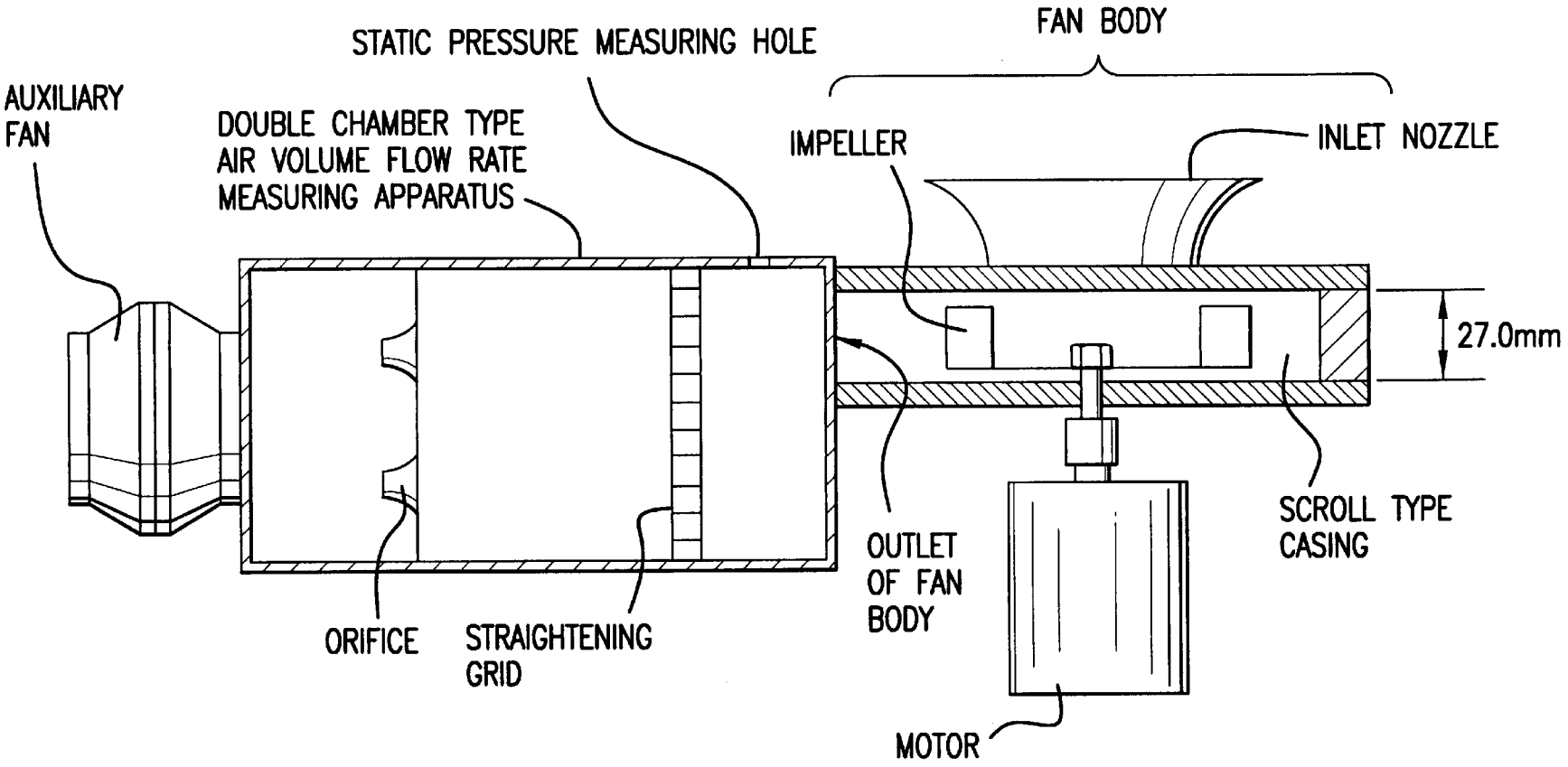
FIG. 9 is a diagram showing the layout of a measuring apparatus for measuring air volume flow rate and static pressure of a multiblade radial fan.

(a) Measuring apparatuses (i) Measuring apparatus for measuring air volume flow rate and static pressure The measuring apparatus used for measuring air volume flow rate and static pressure is shown in FIG. 9. The fan body of the multiblade radial fan had an impeller, a scroll type casing for accommodating the impeller and a motor. An inlet nozzle was disposed on the suction side of the fan body. A double chamber type air volume flow rate measuring apparatus (product of Rika Seiki Co. Ltd., Type F-401) was disposed on the discharge side of the fan body. The air volume flow rate measuring apparatus was provided with an air volume flow rate control damper and an auxiliary fan for controlling the static pressure at the outlet of the fan body. The air flow discharged from the fan body was straightened by a straightening grid.

The air volume flow rate of the fan body was measured using orifices located in accordance with the AMCA standard.

The static pressure at the outlet of the fan body was measured through a static pressure measuring hole disposed near the outlet of the fan body.

(ii) Measuring apparatus for measuring sound pressure level

Figure 10:
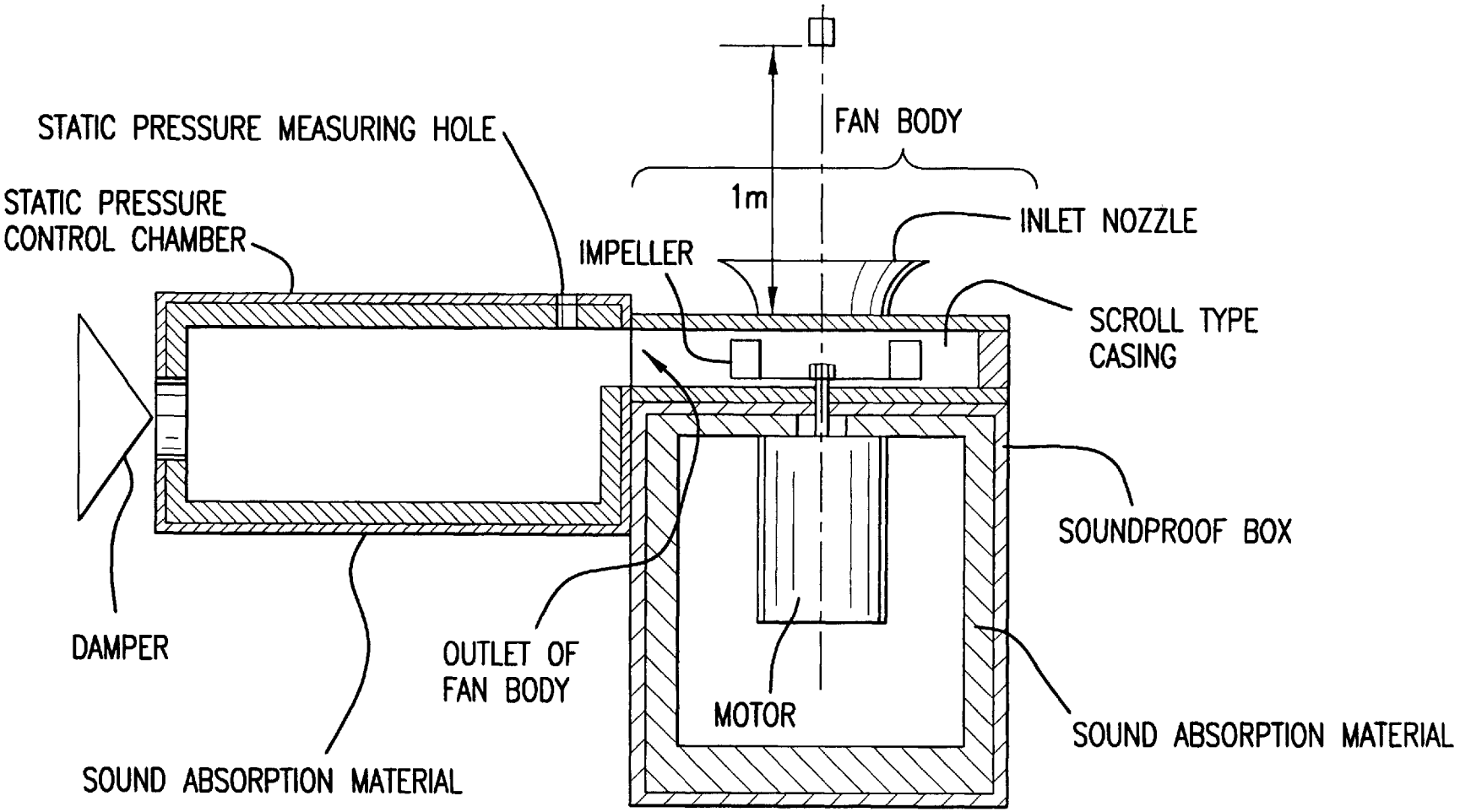
FIG. 10 is a diagram showing the layout of a measuring apparatus for measuring the sound pressure level of a multiblade radial fan.
Figure 11:
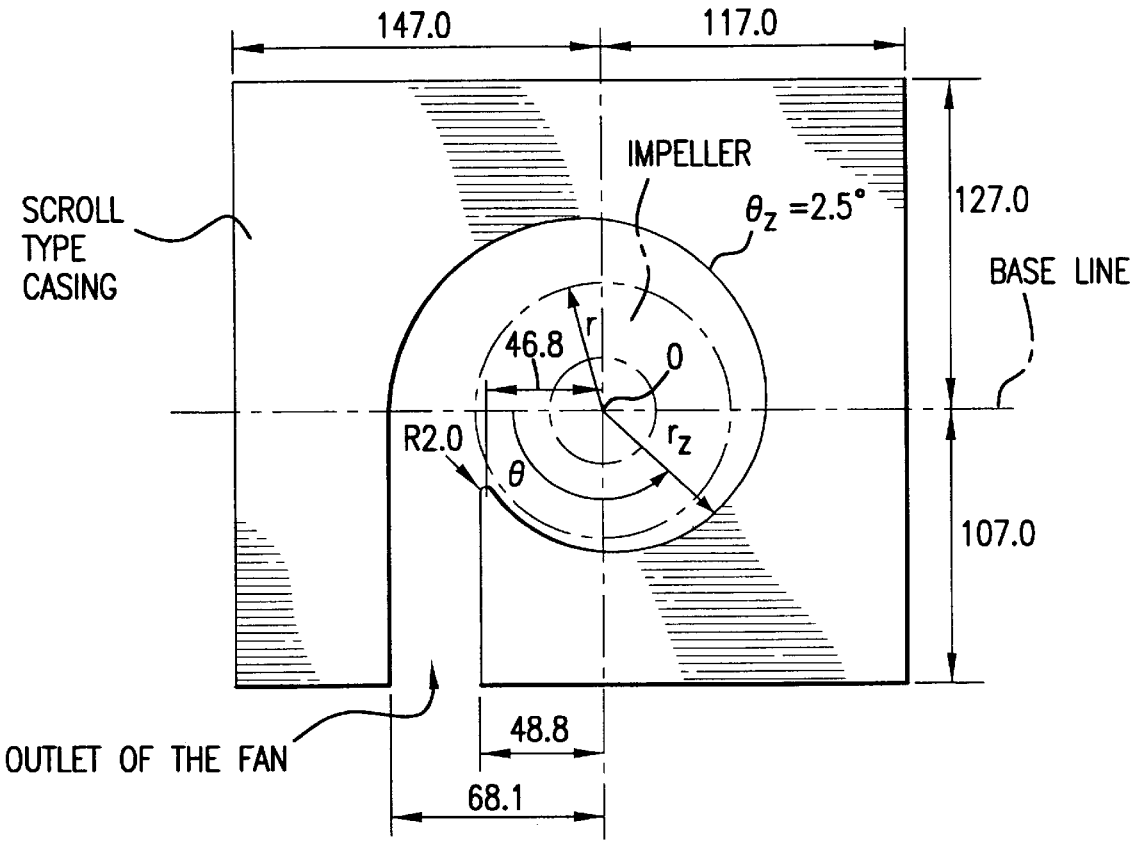
FIG. 11 is a plan view of a tested casing used for measuring the sound pressure level of a multiblade radial fan.
Figure 12:
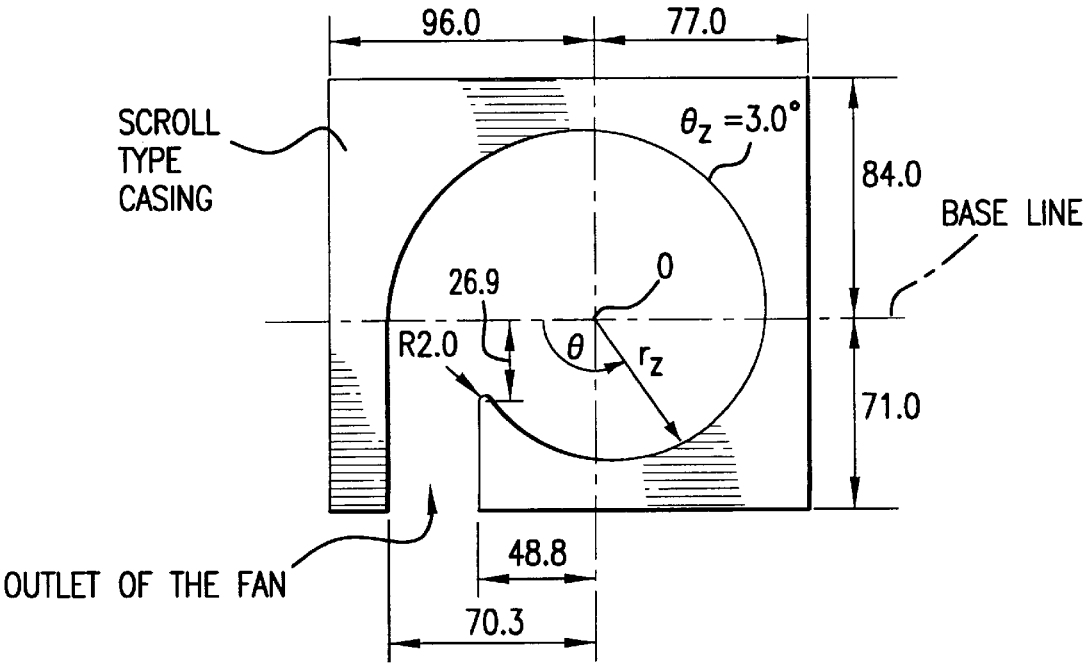
FIG. 12 is a plan view of a tested casing used for measuring the sound pressure level of a multiblade radial fan.
Figure 13:
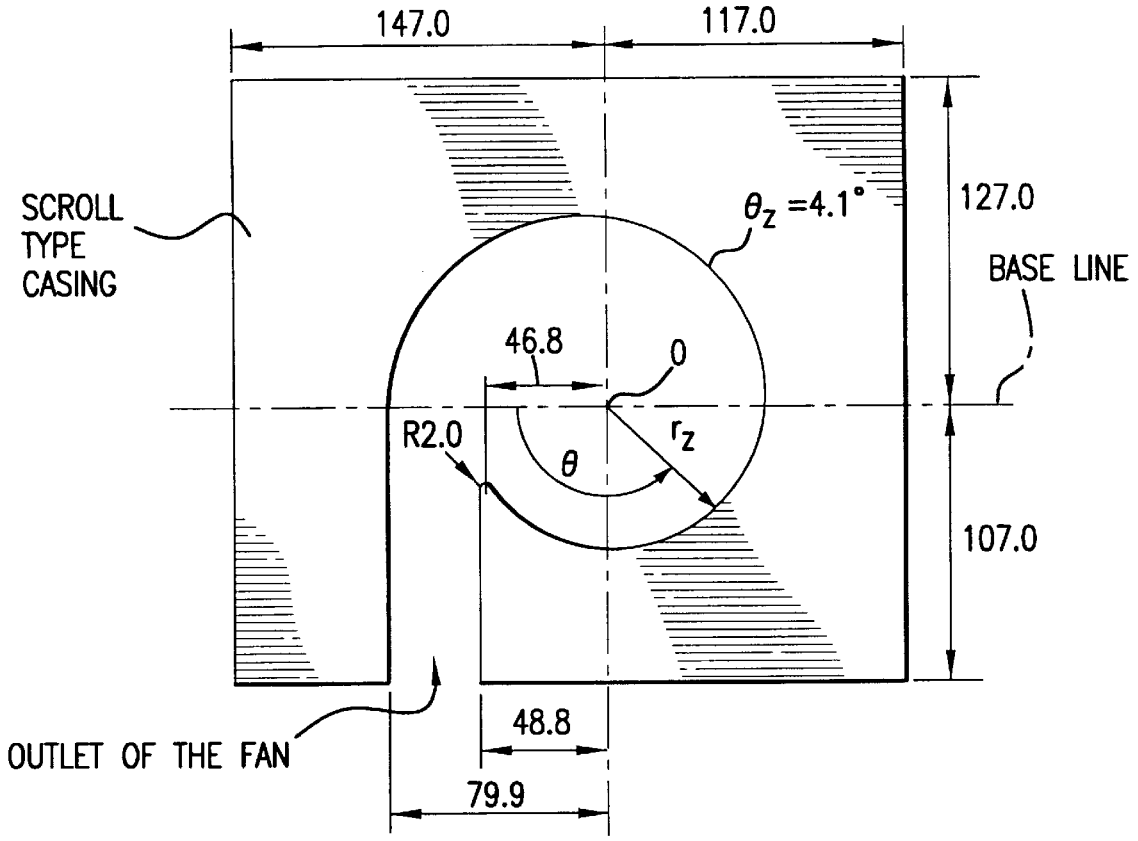
FIG. 13 is a plan view of a tested casing used for measuring the sound pressure level of a multiblade radial fan.
Figure 14:
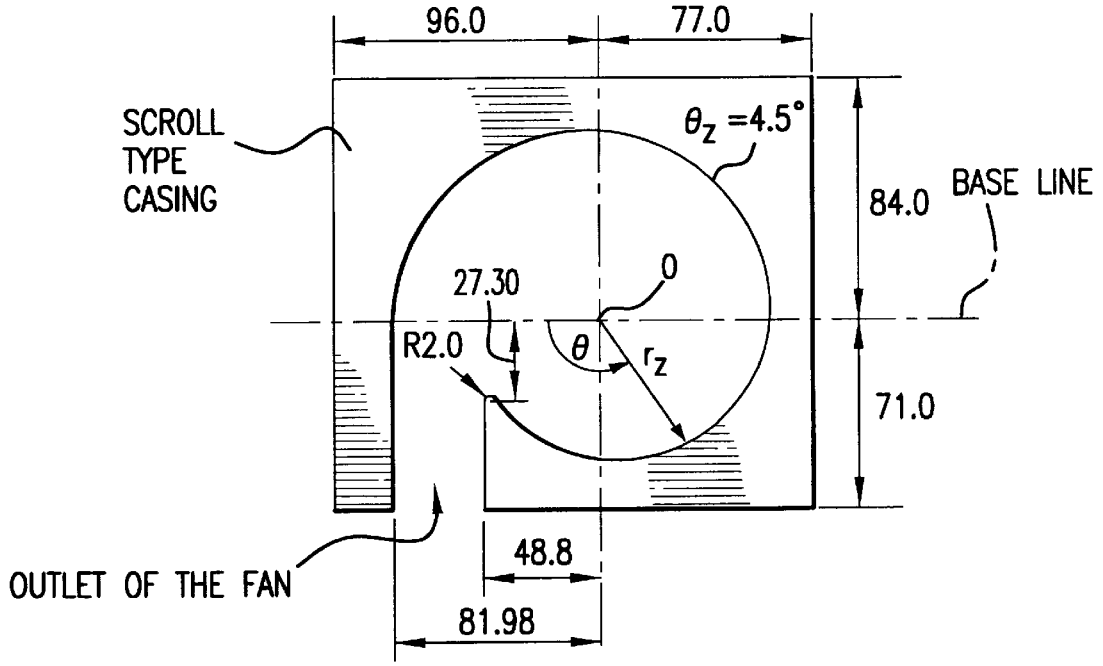
FIG. 14 is a plan view of a tested casing used for measuring the sound pressure level of a multiblade radial fan.
Figure 15:
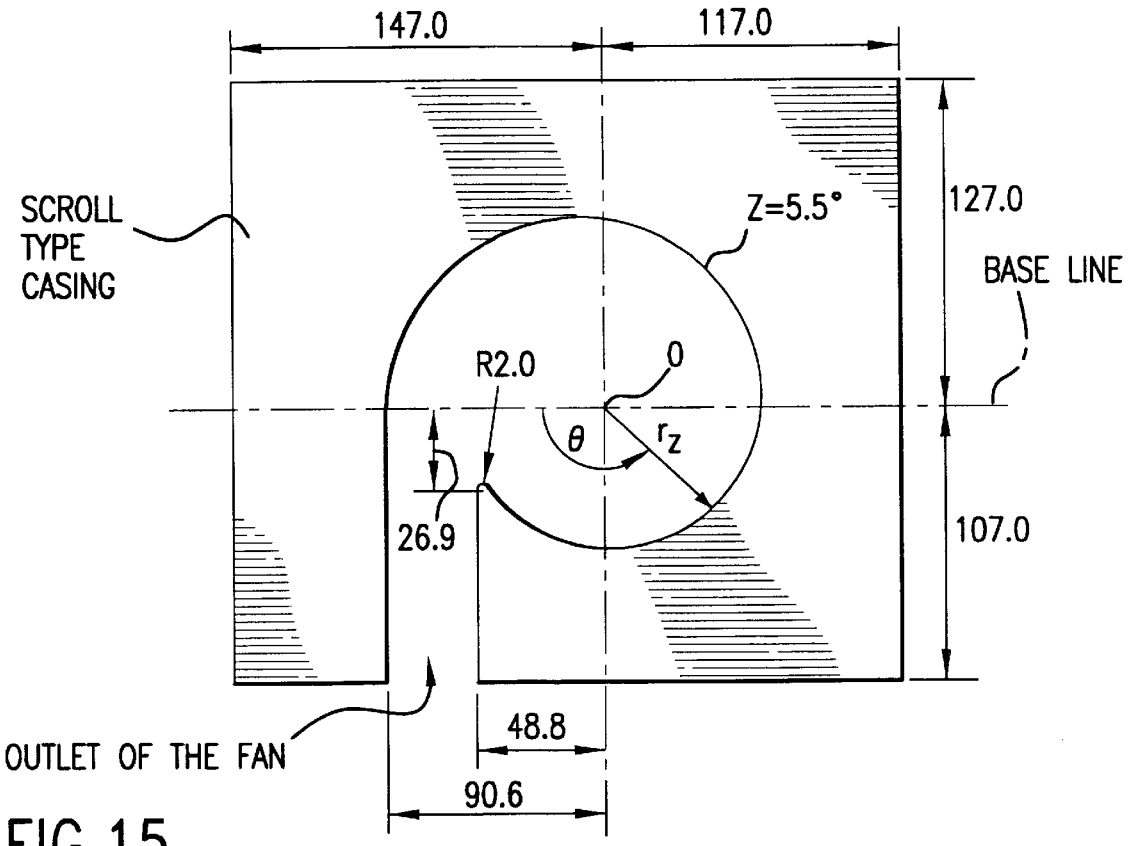
FIG. 15 is a plan view of a tested casing used for measuring the sound pressure level of a multiblade radial fan.
Figure 16:
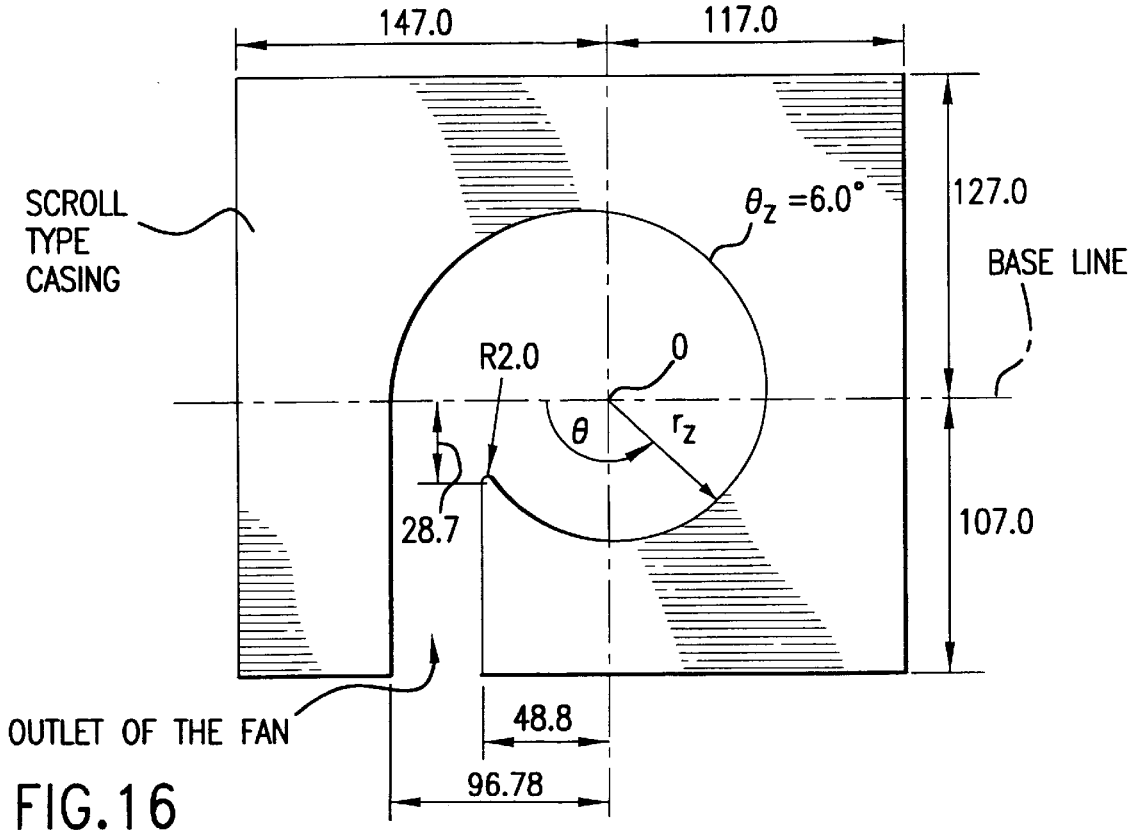
FIG. 16 is a plan view of a tested casing used for measuring the sound pressure level of a multiblade radial fan.
Figure 17:
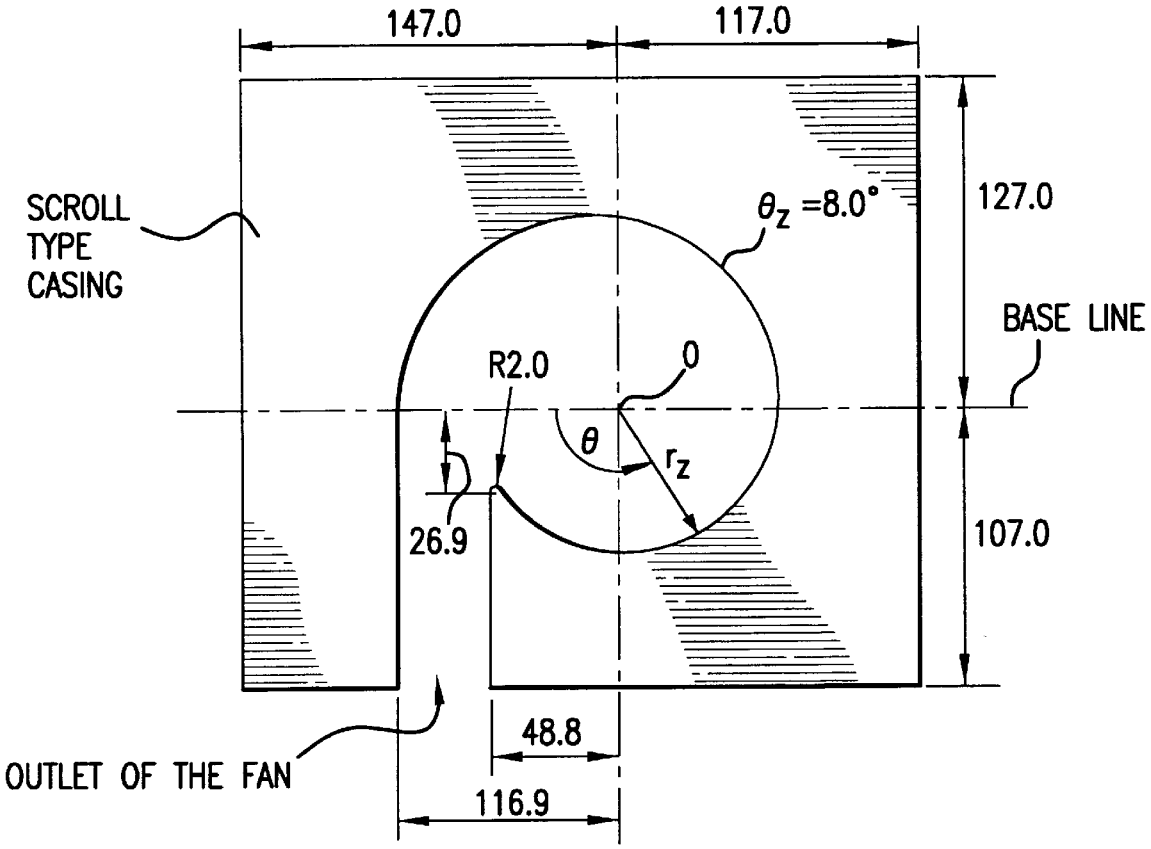
FIG. 17 is a plan view of a tested casing used for measuring the sound pressure level of a multiblade radial fan.

The measuring apparatus for measuring sound pressure level is shown in FIG. 10. An inlet nozzle was disposed on the suction side of the fan body. A static pressure control chamber of a size and shape similar to those of the air volume flow rate measuring apparatus was disposed on the discharge side of the fan body. The inside surface of the static pressure control chamber was covered with sound absorption material. The static pressure control chamber was provided with an air volume flow rate control damper for controlling the static pressure at the outlet of the fan body.

The static pressure at the outlet of the fan body was measured through a static pressure measuring hole located near the outlet of the fan body. The sound pressure level corresponding to a certain level of the static pressure at the outlet of the fan body was measured.

The motor was installed in a soundproof box lined with sound absorption material. Thus, the noise generated by the motor was confined.

The measurement of the sound pressure level was carried out in an anechoic room. The A-weighted sound pressure level was measured at a point on the centerline of the impeller and 1 m above the upper surface of the casing.

(b) Test impellers, Tested casings (i) Tested impellers

No.1 impeller ($\xi$=0.4). No.4 impeller ($\xi$=0.58) and No.5 impeller ($\xi$=0.75) in Table 1 were used as tested impellers.

(ii) Tested casings

The height of the scroll type casing was 27 mm. The divergence configuration of the scroll type casing was a logarithmic spiral defined by the following formula. The divergence angle $\theta_z$ was 2.5°, 3.0°,4.5°, 5.5° and 8.0° for No.1 impeller, 3.5°, 4.1°, 4.5°, 5.5° and 8.0° for No.4 impeller and 3.0°, 4.5°, 5.5°, 6.0° and 8.0° for No.5 impeller.

$r_z=r[\exp(\Phi\ \tan\theta_2)]$

In the above formula, $r_z$: radius of the side wall of the casing measured from the center of the impeller r: outside radius of the impeller $\Phi$: angle measured from a base line, $0\leqq\Phi\leqq2\pi$ $\phi_z$: divergence angle of the scroll type casing The tested casings are shown in FIG. 11 to FIG. 17.

(iii) Revolution speed of the impeller

The revolution speeds of the impeller during the measurement are shown in Table 1.

(c) Measurement

The air volume flow rate of the air discharged from the fan body, the static pressure at the outlet of the fan body, and the sound pressure level were measured for each of the combination of No.1 impeller ($\xi$=0.4), No.4 impeller ($\xi$=0.58), No.5 impeller ($\xi$=0.75) in Table 1 and the scroll type casings of FIG. 11 to FIG. 17 when rotated at the revolution speed shown in Table 1, while the air volume flow rate of the air discharged from the fan body was varied using the air volume flow rate control damper.

(d) Data processing

From the measured value of the air volume flow rate of the air discharged from the fan body, the static pressure at the outlet of the fan body, and the sound pressure level, a specific sound level $K_s$ defined by the following formula was obtained.

$K_s=SPL(A)-10\log_{10}Q(P_t)^2$

In the above formula,

SPL(A): A-weighted sound pressure level, dB

Q: air volume flow rate of the air discharged from the fan body, $m^3/S$ $P_t$: total pressure at the outlet of the fan body, mmAq (e) Test results Based on the results of the measurements, a correlation between the specific sound level $K_s$ and the air volume flow rate was obtained for each combination of No.1 impeller, No.4 impeller and No.5 impeller in Table 1 and the scroll type casings of FIG. 11 to FIG. 17.

The correlation between the specific sound level $K_s$ and the air volume flow rate Q was obtained on the assumption that a correlation wherein the specific sound level $K_s$ is $K_{s1}$ when the air volume flow rate Q is $Q_1$ exists between the specific sound level $K_s$ and the air volume flow rate Q when the air volume flow rate Q and the static pressure p at the outlet of the fan body obtained by the air volume flow rate and static pressure measurement are $Q_1$ and $p_1$ respectively, while the specific sound level $K_s$ and the static pressure p at the outlet of the fan body obtained by the sound pressure level measurement are $K_{s1}$ and $p_1$ respectively. The above assumption is thought to be reasonable as the size and the shape of the air volume flow rate measuring apparatus used in the air volume flow rate and static pressure measurement are substantially the same as those of the static pressure controlling box used in the sound pressure level measurement.

The measurements showed that the specific sound level $K_s$ of each tested combination of No.1 impeller, No.4 impeller and No.5 impeller in Table 1 and the scroll type casings of FIG. 11 to FIG. 17 varied with the air volume flow rate or the flow coefficient. The variation of the specific sound level $K_s$ is generated by the effect of the casing. Thus, it can be assumed that the minimum value of the specific sound level $K_s$, i.e. the minimum specific sound level $K_{Smin}$ in each combination of No.1 impeller, No.4 impeller and No.5 impeller in Table 1 and the scroll type casings of FIG. 11 to FIG. 17, represents the specific sound level $K_s$ when the outlet angle θ of the air discharged from the impeller against the casing coincides with the divergence angle $\theta_z$ of the scroll type casing and the impeller becomes compatible with the scroll type casing.

Figure 18:
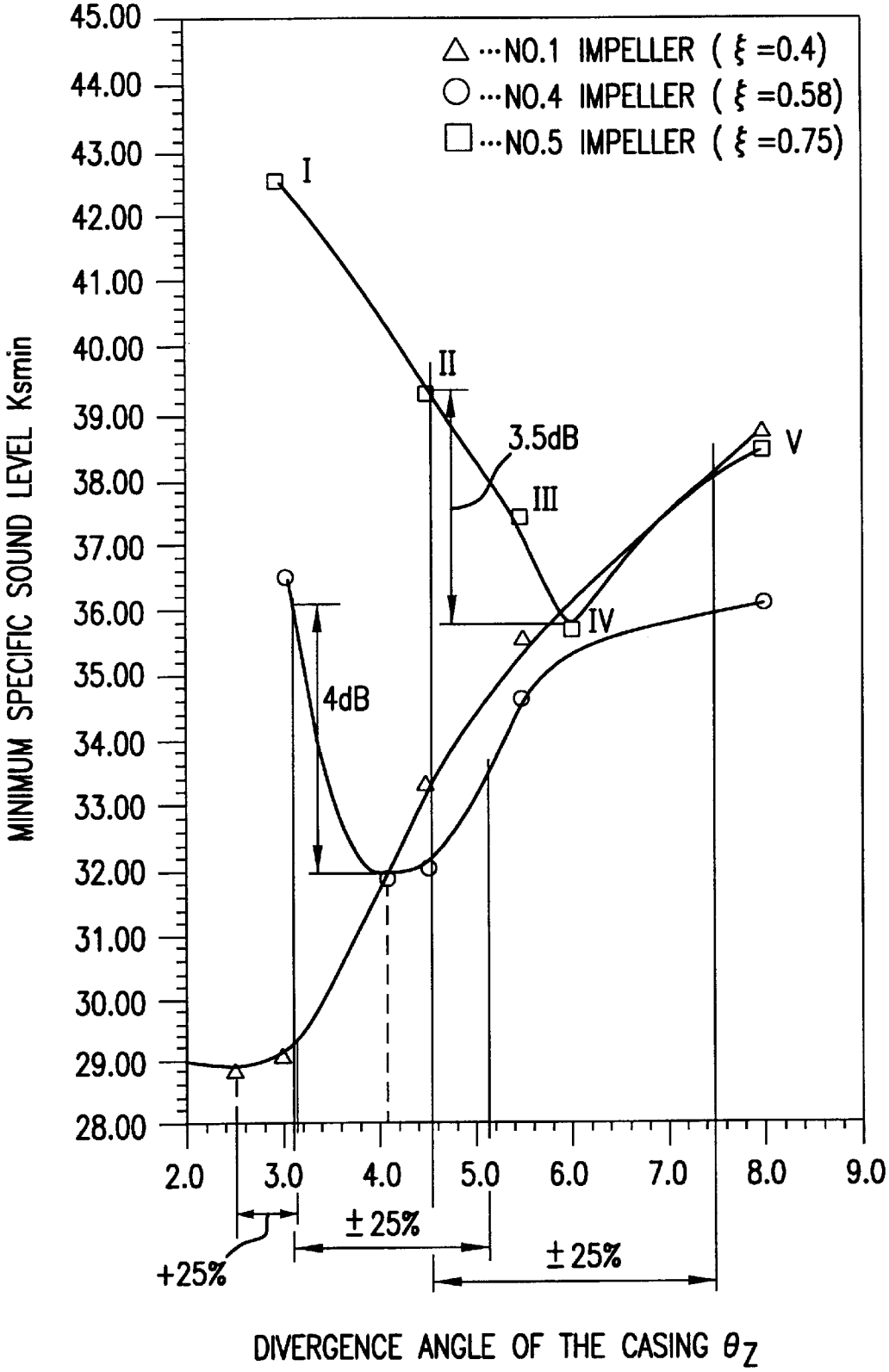
FIG. 18 shows correlation diagram between minimum specific sound level $K_{Smin}$ and divergence angle of the scroll type casing $\theta_z$.

Correlations between the minimum specific sound level $K_{Smin}$ and the divergence angle $\theta_z$ of the scroll type casing are shown in FIG. 18 and No.1 impeller, No.4 impeller and No.5 impeller in Table 1.

(F) Discussion

As is clear from FIG. 18, the minimum specific sound level $K_{Smin}$ is minimized when the divergence angle $\theta_z$ of the scroll type casing is 2.5° in No.1 impeller, the minimum specific sound level $K_{Smin}$ is minimized when the divergence angle $\theta_z$ of the scroll type casing is 4.1° in No.4 impeller, and the minimum specific sound level $K_{Smin}$ is minimized when the divergence angle $\theta_z$ of the scroll type casing in 6.0° in No.5 impeller. On the other hand, the optimum value of the divergence angle $\theta_z$ of the scroll type casing for No.1 impeller, No.4 impeller and No.5 impeller obtained by formula 3 are 2.46°, 3.94° and 5.99°, respectively. Thus, the divergence angle of the scroll type casing which minimizes the minimum specific sound level $K_{Smin}$ is in good agreement with the optimum divergence angle of the scroll type casing obtained by formula 3.

The follow facts are clear from the above.

(c) Results of the measurements for No.5 impeller (ξ=0.75) shown in FIG. 18 should be observed. The minimum specific sound level $K_{Smin}$ in each measured combination is shown in FIG. 18. As mentioned earlier, the outlet angle θ of the air discharged from the impeller against the scroll type casing coincides with the divergence angle $\theta_z$ of the scroll type casing, and the flow coefficient $\phi_s$ of the impeller against the scroll type casing is $\tan\theta_z$ when the specific sound level $K_s$ is $K_{Smin}$. Thus, the flow coefficient $\phi_s$ of the impeller against the scroll type casing is tan3.0° in the measured combination I (the divergence angle $\theta_z$ of the scroll type casing is $\theta_z$=3.0° in the measured combination I), the flow coefficient $\phi_s$ of the impeller against the scroll type casing is tan4.5° in the measured combination II (the divergence angle $\theta_z$ of the scroll type casing is $\theta_z$=4.5° in the measured combination II), the flow coefficient $\phi_s$ of the impeller against the scroll type casing is tan5.5° in the measured combination III (the divergence angle $\theta_z$ of the scroll type casing is $\theta_z$32 5.5° in the measured combination III), the flow coefficient $\phi_s$ of the impeller against the scroll type casing in tan6.0° in the measured combination IV (the divergence angle $\theta_z$ of the scroll type casing is $\theta_z$=6.0° in the measured combination IV), and the flow coefficient $\phi_s$ of the impeller against the scroll type casing is tan8.0° in the measured combination V (the divergence angle $\theta_z$ of the scroll type casing is $\theta_z$=8.0° in the measured combination V).

Supposing that a multiblade radial fan having No.5 impeller installed in the scroll type casing with divergence angle of 6.0° is driven under conditions wherein the flow coefficients $\phi_s$ of the impeller against the scroll type casing are tan3.0°, tan4.5°, tan5.5°, tan6.0° and tan8.0°, then the outlet angle θ of the air discharged from the impeller against the scroll type casing does not coincide with the divergence angle $\theta_z$ ($\theta_z$=6.0°) of the scroll type casing under the driving conditions wherein the flow coefficients $\phi_s$ of the impeller against the scroll type casing are tan3.0°, tan4.5°, tan5.5° and tan8.0°, and the specific sound levels $K_s$ under the driving conditions wherein the flow coefficients $\phi_s$ of the impeller against the scroll type casing are tan3.0°, tan4.5°, tan5.5° and tan8.0° are larger than the minimum specific sound levels in the measured combinations I, II, III and V respectively, On the other hand, the outlet angle θ of the air discharged from the impeller against the scroll type casing coincides with the divergence angle $\theta_z$ ($\theta_z$=6.0°) of the scroll type casing under the driving condition wherein the flow coefficient $\phi_s$ of the impeller against the scroll type casing is tan6.0 °. Thus, the specific sound level $K_s$ under the driving condition wherein the flow coefficient $\phi_s$ of the impeller against the scroll type casing is tan6.0° is equal to the minimum specific sound level in the measured combination VI. Thus, the quietness of the multiblade radial fan having No.5 impeller installed in the scroll type casing with divergence angle of 6.0° is optimized under the driving condition wherein the the flow coefficient $\phi_s$ of the impeller against the scroll type casing is tan6.0°.

As mentioned earlier, the optimum value of the divergence angle $\theta_z$ of the scroll type casing against No.5 impeller obtained by the formula 3 is 5.99°. The divergence angle $\theta_z$ obtained by formula 3 is equal to the arctangent of the flow coefficient $\phi_s$ of the impeller against the scroll type casing when the impeller is driven under the condition wherein the total pressure efficiency η is maximum. Thus, the total pressure efficiency η of No.5 impeller becomes maximum when the flow coefficient $\phi_s$ of the impeller against the scroll type casing is tan5.99 °.

The above discussion proves for No.5 impeller that a multiblade radial fan wherein the quietness is optimized when the impeller is driven under a condition wherein the total pressure efficiency η is maximum can be designed by determining the divergence angle of the scroll type casing based on formula 3.

In the same way, it is proved for No.1 and No.4 impellers that a multiblade radial fan wherein the quietness is optimized when the impeller is driven under a condition wherein the total pressure efficiency η is maximum can be designed by determining the divergence angle of the scroll type casing based on formula 3.

(ii) Results of the measurements for No.5 impeller (ξ=0.75) in FIG. 18 should be observed. The minimum specific sound level $K_{Smin}$ in each measured combination is shown in FIG. 18. As is clear from FIG. 18, the minimum specific sound level $K_{Smin}$ is minimized in the measured combination IV, that is the minimum specific sound level $K_{Smin}$ is minimized when the divergence angle $\theta_z$ of the scroll type casing is 6.0°. Thus, the quietness of No.5 impeller is optimized when it is installed in a casing with divergence angle of 6.0° (it is reasonable to conclude that the minimum specific sound level $K_{Smin}$ is minimized in the measured combination IV because the total pressure efficiency of No.5 impeller becomes maximum, the energy loss of the No.5 impeller becomes minimum, and the sound of No.5 impeller alone which causes the energy loss of the No.5 impeller becomes minimum in the measured combination IV). On the other hand, the optimum value of the divergence angle $\theta_z$ of the scroll type casing against No.5 impeller obtained by formula 3 is 5.99°.

The above discussion proves for No.5 impeller that the quietness of the multiblade radial fan can be optimized by determining the divergence angle of the scroll type casing based on formula 3.

In the same way, it is proved for No.1 and No.4 impellers that the quietness of the multiblade radial fan can be optimized by determining the divergence angle of the scroll type casing based on formula 3.

(3) Design criteria for achieving the compatibility between the impeller and the scroll type casing for accommodating the impeller of the multiblade radial fan.

(a) A multiblade radial fan wherein compatibility between the scroll type casing and the impeller is achieved, the sound level is minimized, and the quietness is optimized when the impeller is driven under the condition wherein the total pressure efficiency $\eta$ is maximum can be designed by determining the divergence angle $\theta_z$ of the scroll type casing based on formula 3.

(b) The quietness of the multiblade radial fan can be optimized by determining the divergence angle $\theta_z$ of the scroll type casing based on formula 3.

(c) Further development of the design criteria (1) Expansion of formula 3

Figure 19:
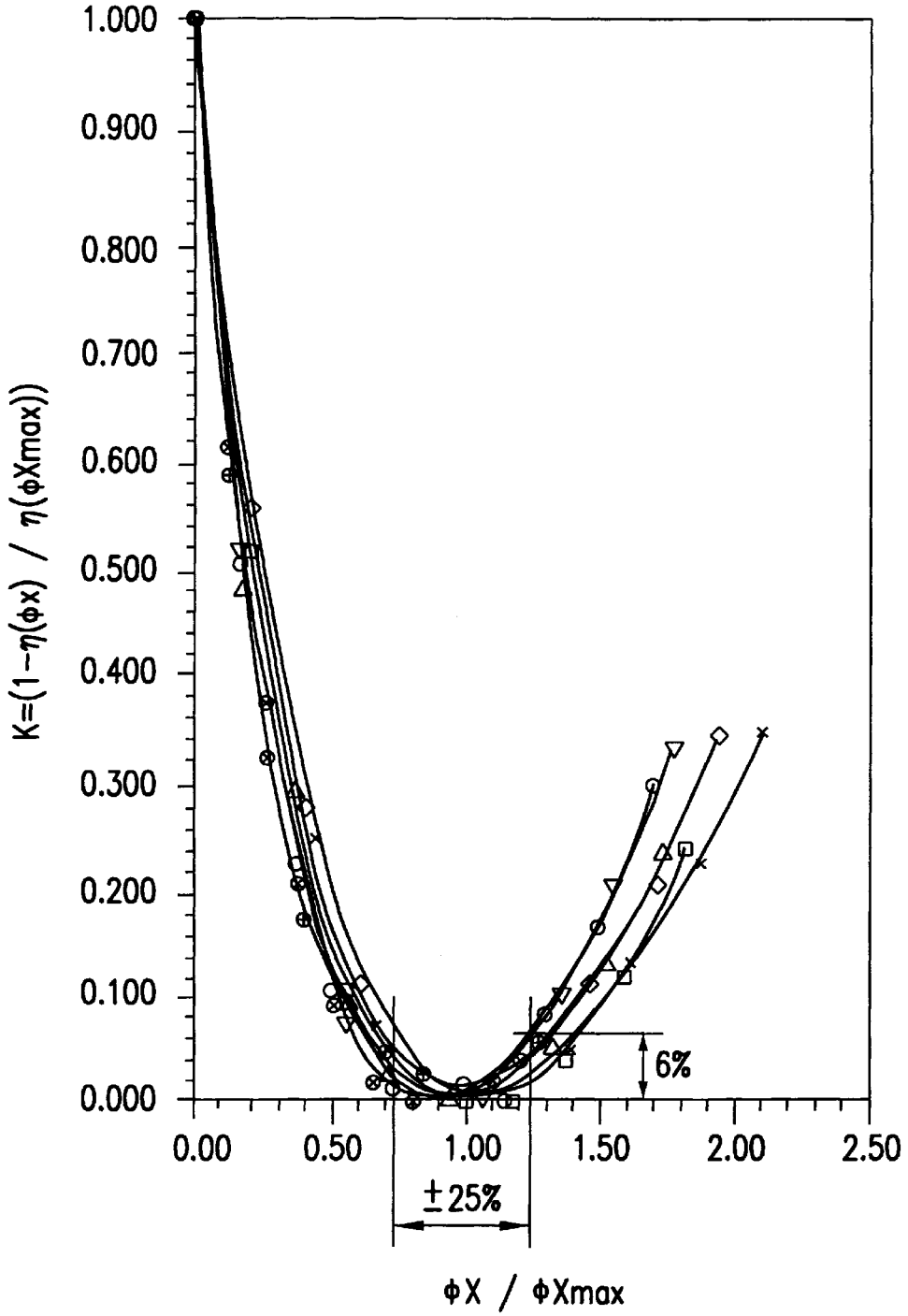
FIG. 19 shows correlation diagrams between $K=(1-\eta(\phi X)/\eta(\phi Xmax))$ and $\phi_X/\phi_{Xmax}$.

Correlations between $K=(1-{}_{\eta(\phi x)}/_{\eta(\phi Xmax)})$ and $\phi_x/\phi_{Xmax}$ derived from FIG. 4 are shown in FIG. 19.

As is clear from FIG. 19, the decrease of the total pressure efficiency $\eta$ from its maximum value is 6% or so even if $\phi_x$ is varied ±25% from $\phi_{Xmax}$. As is clear from FIG. 19, the increase of the minimum specific sound level $K_{Smin}$ from its minimum value is 3 dB to 4dB even if $\phi_x$ is varied ±25% from $\phi_{Xmax}$. Thus, it is thought that the efficiency and the quietness of the multiblade radial fan do not decrease so much even if the right side of formula 3 is varied about ±25% when the divergence angle $\theta_z$ of the scroll type casing is determining based on formula 3. Thus, it is thought that the following formula 4 can be used as the design criteria for achieving compatibility between the impeller and the scroll type casing.

$$\theta_z=\tan^{-1}[0.295\epsilon(1-nt/(2\pi r)(H/H_t)\xi^{1.641}] \quad 4$$

In the above formula, $0.75\leqq\epsilon\leqq1.25$ (2) Range of the diameter ratio of the impeller As is clear from FIG. 5, the correlation diagram between the diameter ratio $\xi$ of the impeller and the flow coefficient $\phi_{Xmax}$ based on the outlet sectional area of the interblade channel which gives the maximum value of the total pressure efficiency $\eta$ is substantially linear over the range $0.4\leqq\xi\leqq0.9$. Judging from this fact, it is thought that formula 4 can be expandedly used for an impeller whose diameter ratio $\xi$ is in the range of $0.3\leqq\xi\leqq0.9$. However, it is rather hard to achieve satisfactory quietness in an impeller whose diameter ratio $\xi$ is as large as 0.9 or so, while it is rather hard to dispose numerous radially directed blades in an impeller whose diameter ratio $\xi$ is as small as 0.3 or so. Thus, formula 4 is preferably used for an impeller whose diameter ratio $\xi$ is in the range of $0.4\leqq\xi\leqq0.8$.

(3) Range of the divergence angle $\theta_z$ of the scroll type casing

A scroll type casing whose divergence angle $\theta_z$ is too small cannot provide a satisfactory air volume flow rate, while a scroll type casing whose divergence angle $\theta_z$ is too large is troublesome to handle because its outside dimensions are too large. Thus, the divergence angle $\theta_z$ of the scroll type casing is preferably in the range of $3.0°\leqq\theta_z\leqq8.0°$.

(4) Range of $H/D_1$

Figure 20:
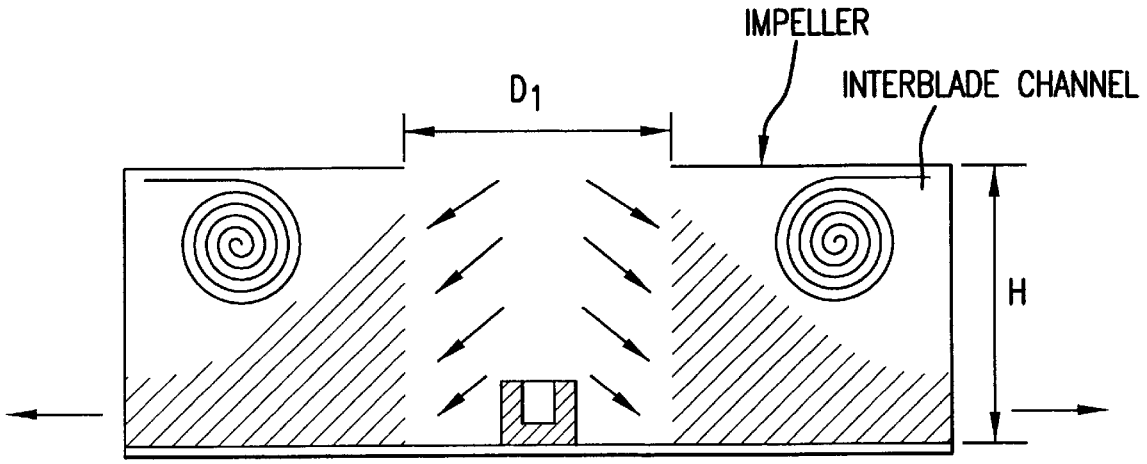
FIG. 20 shows the air flow in the impeller.
Figure 21:
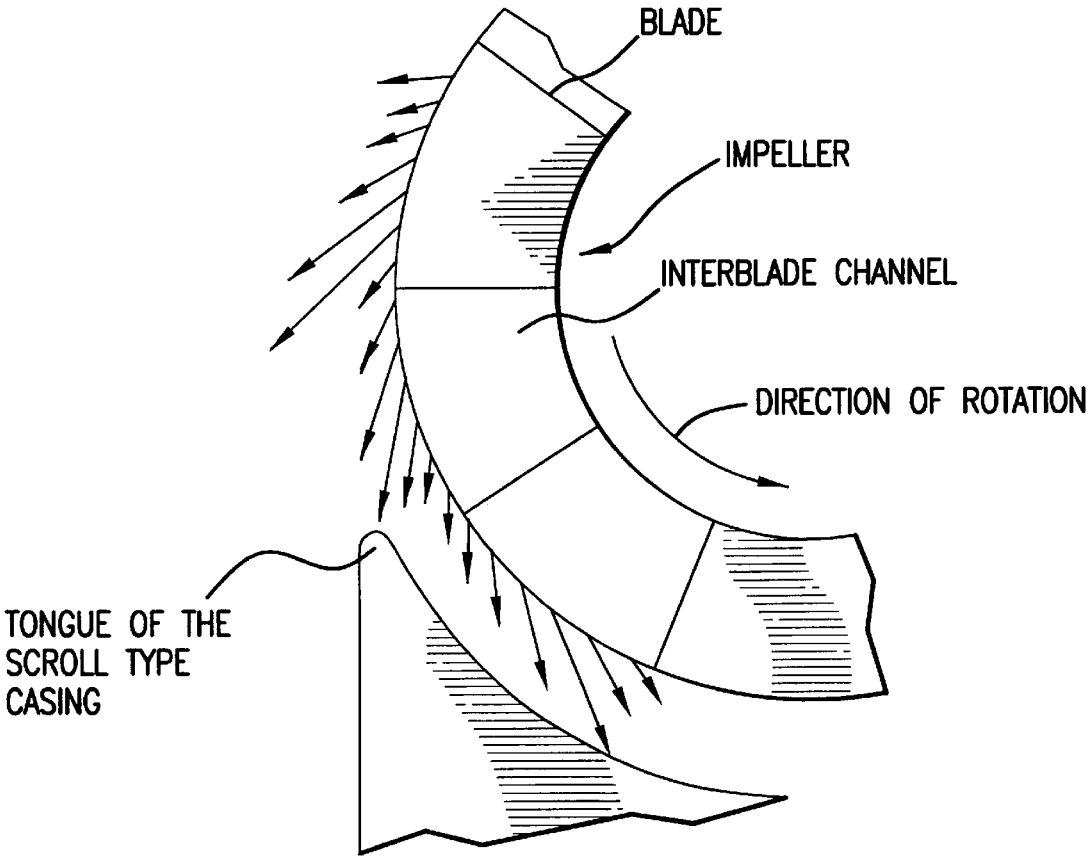
FIG. 21 shows the circumferential velocity distribution of the air discharged from the interblade channels of the multiblade radial fan.
Figure 22:
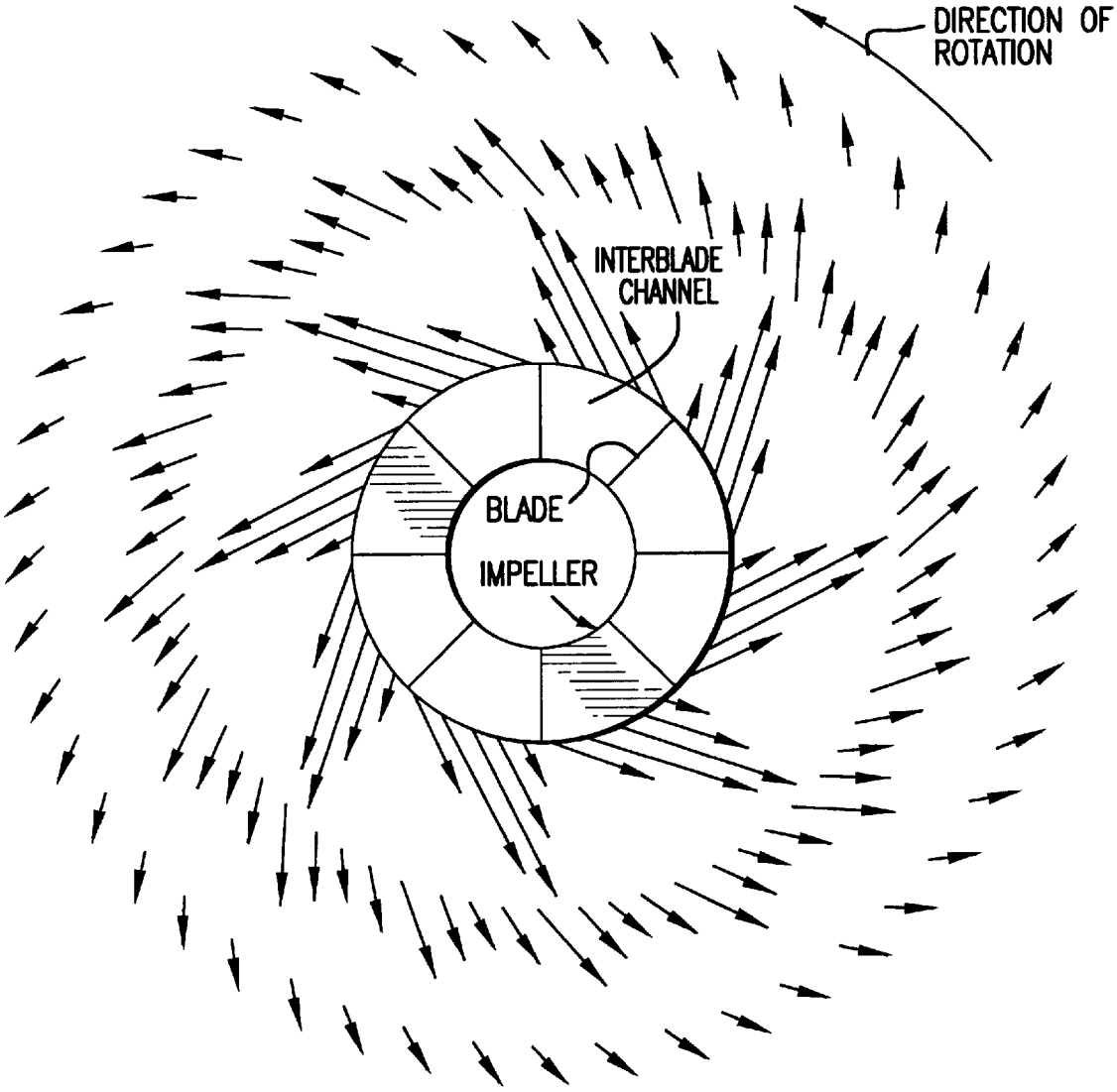
FIG. 22 shows the manner in which the circumferential velocity distribution of the air discharged from the interblade channels of the multiblade radial fan becomes uniform.

When the ratio $H/D_1$ of the height H of the radially directed blades to the inside diameter $D_1$ of the impeller is too large, vortices are generated in the interblade channels as shwon in FIG. 20, which degrades the aerodynamic performance and the quietness of the impeller. Generally speaking, the ratio $H/D_1$ is set at 8.0 to 9.0 in the sirocco fan and 0.6 or so in the radial fan. Thus, the the ratio $H/D_1$ is preferably in the range of $H/D_1\leqq0.75$.

(5) Rang of $H/H_t$

When the ratio $H/H_t$ of the height H of the radially directed blades to the height of the scroll type casing is to small, the air discharged from the impeller is discharged from the casing before it sufficiently diffuses in the casing. Thus, some portions of the space in the casing are not effectively utilized. Thus, the ratio $H/H_t$ is preferably in the range of $0.65\leqq H/H_t$ so as to sufficiently diffuse the air discharged from the impeller in the casing.

II. Invention to provide design criteria for decreasing sound caused by interference between the tongue of the scroll type casing and the blades of the impeller of the multiblade radial fan, and to provide design criteria for decreasing sound caused by interference between the tongue of the scroll type casing and the blades of the impeller of the multiblade centrifugal fan as generally defined to include the multiblade radial fan Preferred embodiments of the present invention are described.

A. Theoretical background

Figure 23:
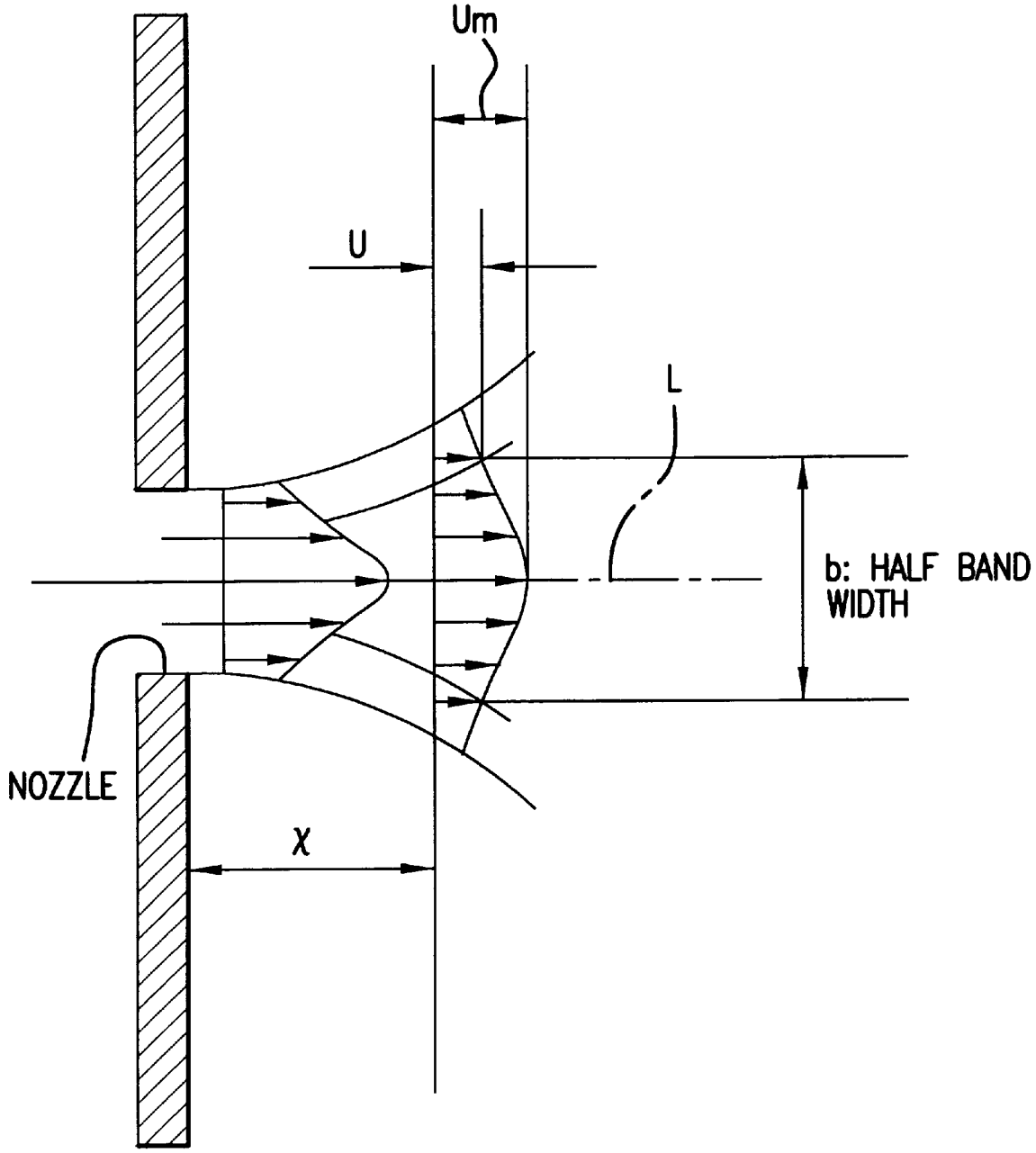
FIG. 23 shows the velocity distribution of the two-dimensional jet flow discharged from a nozzle.

L. Prandtl states that the half band width b of a two dimensional jet flow discharged from a nozzle (supposing that the flow velocity of a two dimensional jet flow at its center line L is $u_m$, so that half band width b is twice as long as the distance between a point where the flow velocity u is $u=u_m/2$ and the center line L of the two dimensional jet flow) is proportional to the distance x from the nozzle shown in FIG. 23 (Prandtl, L., The mechanics of viscous fluids, in W. F. Dureand (ed.): Aerodynamic Theory, III, 16–208(1935)).

The air flow discharged from the interblade channels of the impeller of the multiblade radial fan can be regarded as two dimensional jet flows discharged from the same number of radially directed nozzles as the blades of the impeller disposed along the outer periphery of the impeller.

Figure 24:
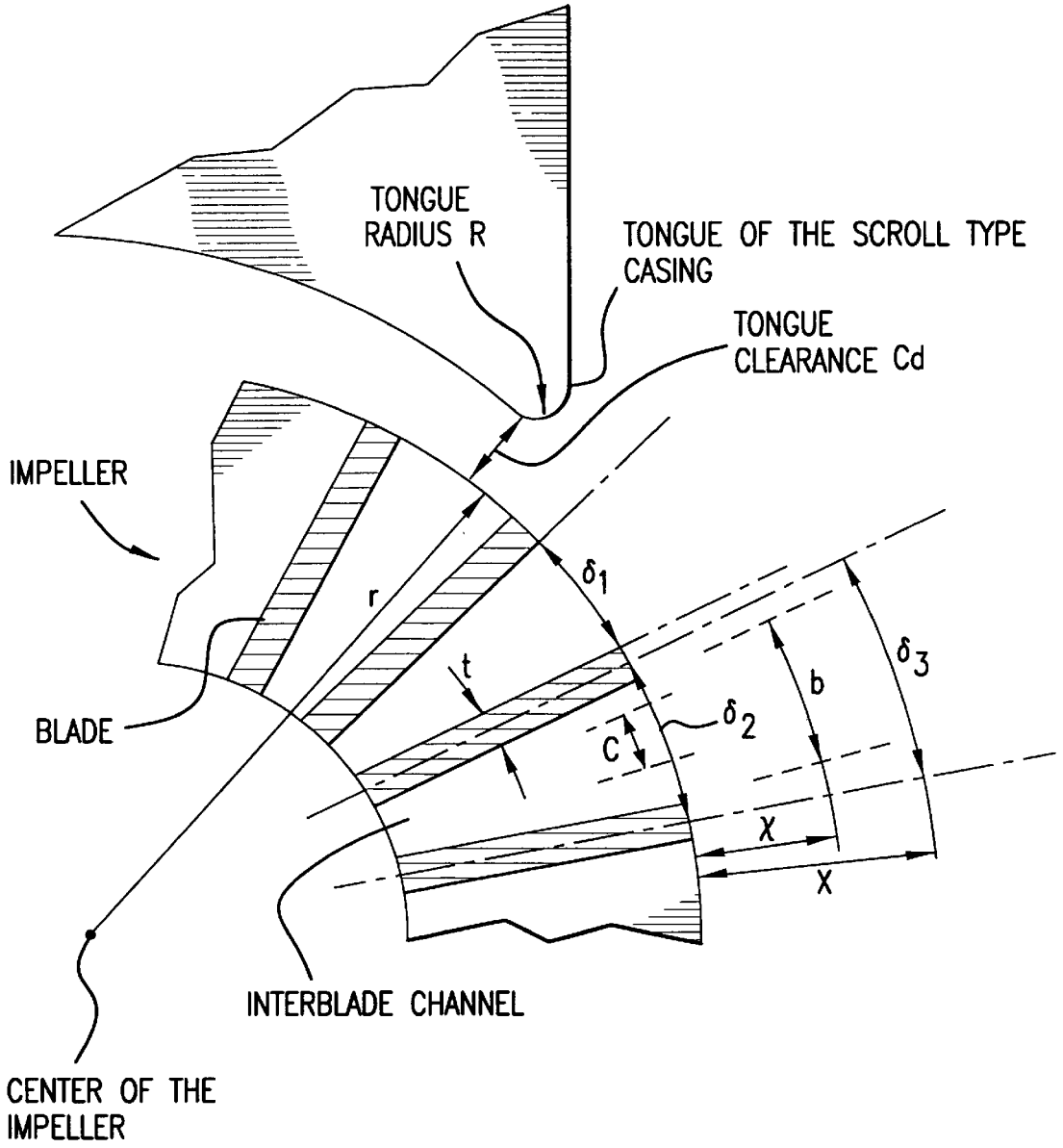
FIG. 24 is an explanatory diagram showing the half band width of the air flow discharged from the interblade channel of the multiblade radial fan.

Supposing that, as shown in FIG. 24, the breadth of the interblade channel at the outer periphery of the impeller of the multiblade radial fan is $\delta_1$, the interblade pitch at the outer periphery of the impeller of the multiblade radial fan is $\delta_2$, the half band width of the air flow discharged from the interblade channel at the outer periphery of the impeller of the multiblade radial fan is c, the radial distance of the point where the half band width of the air flow discharged from the interblade channel is equal to the virtual interblade pitch (supposing that the blades extend radially beyond the outer periphery of the impeller, so that the virtual interblade pitch is the interblade pitch in the region where the blades extend radially beyond the outer periphery of the impeller) from the outer periphery of the impeller is X, the virtual interblade pitch at the point where the radial distance from the outer periphery of the impeller is X is $\delta_3$, and the distance from the outer periphery of the impeller is x, then the half band width b of the air flow discharged from the interblade channel of the impeller of the multiblade radial fan is obtained by the following formula based on the theory of Prandtl.

$$b=(\delta_3-c)x/X+c \quad 5$$

$\delta_1$, $\delta_2$ and $\delta_3$ are obtained by the following formulas.

$$\delta_1=\{(2\pi r)/n\}-t \quad 6$$

$$\delta_2=(2\pi r)/n \quad 7$$

$$\delta_3=2\pi(r+X)/n \quad 8$$

In the above formulas, n is number of the blades, t is thickness of the blades, and r is outside radius of the impeller.

b is divided by $\delta_3$ so as to make the formula 5 nondimensional. Then, $$\tau = b/\delta_3 \qquad 9$$
$$= \{(\delta_3 - c)x/X + c\}/\delta_3$$

It can be conclude that the nondimensional number $\tau$ represents the degree of the diffusion of the air flow discharged from the interblade channel of the impeller of the multiblade radial fan, or the degree of the uniformization of the circumferential distribution of the air velocity. Thus, it is thought that the design criteria for decreasing the tongue interference sound of the multiblade radial fan can be obtained by using the nondimensional number $\tau$.

B. Sound level measurement tests

Sound level measurement tests were carried out on a plurality of impellers of the multiblade radial fan with different diameter ratio.

(1) Test conditions (a) Tested impellers, Tested casings (i) Tested impellers

A total of 39 kinds of impellers with different outside diameter, diameter ratio, number of blades, blade thickness, etc. were made and tested.

Figure 25A:
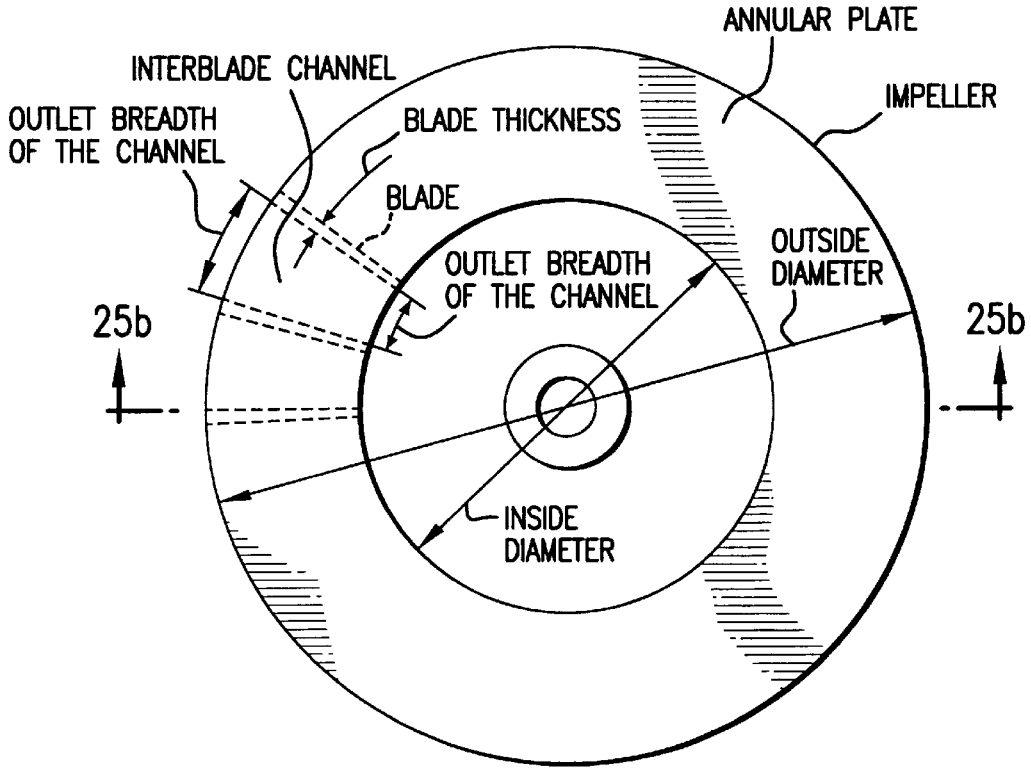
FIG. 25(*a*) is a plan view of a tested impeller used for measuring the sound pressure level and FIG. 25(*b*) is a sectional view taken along line b—b in FIG. 25(*a*).
Figure 25B:
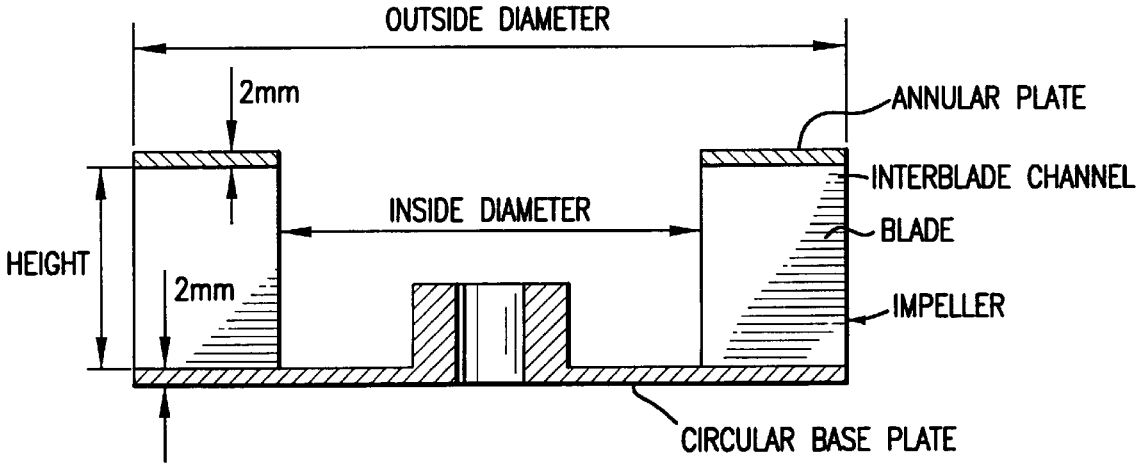
Figure 26:
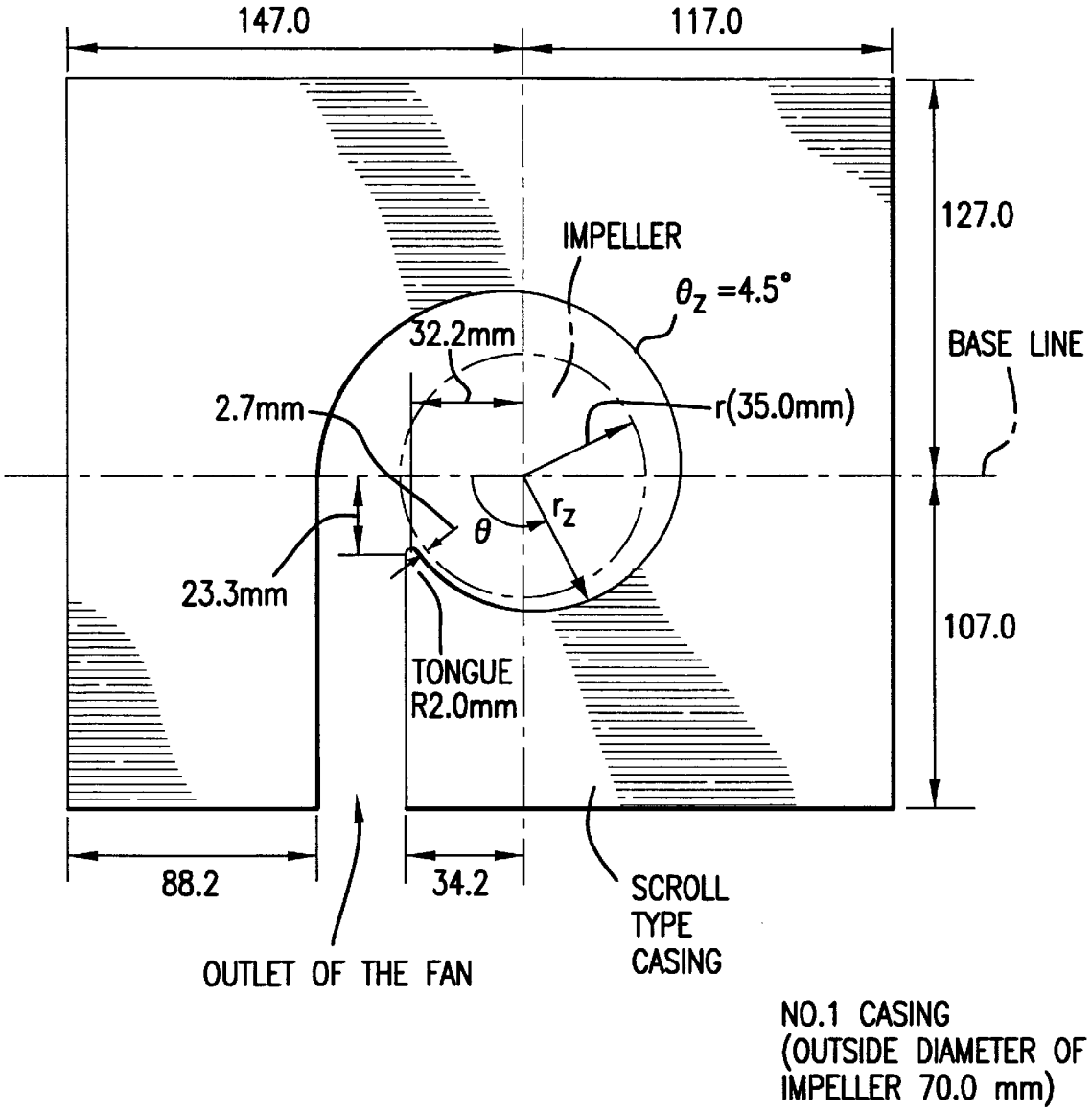
FIG. 26 is a plan view of a tested casing used for measuring the sound pressure level of a multiblade radial fan.
Figure 27:
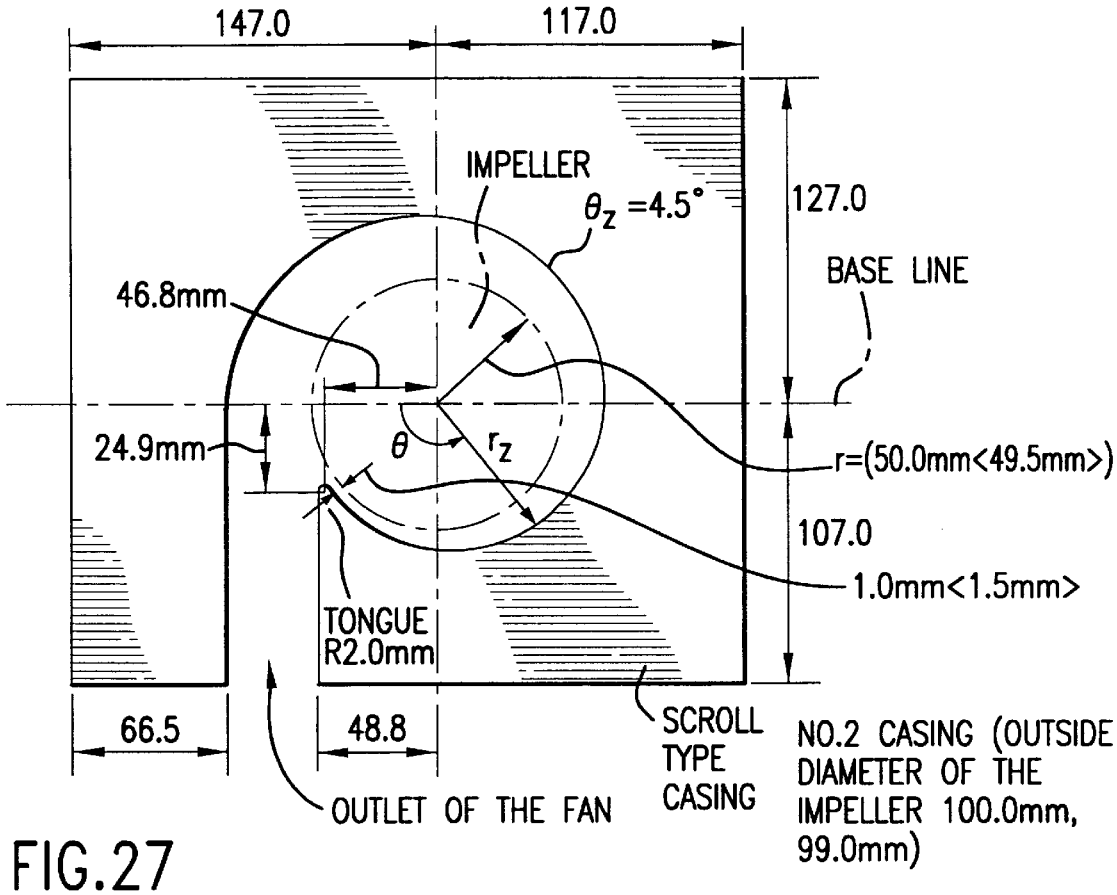
FIG. 27 is a plan view of a tested casing used for measuring the sound pressure level of a multiblade radial fan.
Figure 28:
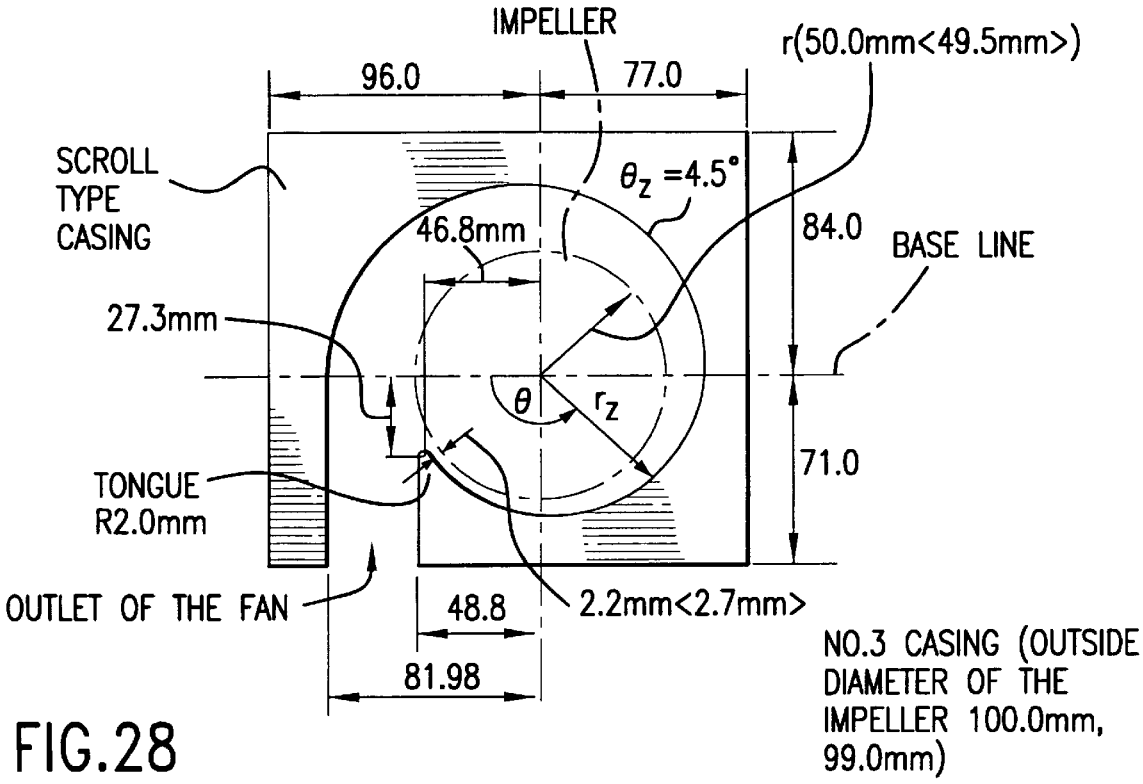
FIG. 28 is a plan view of a tested casing used for measuring the sound pressure level of a multiblade radial fan.
Figure 29:
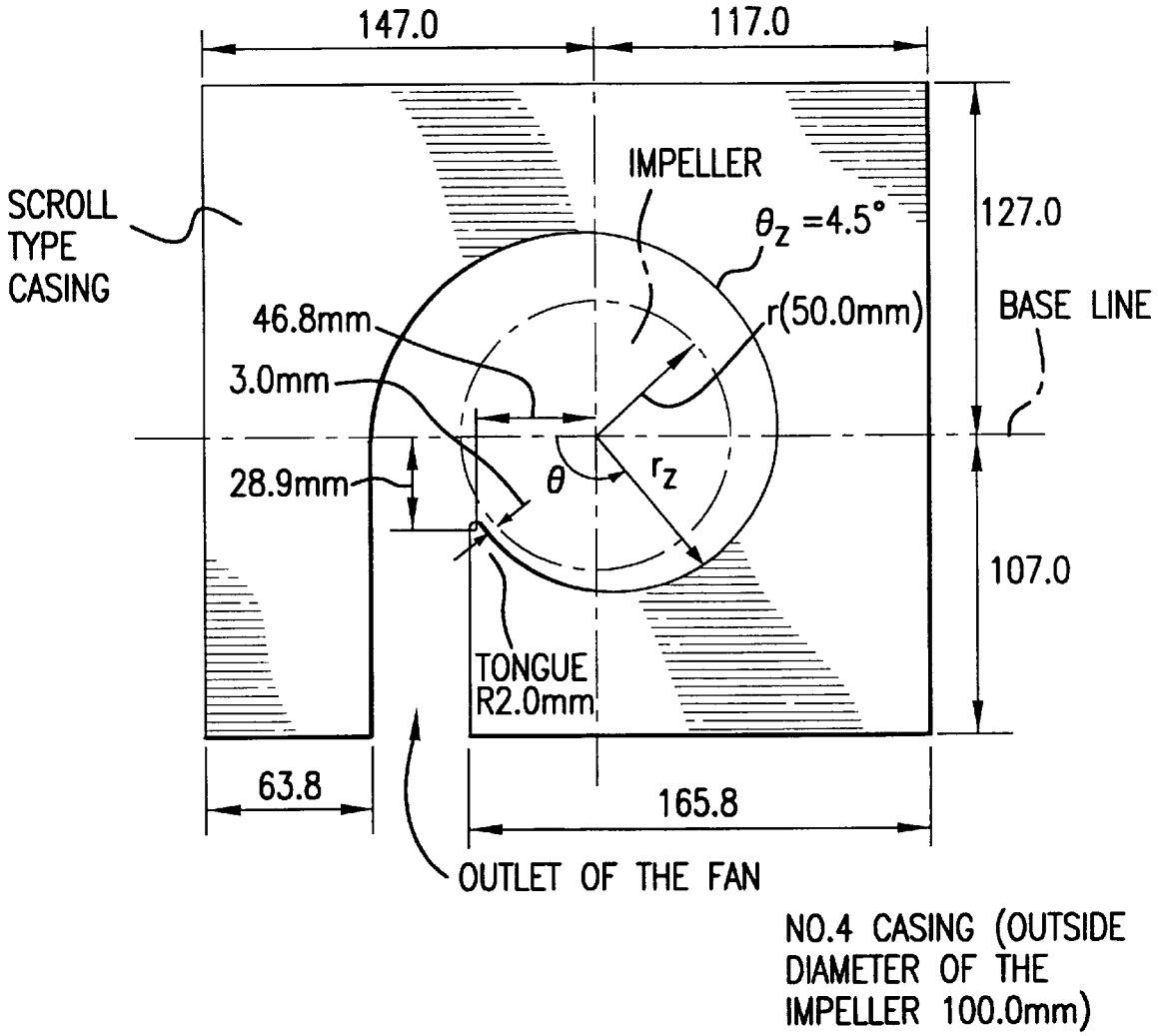
FIG. 29 is a plan view of a tested casing used for measuring the sound pressure level of a multiblade radial fan.
Figure 30:
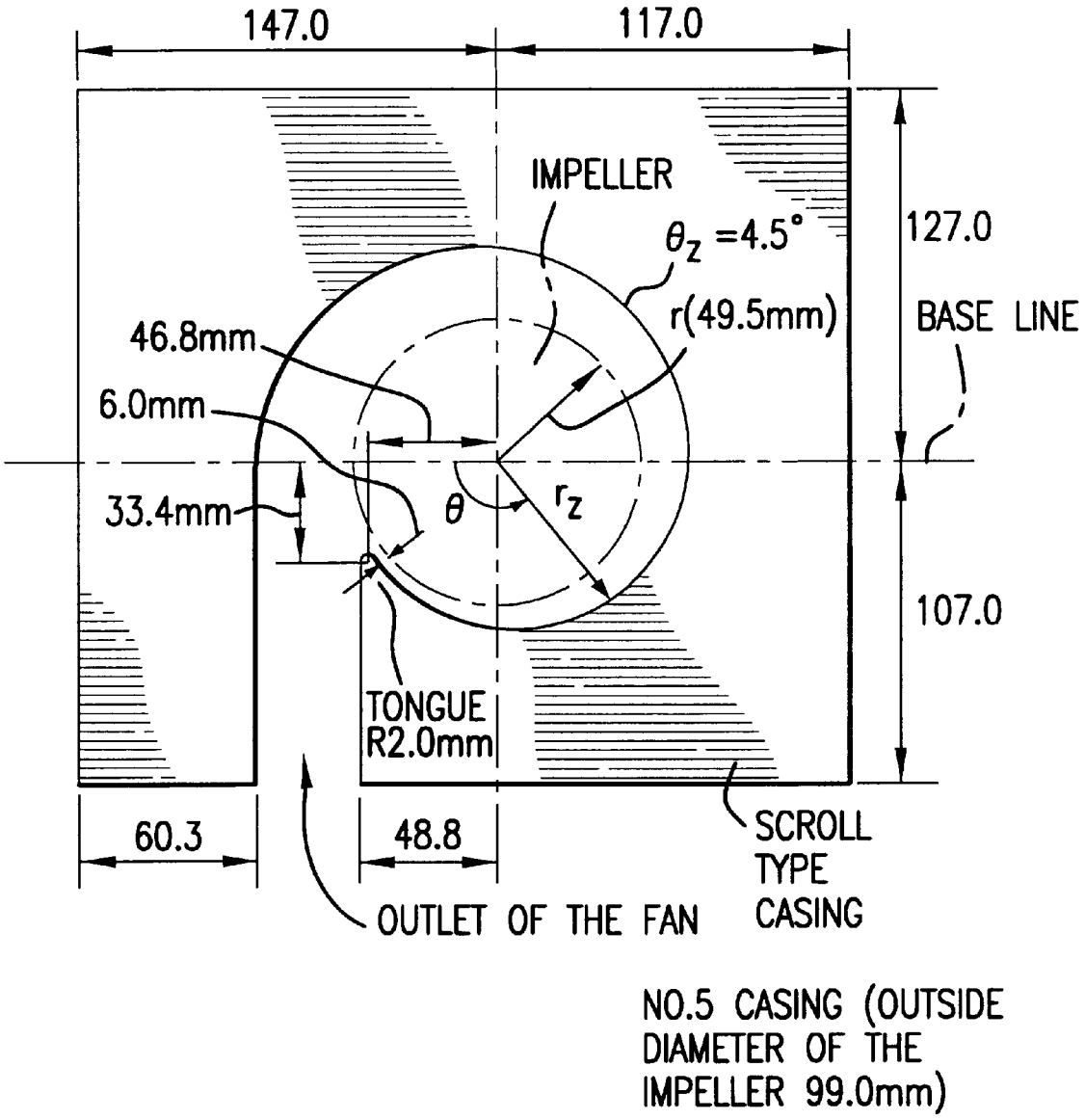
FIG. 30 is a plan view of a tested casing used for measuring the sound pressure level of a multiblade radial fan.
Figure 31:
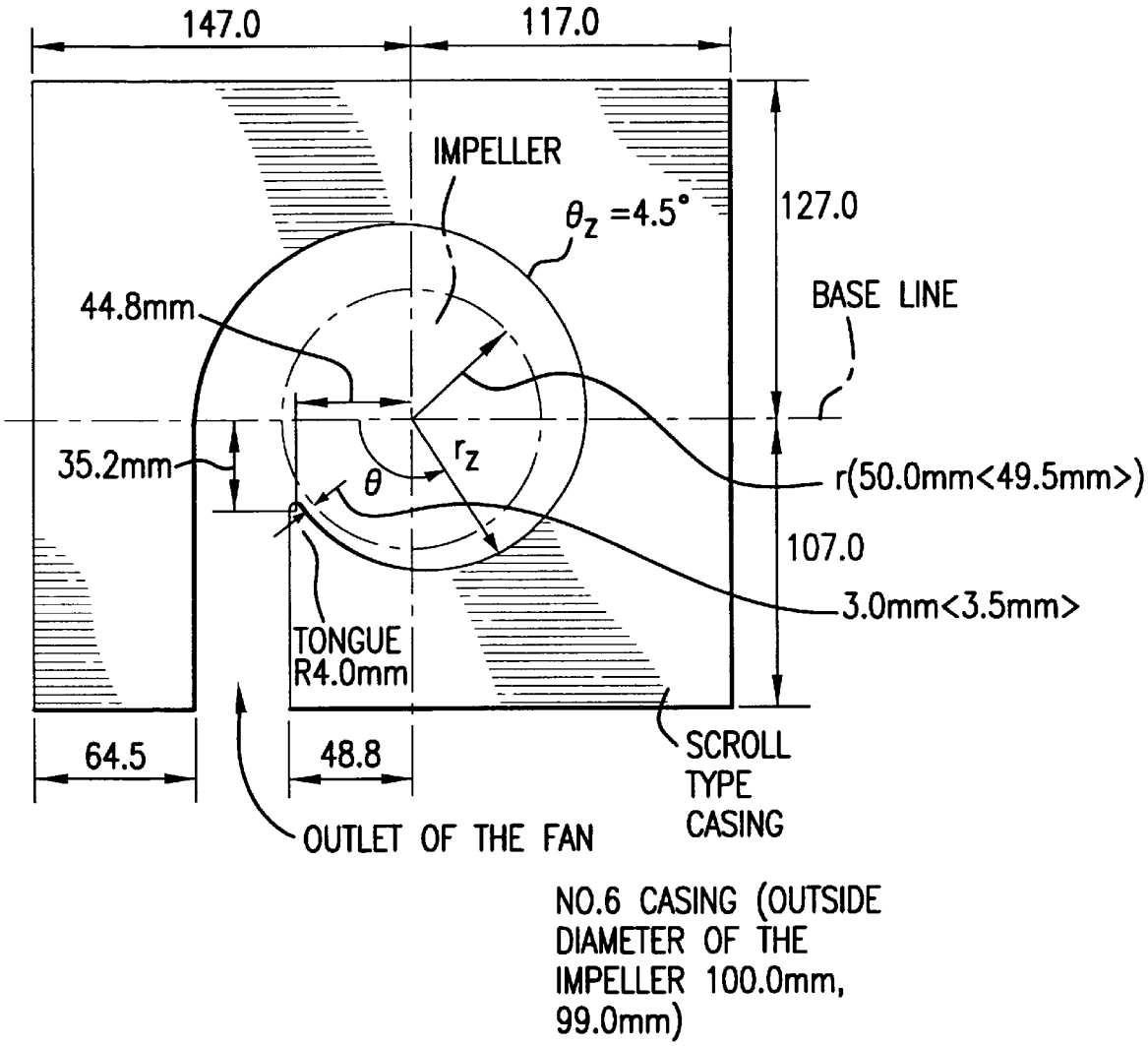
FIG. 31 is a plan view of a tested casing used for measuring the sound pressure level of a multiblade radial fan.
Figure 32:
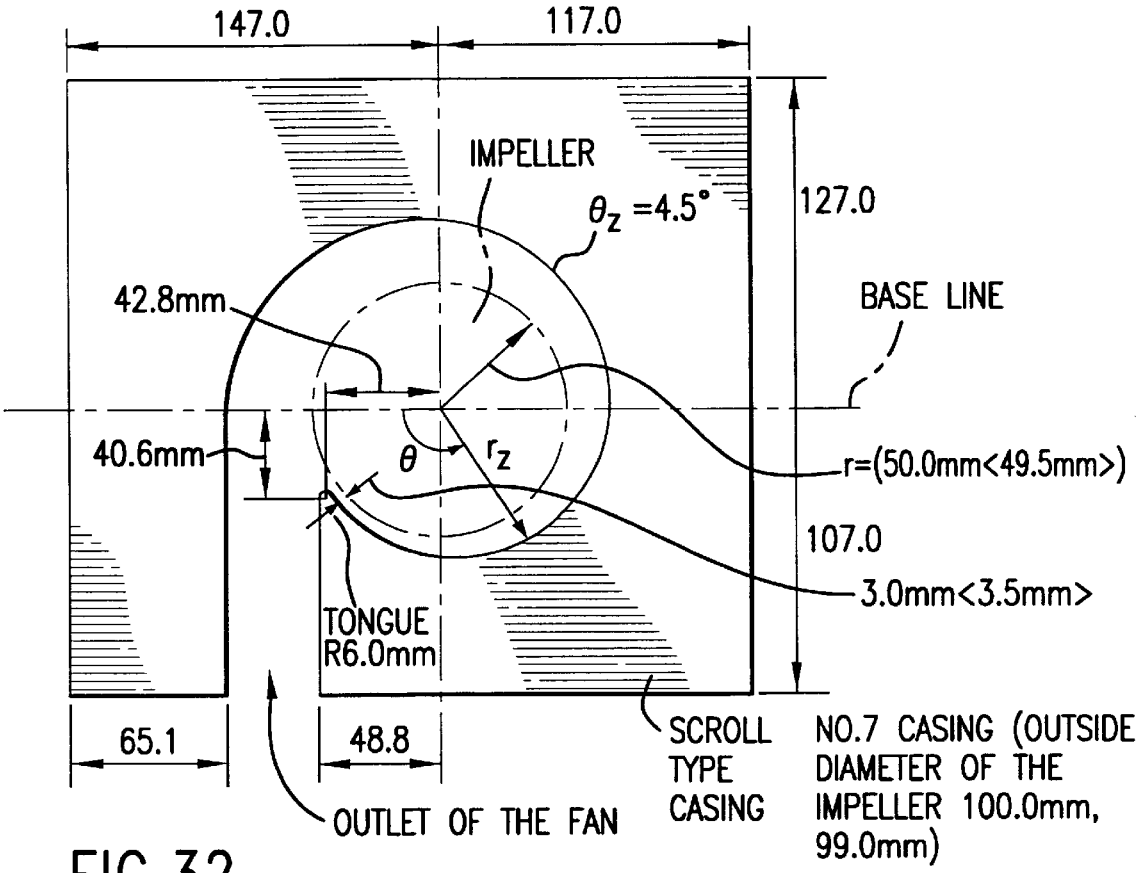
FIG. 32 is a plan view of a tested casing used for measuring the sound pressure level of a multiblade radial fan.
Figure 33:
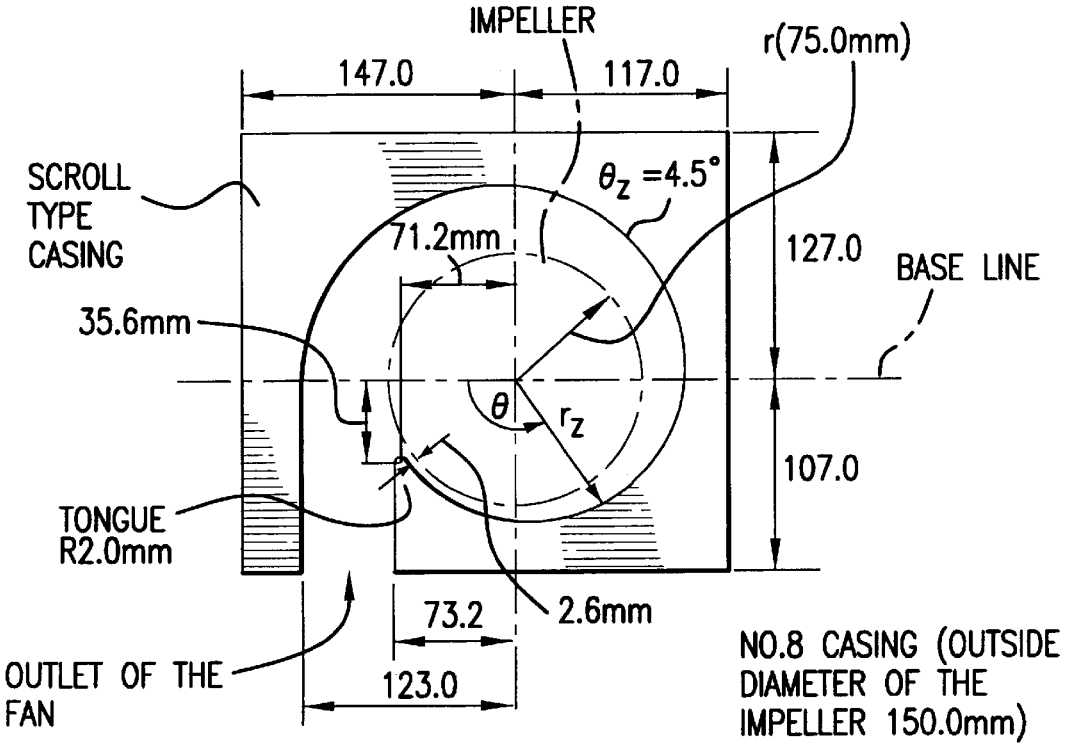
FIG. 33 is a plan view of a tested casing used for measuring the sound pressure level of a multiblade radial fan.

The particulars of the tested impellers are shown in Table 2, and FIGS. 25(*a*) and 25(*b*).

(ii) Tested casings

The height of the scroll type casings was 27 mm. The divergence configuration of the scroll type casings was a logarithmic spiral defined by the following formula. The divergence angle $\theta_2$ was 4.50°.

$$r_z = r[\exp(\theta \tan \theta_z)]$$

In the above formula, $r_z$: radius of the side wall of the casing measured from the center of the impeller r: outside radius of the impeller $\theta$: angle measured from a base line, $0 \leqq \theta \leqq 2\pi$ $\theta_z$: divergence angle of the scroll type casing A plurality of casings with different tongue radius R and tongue clearance $C_d$ were made for each group of impellers with the same outside diameter so as to accommodate the impellers belonging to the group and were tested. The tested casings are shown in FIGS. 26 to 33.

(b) Measuring apparatuses (i) Measuring apparatus for measuring air volume flow rate and static pressure The measuring apparatus used for measuring air volume flow rate and static pressure is shown in FIG. 9. The fan body had an impeller, a scroll type casing for accommodating the impeller and a motor. An inlet nozzle was disposed on the suction side of the fan body. A double chamber type air volume flow rate measuring apparatus (product of Rika Seiki Co. Ltd., Type F-401) was disposed on the discharge side of the fan body. The air volume flow rate measuring apparatus was provided with an air volume flow rate control damper and an auxiliary fan for controlling the static pressure at the outlet of the fan body. The air flow discharged from the fan body was straightened by a straightening grid.

The air volume flow rate of of the air discharged from the fan body was measured using orifices located in accordance with the AMCA standard. The static pressure at the outlet of the fan body was measured through a static pressure measuring hole disposed near the outlet of the fan body.

(ii) Measuring apparatus for measuring sound pressure level

The measuring apparatus for measuring sound pressure level is shown in FIG. 10. An inlet nozzle was disposed on the suction side of the fan body. A static pressure control chamber of a size and shape similar to those of the air volume flow rate measuring apparatus was disposed on the discharge side of the fan body. The inside surface of the static pressure control chamber was covered with sound absorption material. The static pressure control chamber was provided with an air volume flow rate control damper for controlling the static pressure at the outlet of the fan body.

The static pressure at the outlet of the fan body was measured through a static pressure measuring hole located near the outlet of the fan body. The sound pressure level corresponding to a certain level of the static pressure at the outlet of the fan body was measured.

The motor was installed in a soundproof box lined with sound absorption material. Thus, the noise generated by the motor was confined.

The measurement of the sound pressure level was carried out in an anechoic room. The A-weighted sound pressure level was measured at a point on the centerline of the impeller and 1 m above the upper surface of the casing.

(2) Measurement

Measurements were carried out as follows.

(a) One specific impeller belonging to one specific group of impellers with the same outside diameter, number of blades and blade thickness was set in one specific casing belonging to the corresponding group of casings with different tongue radius and tongue clearance.

(b) Sound level of the fan was measured for each of a plurality of combinations of the air volume flow rate of the discharged air from the fan and the revolution speed of the impeller with the same flow coefficient $\phi$ of 0.106.

The reason for setting the flow coefficient $\phi$ at 0.106 will be explained.

As shown in FIG. 6, flow coefficient $\phi$ ($\phi$=u/v, u=Q/S: radial air velocity at the outlet of the impeller, v=r$\omega$: circumferential velocity of the impeller of the outer periphery of the impeller, Q: air volume flow rate, S=2$\pi$rh: outlet sectional area of the impeller, r: outside radius of the impeller, h: height of the impeller, $\omega$: angular velocity of the impeller) is the tangent of the outlet angle $\theta$ of the air discharged from the impeller. It is thought that the air discharged from the impeller forms a free vortex. Thus, as shown in FIG. 7, the crossing angle of a concentric circle whose center coincides with the rotation center of the impeller and the stream line of the air discharged from the impeller is kept at the outlet angle $\theta$ of the air discharged from the impeller, i.e. $\tan^{-1}\phi$, irrespective of the distance from the rotation center of the impeller. Thus, compatibility between the scroll type casing and the impeller is achieved and the sound caused by incompatibility between the scroll type casing and the impeller is eliminated when the divergence angle $\theta_z$ (logarithmic spiral angle) of the scroll type casing coincides with $\tan^{-1}\phi$. In the present measurement, $\tan^{-1}\phi$ was made coincide with the divergence angle $\theta_z$ of the scroll type casing, i.e. 4.5°, so as to eliminate sounds other than the tongue interference sound as far as possible. Thus, the flow coefficient $\phi$ was set at 0.106.

The correlation between the sound level of the fan and the air volume flow rate of the discharged air from the fan was obtained on the assumption that a correlation wherein the specific sound level is $K_1$ when the air volume flow rate is $Q_1$ exists between the specific sound level K and the air volume flow rate Q when the air volume flow rate and the static pressure at the outlet of the fan body obtained by the air volume flow rate and specific pressure measurement are $Q_1$ and $p_1$ respectively, while the specific sound level and the static pressure at the outlet of the fan body obtained by the sound pressure level measurement are $K_1$ and $p_1$ respectively. The above assumption is thought to be reasonable as the size and the shape of the air volume flow rate measuring apparatus used in the air volume flow rate and static pressure measurement are substantially the same as those of the static pressure controlling box used in the sound pressure level measurement.

Figure 34:
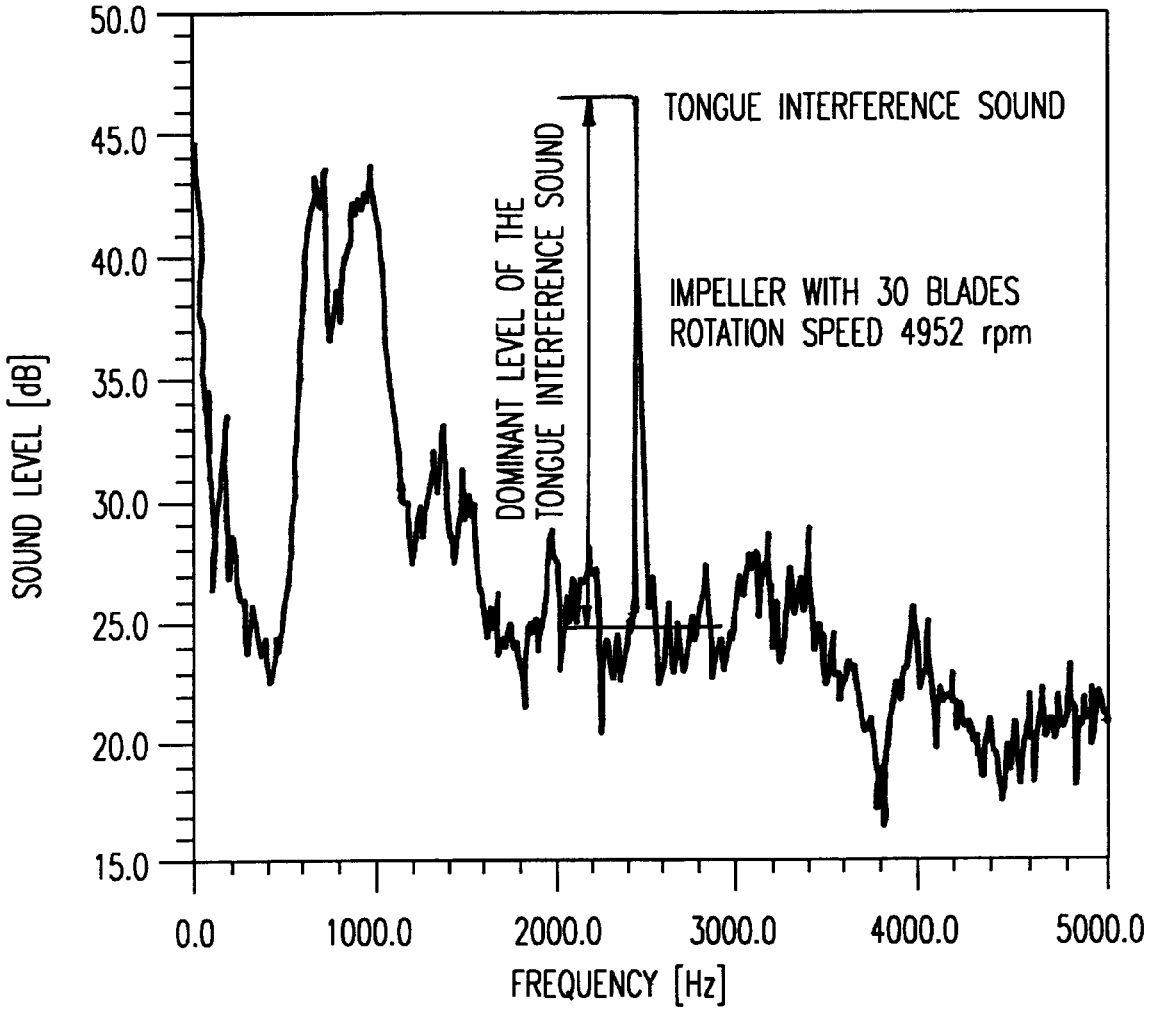
FIG. 34 shows an example of the sound level spectrum obtained by the sound pressure level measurement.

(c) Dominant level of the tongue interference sound was obtained by visually inspecting the spectrum of the measured sound for each of the plurality of combinations of air volume flow rate of the discharged air from the fan and the rotation velocity of the impeller with the same value, 0.106, of the flow coefficient $\phi$. The dominant level of the tongue interference sound was obtained as the difference between the tongue interference sound level and the mean value of the sound level in the frequency range near the frequency of the tongue interference sound. The dominant level of the tongue interference sound of the specific one impeller set out in (a) was obtained as the mean value of the plurality of dominant levels of the tongue interference sound obtained by the aforementioned procedure. One example of the spectra obtained by the sound level measurements is shown in FIG. 34. One example of the results of the sound level measurements for one specific impeller is shown in Table 3.

(d) Another one specific impeller belonging to the one specific group of the impellers set out in (a) was set in the one specific casing set out in (a) so as to carry out (b) and (c), thereby obtaining the dominant level of the tongue interference sound of the another one specific impeller. In the same way, the dominant levels of the tongue interference sound of all of the impellers belonging to the one specific gorup set out in (a) were obtained.

(e) The dominant level of the tongue interference sound of the combination of the one specific group of the impellers set out in (a) and the one specific casing set out in (a) was obtained as the mean value of a plurality of dominant levels of the tongue interference sound obtained by (c) and (d). One specific test was defined by a series of the procedures (a) to (e).

(f) In the same way as (a) to (e), the dominant level of the tongue interference sound of the combination of the one specific group of the impellers set out in (a) and another one specific casing belonging to the group of the casings set out in (a) was obtained. Another one specific test was defined by a series of the procedures of (f).

(g) In the same way as (f), a total of 47 kinds of tests were carried out for a total of 47 kinds of combinations of a plurality of groups of the impellers and a plurality of casings so as to obtain dominant levels of the tongue interference sound.

Test results are shown in Table 4. In Table 4, impeller numbers belonging to the group of the impellers, casing number, specifications of the impellers, specifications of the casing and the dominant level of the tongue interference sound corresponding to each test are also shown.

(3) Discussion (a) Correlation between the tongue interference sound and the nondimensional number $\tau$ It is though that, if the half band width b of the air flow discharged from the interblade channel is equal to or larger than $\delta_3$ at the radial position of the tongue of the scroll type casing in FIG. 24, then the tongue interference sound is hardly generated because the velocity distribution of the air flow discharged from the interblade channel is fairy uniform at the radial position of the tongue of the scroll type casing. That is, it is thought that, if $\tau$ obtained by formula 9 is equal to or larger than 1 when tongue clearance $C_d$ of the scroll type casing is substituted for x in formula 5, then the tongue interference sound is hardly generated.

It is supposed that, also in Table 4, $\tau$ of each combination of the group of the impellers and the scroll type casing corresponding to the test number wherein the tongue interference sound did not appear, obtained by substituting the tongue clearance $C_d$ of the scroll type casing of the aforementioned combination for x in formula 5, calculating formulas 6 to 8 using the outside radius r, number of blades n, and blade thickness t of the group of the impellers of the aforementioned combination, and calculating $\tau$ based on formula 9, is equal to or greater than 1.

Based on the aforementioned supposition, $\tau$ was obtained for each test number in Table 4 by substituting the tongue clearance $C_d$ of the corresponding scroll type casing for x in formula 5, calculating formulas 6 to 8 using the outside radius r, number of blades n, and blade thickness t of the corresponding group of the impellers, and calculating $\tau$ based on formula 9. Thereafter, X and c in formula 5 was determined so as to make the threshold value of $\tau$ (if $\tau$ is smaller than the "threshold value", then the tongue interference sound does not appear, i.e. the dominant level of the tongue interference sound becomes negative, while if $\tau$ is equal to or larger than the "threshold value", then the tongue interference sound appears, i.e. the dominant level of the tongue interference sound becomes positive) is substantially equal to 1. The determined value of X and c are as follows.

$$X=0.8\delta_2,\ c=0.3\delta_1$$

$\tau$ was obtained for each test number in Table 4 by substituting the tongue clearance $C_d$ of the corresponding scroll type casing for x in formula 5, substituting $0.8\delta_2$ and $0.3\delta_1$ for X and c i formula 5 respectively, calculating formulas 6 to 8 using the outside radius r, number of blades n, and blade thickness t of the corresponding group of the impellers, and calculating $\tau$ based on formula 9. The calculated values of $\tau$ are shown in Table 4.

Figure 35:
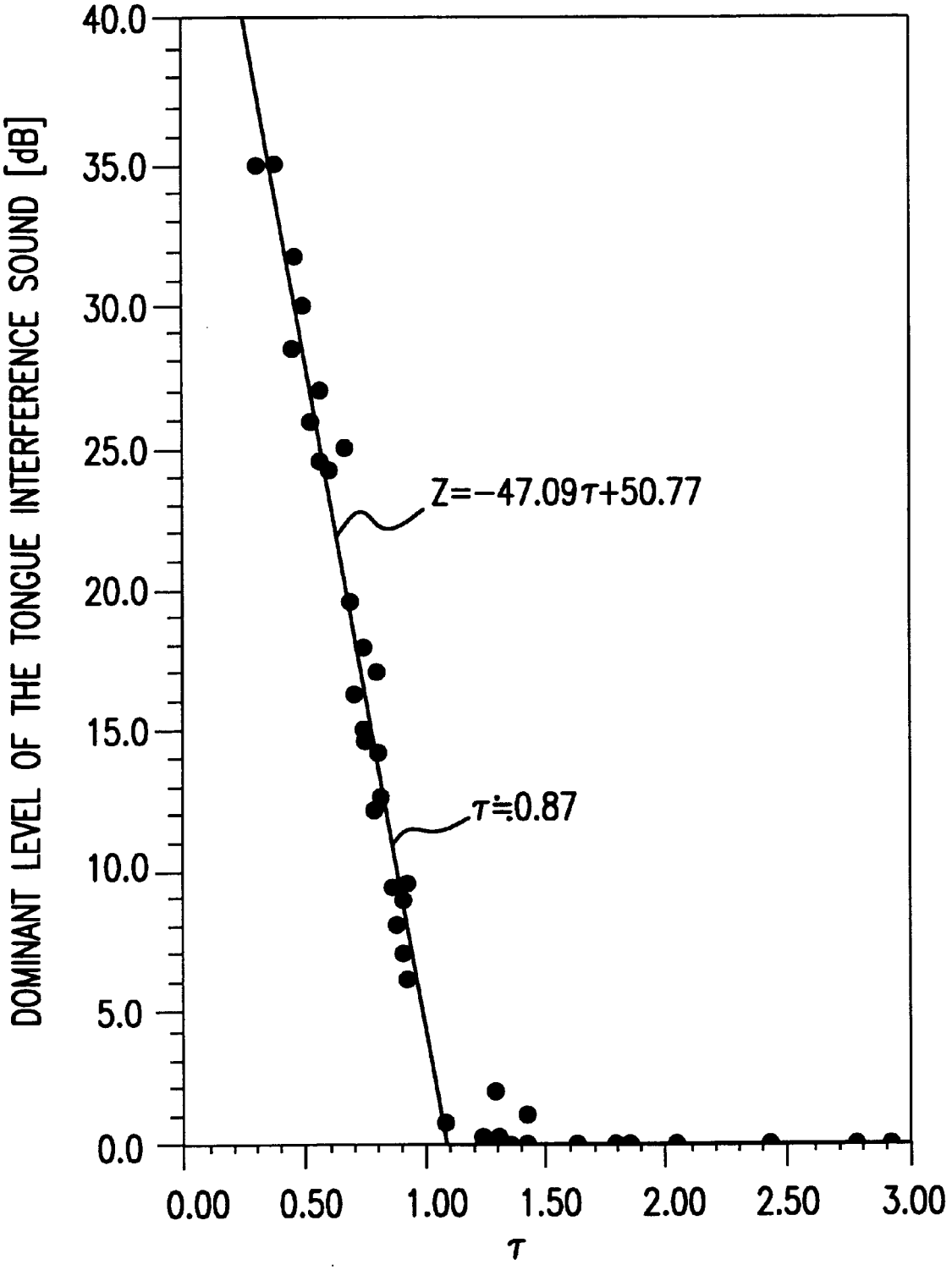
FIG. 35 shows the correlation between the nondimensional number $\pi$ and the dominant level of the tongue interference sound.

Correlations between $\tau$ in Table 4 and the dominant level of the tongue interference sound are shown in FIG. 35. As is clear from FIG. 35, in spite of some degree of scattering, there is a definite correlation between $\tau$ in Table 4 and the dominant level of the tongue interference sound wherein the dominant level of the tongue interference sound is substantially zero in the region of $\tau$ equal to or larger than 1 and linearly increases as $\tau$ decreases in the region of $\tau$ smaller 1. As mentioned earlier, the dominant levels of the tongue interference sound shown in Table 4 are mean values of the results of the numerous sound level measurements. So, it is thought that measurement errors are small. Thus, the correlation of FIG. 35 is sufficiently trustworthy.

The correlation between $\tau$ and the dominant level of the tongue interference sound in the region of $\tau$ smaller than 1 in FIG. 35 can be approximated to the following line by the least square approximation method.

$$Z=-47.09\tau+50.77$$

In the formula, Z is the dominant level of the tongue interference sound.

(b) Allowable value of the dominant level of the tongue interference sound

Generally, the A-weighted (0 to 20 $kH_z$), ⅓ octave band overall sound pressure level is used in sound pressure level measurement. Considering the characteristics of the A-weighted filter, sound pressure level measurements wherein tongue interference sound with a frequency range of about 2 $KH_z$ to 7 $KH_z$ appeared were observed for a plurality of impellers. In the observed measurements, the A-weighted, ⅓ octave band overall sound pressure level was compared with the A-weighted, ⅓ octave band overall sound pressure level without the ⅓ octave band sound pressure level of the frequency range wherein the tongue interference sound was present.

The results of the comparison are shown in Table 5. Dominant levels of the tongue interference sound derived from the spectra of the sound are also shown in Table 5. Correlations between the dominant level of the tongue interference sound and the different between the ⅓ octave band overall sound pressure level with the tongue interference sound and the ⅓ octave band overall sound pressure level without the tongue interference sound are shown in FIG. 36.

Figure 36:
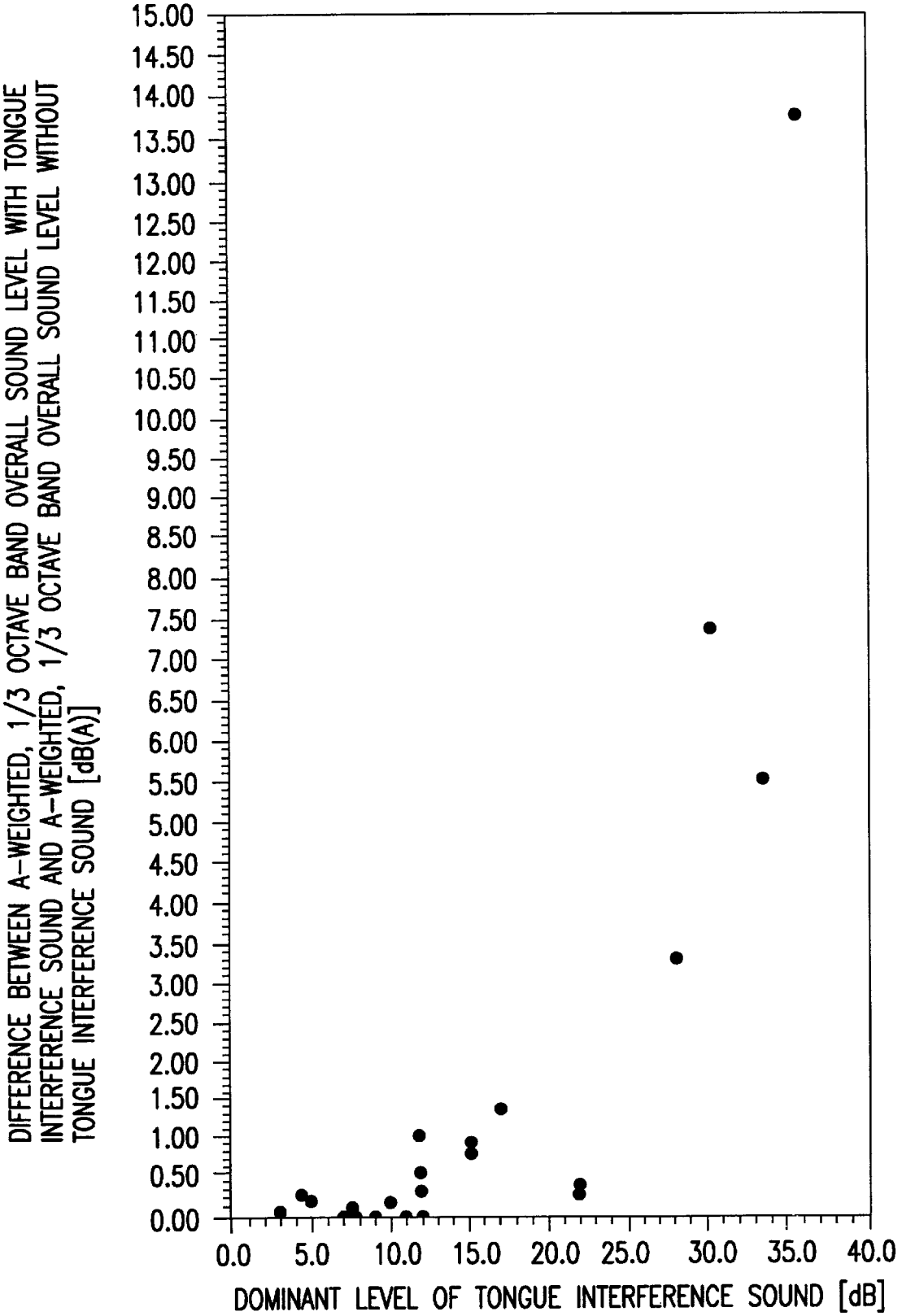
FIG. 36 shows the correlation between (a) the dominant level of the tongue interference sound and (b) the difference between the A-weighted ⅓ octave band overall sound pressure level with tongue interference sound and the A-weighted ⅓ octave band overall sound pressure level without tongue interference sound.

As is clear from Table 5 and FIG. 36, when the dominant level of the tongue interference sound is equal to or less than 10 dB, the difference between the ⅓ octave band overall sound pressure level with the tongue interference sound and the ⅓ octave band overall sound pressure level without the tongue interference sound is equal to or less than 0.5 dB. Considering the fact that the allowable value of measurement error of a precision sound level meter is 0.5 dB, the difference of 0.5 dB is not significant for A-weighted, ⅓ octave band overall sound level. Thus, it is thought that, if the dominant level of the tongue interference sound is restricted equal to 10 dB or less, the tongue interference sound does not sound noisy to a person. Actually, the tongue interference sound with a dominant level equal to or less than 10 dB was not considered noisy by those making the measurement.

Thus, it is thought that the tongue interference sound can be sufficiently decreased by setting the allowable value of the dominant level of the tongue interference sound at 10 dB.

C. Design criteria

The following design criteria for decreasing the tongue interference sound of the multiblade radial fan are derived from the aforementioned discussion.

The specifications of the impeller and the scroll type casing should be determined to satisfy the following formula.

$$-47.09\tau+50.77<10.0 \text{ (where } \tau=b/\delta_3,$$

$$b=(\delta_3-c)(C_d/X)+c,\ X=0.8\delta_2,\ c=0.3\ \delta_1,$$

$$\delta_1=\{(2\pi r)/n\}-t,\ \delta_2=(2\pi r)/n,$$

$\delta_3=2\pi(r+X)/n$, $C_d$: tongue clearance, n: number of the blades, t: thickness of the blades, r: outside radius of the impeller).

An embodiment of the present invention regarding the design criteria for decreasing the sound caused by the interference between the tongue of the scroll type casing and the impeller has been described above. However, the present invention is not restricted to the above described embodiment.

The above described embodiment concerns the multiblade radial fan having an impeller with numerous radially directed blades disposed at an equal circumferential distance from each other and a scroll type casing for accommodating the impeller. However, it is though that the same design criteria as for the multiblade radial fan can be obtained for the multiblade centrifugal fan wherein the leading edges of the blades of the multiblade radial fan are knuckled or bent in the direction of rotation (if the leading edges of the radially directed blades are bent in the direction of rotation, inlet angle of the air into the interblade channels decreases, and the sound level decreases), the multiblade sirocco fan having an impeller with numerous forward-curved blades disposed at an equal circumferential distance from each other and a scroll type casing for accommodating the impeller, the multiblade turbo fan having an impeller with numerous backward-curved blades disposed at an equal circumferential distance from each other and a scroll type casing for accommodating the impeller, etc., by carrying out the same sound level measurements as described above, determining X and c in formula 5, obtaining the same correlations between $\tau$ and the dominant level of the tongue interference sound as shown in FIG. 35, and determing the same correlation line as shown in FIG. 35.

As is clear from FIG. 35, the relation $-47.09\tau+50.77<10.0$ is equivalent to the relation $\tau<0.866$. Thus, the aforementioned design criteria are equivalent to the design rule "the tongue of the scroll type casing should be located at or outside of the radial position where the ratio of the half band width of a jet flow discharged from an interblade channel to the virtual interblade pitch at a radial position where the half band width of adjacent two jet flows discharged from adjacent two interblade channels are equal to the virtual interblade pitch is 0.866." It is though that the aforementioned ratio varies with the type of the centrifugal fan and can be determined based on the sound level measurement. Thus, it is thought that the tongue interference sound of the multiblade centrifugal fan can be generally decreased by "locating the tongue of the scroll type casing at or outside of the radial position where the ratio the half band width of a jet flow discharged from an interblade channel to the virtual interblade pitch at a radial position where the half band width of the adjacent two jet flows discharged from adjacent two interblade channels are equal to the virtual interblade pitch is a certain value near 1".

It is though that the half band width of a jet flow discharged from an interblade channel increases as the distance from the outer periphery of the impeller increases, and the ratio of the half band width of a jet flow at a certain radial position to the virtual interblade pitch at the radial position increases as the distance from the outer periphery of the impeller increases. Thus, it is thought that it is possible to make the air discharged from the interblade channels collide with the tongue of the scroll type casing after the circumferential velocity distribution of the air has become fairly uniform so as to decrease the tongue interference sound of the multiblade centrifugal fan by "locating the tongue of the scroll type casing at or outside of the radial position where the ratio of the half band width of a jet flow discharged from an interblade channel to the virtual interblade pitch is a certain value near 1."

III Invention of a method for driving the impeller of the multiblade radial fan under a systematically derived condition of maximum efficiency As is clear from the aforementioned formula 2, the impeller of the multiblade radial fan can be driven under the condition of maximum efficiency by driving the impeller so as to make the flow coefficient $\phi$ equal to $0.295(1-nt/2\pi r))\xi^{1.641}$ (where n: number of the radially directed blades, t:

thickness of the radially directed blades, r: outside radius of the impeller, ξ: diameter ratio of the impeller).

As pointed out earlier, it is clear from FIG. 19 that the decrease of the total pressure efficiency η from its maximum value is 6% or so even if $\phi_x$ is varied ±25% from $\phi_{Xmax}$. Thus, it is thought that, when the driving condition of the multiblade radial fan is determined based on formula 2, the efficiency of the multiblade radial fan does not decrease so much even if the right side of formula 2 is varied about ±25%. Thus, it is thought that the following formula 10 can be used as the design criteria for systematically determining the driving condition of the maximum efficiency of the impeller of the multiblade radial fan.

$$\phi=0.295\epsilon(1-nt/(2\pi r))\,\xi^{1.641}$$

In the above formula, $0.75 \leqq \epsilon \leqq 1.25$

As is clear from FIG. 5, the correlation diagram between the diameter ratio ξ of the impeller and the flow coefficient $\phi_{Xmax}$ based on the outlet sectional area of the interblade channel which gives the maximum value of the total pressure efficiency is substantially linear over the range $0.4 \leqq \xi \leqq 0.9$. Judging from this fact, it is thought that formula 10 can be expandedly used for an impeller whose diameter ratio ξ is in the range of $0.3 \leqq \xi \leqq 0.9$. However, it is rather hard to achieve the satisfactory quietness in an impeller whose diameter ratio ξ is as large as 0.9 or so, while it is rather hard to dispose numerous radially directed blades in an impeller whose diameter ratio ξ is as small as 0.3 or so. Thus, formula 10 is preferably used for an impeller whose diameter ratio ξ is in the range of $0.4 \leqq \xi \leqq 0.8$.

Load on the impeller of the multiblade radial fan varies and the driving condition of the impeller of the multiblade radial fan varies with the shape and the size of the casing for accommodating the impeller of the multiblade radial fan and the nozzle and duct connected to the casing. Thus, the shape and the size of the casing for accommodating the impeller of the multiblade radial fan and the nozzle and duct connected to the casing should be adequately studied so as to realize the driving condition determined by formula 10.

INDUSTRIAL APPLICABILITY OF THE INVENTION

A multiblade radial fan and a multiblade centrifugal fan with optimized quietness can be obtained by applying the design criteria in accordance with the present invention.

The multiblade radial fan can be driven under the condition of the maximum efficiency by applying the design criteria in accordance with the present invention.

TABLE 1

| Impeller No. | Outside diameter of the impeller (mm) | Inside diameter of the impeller (mm) | Diameter ratio | Number of blades | Blade thickness (mm) | Rotation speed of the impeller at the measurement of the efficiency of the impeller alone (rpm) | Rotation speed of the impeller at the measurement of the sound level (rpm) |
|---|---|---|---|---|---|---|---|
| 1 | 100 | 40 | 0.40 | 120 | 0.3 | 5400 | see note 1 |
| 2 | 100 | 40 | 0.40 | 40 | 0.5 | 5400 | |
| 3 | 100 | 58 | 0.58 | 144 | 0.3 | 5400 | |
| 4 | 100 | 58 | 0.58 | 144 | 0.5 | 5400 | 7000 |
| 5 | 100 | 75 | 0.75 | 144 | 0.5 | 5400 | see note 2 |
| 6 | 100 | 75 | 0.75 | 100 | 0.5 | 5400 | |
| 7 | 100 | 90 | 0.90 | 240 | 0.5 | 5400 | |
| 8 | 100 | 90 | 0.90 | 120 | 0.5 | 5400 | |

note 1:
5000, but 7000 for $\theta_z = 2.5°$
note 2:
5000, but 7000 for $\theta_2 = 4.5°, 5.5°, 6.0°$

TABLE 2

| Impeller No. | Outside diameter (mm) | Indise diamter ((mm) | Diameter ratio | Number of blades | Blade thickness (mm) | Blade height (mm) | Ratio of the height to the Outside diameter | Inlet breadth of the interblade channel (mm) | Outlet breadth of the interblade channel (mm) |
|---|---|---|---|---|---|---|---|---|---|
| 1 | 99.0 | 58.0 | 0.59 | 120 | 0.50 | 20.0 | 0.20 | 1.02 | 2.09 |
| 2 | 99.0 | 40.0 | 0.40 | 100 | 0.50 | 20.0 | 0.20 | 0.76 | 2.61 |
| 3 | 99.0 | 58.0 | 0.59 | 100 | 0.50 | 20.0 | 0.20 | 1.32 | 2.61 |
| 4 | 99.0 | 75.0 | 0.76 | 100 | 0.50 | 20.0 | 0.20 | 1.86 | 2.61 |
| 5 | 99.0 | 90.0 | 0.91 | 100 | 0.50 | 20.0 | 0.20 | 2.33 | 2.61 |
| 6 | 99.0 | 75.0 | 0.76 | 100 | 0.50 | 20.0 | 0.20 | 5.39 | 7.28 |
| 7 | 99.0 | 75.0 | 0.76 | 60 | 0.50 | 20.0 | 0.20 | 3.43 | 4.68 |
| 8 | 99.0 | 75.0 | 0.76 | 80 | 0.50 | 20.0 | 0.20 | 2.45 | 3.39 |
| 9 | 99.0 | 75.0 | 0.76 | 120 | 0.50 | 20.0 | 0.20 | 1.46 | 2.09 |
| 10 | 99.0 | 75.0 | 0.76 | 144 | 0.50 | 20.0 | 0.20 | 1.14 | 1.66 |
| 11 | 99.0 | 58.0 | 0.59 | 40 | 0.50 | 20.0 | 0.20 | 4.06 | 7.28 |
| 12 | 99.0 | 58.0 | 0.59 | 60 | 0.50 | 20.0 | 0.20 | 2.54 | 4.68 |
| 13 | 99.0 | 58.0 | 0.59 | 80 | 0.50 | 20.0 | 0.20 | 1.78 | 3.39 |
| 14 | 99.0 | 90.0 | 0.91 | 120 | 0.50 | 20.0 | 0.2D | 1.86 | 2.09 |
| 15 | 99.0 | 58.0 | 0.59 | 144 | 0.50 | 20.0 | 0.20 | 0.77 | 1.66 |

TABLE 2-continued

| Impeller No. | Outside diameter (mm) | Indise diamter ((mm) | Diameter ratio | Number of blades | Blade thickness (mm) | Blade height (mm) | Ratio of the height to the Outside diameter | Inlet breadth of the interblade channel (mm) | Outlet breadth of the interblade channel (mm) |
|---|---|---|---|---|---|---|---|---|---|
| 16 | 99.0 | 58.0 | 0.59 | 120 | 0.30 | 20.0 | 0.20 | 1.22 | 2.29 |
| 17 | 99.0 | 58.0 | 0.59 | 144 | 0.30 | 20.0 | 0.20 | 0.97 | 1.86 |
| 18 | 99.0 | 58.0 | 0.59 | 180 | 0.30 | 20.0 | 0.20 | 0.71 | 1.43 |
| 19 | 99.0 | 75.0 | 0.76 | 300 | 0.30 | 20.0 | 0.20 | 0.49 | 0.74 |
| 20 | 99.0 | 58.0 | 0.59 | 10 | 0.50 | 20.0 | 0.20 | 17.72 | 30.60 |
| 21 | 99.0 | 40.0 | 0.40 | 40 | 0.50 | 20.0 | 0.20 | 2.64 | 7.28 |
| 22 | 99.0 | 58.0 | 0.59 | 60 | 1.00 | 20.0 | 0.20 | 2.04 | 4.18 |
| 23 | 99.0 | 58.0 | 0.59 | 30 | 2.00 | 20.0 | 0.20 | 4.07 | 8.37 |
| 24 | 99.0 | 90.0 | 0.91 | 240 | 0.50 | 20.0 | 0.20 | 0.68 | 0.80 |
| 25 | 99.0 | 40.0 | 0.40 | 120 | 0.30 | 20.0 | 0.20 | 0.75 | 2.29 |
| 26 | 100.0 | 58.0 | 0.58 | 60 | 0.30 | 20.0 | 0.20 | 2.74 | 4.94 |
| 27 | 100.0 | 58.0 | 0.58 | 80 | 0.30 | 20.0 | 0.20 | 1.98 | 3.63 |
| 28 | 100.0 | 58.0 | 0.58 | 100 | 0.30 | 20.0 | 0.20 | 1.52 | 2.84 |
| 29 | 100.0 | 58.0 | 0.58 | 120 | 0.50 | 60.0 | 0.60 | 1.02 | 2.12 |
| 30 | 100.0 | 58.0 | 0.58 | 120 | 0.50 | 60.0 | 0.60 | 1.02 | 2.12 |
| 31 | 70.0 | 40.6 | 0.55 | 90 | 0.50 | 28.0 | 0.40 | 0.92 | 1.94 |
| 32 | 70.0 | 52.5 | 0.75 | 90 | 0.50 | 28.0 | 0.40 | 1.33 | 1.94 |
| 33 | 150.0 | 87.0 | 0.58 | 200 | 0.50 | 30.0 | 0.20 | 0.87 | 1.86 |
| 34 | 150.0 | 112.5 | 0.75 | 200 | 0.50 | 30.0 | 0.20 | 1.27 | 1.86 |
| 35 | 70.0 | 40.6 | 0.58 | 100 | 0.30 | 28.0 | 0.40 | 0.95 | 1.90 |
| 36 | 70.0 | 40.6 | 0.58 | 120 | 0.30 | 28.0 | 0.40 | 0.76 | 1.53 |
| 37 | 150.0 | 87.0 | 0.58 | 200 | 0.50 | 65.0 | 0.43 | 0.87 | 1.86 |
| 35 | 100.0 | 58.0 | 0.58 | 240 | 0.30 | 20.0 | 0.20 | 0.46 | 1.01 |
| 39 | 100.0 | 58.0 | 0.58 | 200 | 0.30 | 20.0 | 0.20 | 0.61 | 1.27 |

TABLE 3

Impeller No. 23 (mean value of the dominant level of the tongue interference sound = 24.63 dB)
Divergence angle of the scroll type casing $\theta_z$ = 4.5°, Tongue clearance = 3.5 mm
Tongue R = 4.0 mm

| Measurement No. | Flow coefficient $\phi$ | Number of blades | Rotation speed of the impeller (rpm) | Frequency of the tongue interference soud ($H_z$) | Dominant level of the tongue interference sound (dB) |
|---|---|---|---|---|---|
| 1 | 0.10 | 30 | 5500 | 96.67 | 25.0 |
| 2 | 0.11 | 30 | 5800 | 96.67 | 21.0 |
| 3 | 0.10 | 30 | 6300 | 105.00 | 10.0 |
| 4 | 0.11 | 30 | 6300 | 105.00 | 22.5 |
| 5 | 0.10 | 30 | 6800 | 113.33 | 27.0 |
| 6 | 0.11 | 30 | 6800 | 113.33 | 29.0 |
| 7 | 0.10 | 30 | 7300 | 121.67 | 25.5 |
| 8 | 0.11 | 30 | 7300 | 121.67 | 27.0 |
| 9 | 0.10 | 30 | 7800 | 130.00 | 25.5 |
| 10 | 0.11 | 30 | 7800 | 130.00 | 28.5 |
| 11 | 0.10 | 30 | 8300 | 138.33 | 25.5 |
| 12 | 0.11 | 30 | 8300 | 138.33 | 26.0 |
| 13 | 0.10 | 30 | 8800 | 146.67 | 22.5 |
| 14 | 0.11 | 30 | 8800 | 146.67 | 27.0 |
| 15 | 0.10 | 30 | 9300 | 155.00 | 25.0 |
| 16 | 0.11 | 30 | 9300 | 155.00 | 24.0 |

TABLE 4

| | Specification of the impeller | | | Specification of the casing | | | Dominant level | | |
|---|---|---|---|---|---|---|---|---|---|
| Test No. | Outside diameter (mm) | Number of blades | Blade thickness (mm) | Tongue clearance Cd (mm) | Tongue radius R (mm) | $\tau$ | of tongue interference sound Z (dB) | Casing No. | Impeller No. |
| 1 | 99.0 | 10 | 0.5 | 2.7 | 2.0 | 0.28 | 35.0 | 3 | 20 |
| 2 | 99.0 | 30 | 2.0 | 2.7 | 2.0 | 0.47 | 30.0 | 3 | 23 |
| 3 | 99.0 | 60 | 0.5 | 2.7 | 2.0 | 0.58 | 24.3 | 3 | 6,11,21 |
| 4 | 100.0 | 60 | 0.3 | 2.2 | 2.0 | 0.65 | 25.0 | 3 | 26 |
| 5 | 99.0 | 60 | 0.5 | 2.7 | 2.0 | 0.74 | 17.8 | 3 | 7,12 |

TABLE 4-continued

| Test No. | Specification of the impeller: Outside diameter (mm) | Number of blades | Blade thickness (mm) | Specification of the casing: Tongue clearance Cd (mm) | Tongue radius R (mm) | τ | Dominant level of tongue interference sound Z (dB) | Casing No. | Impeller No. |
|---|---|---|---|---|---|---|---|---|---|
| 6 | 99.0 | 60 | 1.0 | 2.7 | 2.0 | 0.73 | 15.0 | 3 | 22 |
| 7 | 100.0 | 80 | 0.3 | 2.2 | 2.0 | 0.78 | 17.0 | 3 | 27 |
| 8 | 99.0 | 80 | 0.5 | 2.7 | 2.0 | 0.90 | 8.9 | 3 | 8,13 |
| 9 | 100.0 | 100 | 0.3 | 2.2 | 2.0 | 0.91 | 6.0 | 3 | 28 |
| 10 | 99.0 | 100 | 0.5 | 2.7 | 2.0 | 1.06 | 0.7 | 3 | 2,3,4,5 |
| 11 | 99.0 | 120 | 0.3 | 2.7 | 2.0 | 1.23 | 0.0 | 3 | 16,25 |
| 12 | 99.0 | 120 | 0.5 | 2.7 | 2.0 | 1.23 | 0.4 | 3 | 1,9,14,2,30 |
| 13 | 99.0 | 144 | 0.3 | 2.7 | 2.0 | 1.42 | 1.0 | 3 | 17 |
| 14 | 99.0 | 144 | 0.5 | 2.7 | 2.0 | 1.44 | 0.0 | 3 | 10,15 |
| 15 | 100.0 | 180 | 0.3 | 3.0 | 2.0 | 1.87 | 0.0 | 4 | 18 |
| 16 | 100.0 | 200 | 0.3 | 3.0 | 2.0 | 2.06 | 0.0 | 4 | 39 |
| 17 | 100.0 | 200 | 0.3 | 3.0 | 2.0 | 2.44 | 0.0 | 4 | 38 |
| 18 | 99.0 | 300 | 0.3 | 2.7 | 2.0 | 2.78 | 0.0 | 3 | 19 |
| 19 | 70.0 | 90 | 0.5 | 2.7 | 2.0 | 1.30 | 1.8 | 1 | 31,32 |
| 20 | 70.0 | 100 | 0.3 | 2.7 | 2.0 | 1.40 | 0.0 | 1 | 35 |
| 21 | 70.0 | 120 | 0.3 | 2.7 | 2.0 | 1.64 | 0.0 | 1 | 36 |
| 22 | 150.0 | 200 | 0.5 | 2.6 | 2.0 | 1.29 | 0.0 | 8 | 33,34 |
| 23 | 100.0 | 150 | 0.3 | 3.0 | 4.0 | 1.87 | 0.0 | 6 | 18 |
| 24 | 99.0 | 30 | 2.0 | 3.5 | 4.0 | 0.54 | 24.6 | 6 | 23 |
| 25 | 100.0 | 60 | 0.5 | 3.0 | 4.0 | 0.79 | 14.1 | 6 | 40 |
| 26 | 99.0 | 100 | 0.5 | 3.5 | 4.0 | 1.31 | 0.0 | 6 | 3 |
| 27 | 99.0 | 60 | 1.0 | 3.5 | 4.0 | 0.88 | 9.4 | 6 | 22 |
| 28 | 99.0 | 144 | 0.5 | 3.5 | 4.0 | 1.80 | 0.0 | 6 | 15 |
| 29 | 99.0 | 30 | 2.0 | 3.5 | 6.0 | 0.54 | 27.0 | 7 | 23 |
| 30 | 99.0 | 60 | 1.0 | 3.5 | 6.0 | 0.88 | 8.1 | 7 | 22 |
| 31 | 99.0 | 144 | 0.5 | 3.5 | 6.0 | 1.80 | 0.0 | 7 | 15 |
| 32 | 100.0 | 180 | 0.3 | 3.0 | 6.0 | 1.87 | 0.0 | 7 | 18 |
| 33 | 99.0 | 100 | 0.5 | 3.5 | 6.0 | 1.31 | 0.3 | 7 | 3 |
| 34 | 100.0 | 60 | 0.5 | 3.0 | 6.0 | 0.79 | 12.2 | 7 | 40 |
| 35 | 99.0 | 40 | 0.5 | 3.5 | 6.0 | 0.67 | 19.5 | 7 | 11 |
| 36 | 99.0 | 240 | 0.5 | 1.5 | 2.0 | 1.37 | 0.0 | 2 | 24 |
| 37 | 99.0 | 100 | 0.5 | 1.5 | 2.0 | 0.70 | 16.2 | 2 | 3 |
| 38 | 99.0 | 60 | 1.0 | 1.5 | 2.0 | 0.50 | 26.0 | 2 | 22 |
| 39 | 99.0 | 30 | 2.0 | 1.5 | 2.0 | 0.35 | 35.0 | 2 | 23 |
| 40 | 100.0 | 60 | 0.5 | 1.0 | 2.0 | 0.43 | 28.4 | 2 | |
| 41 | 99.0 | 40 | 0.5 | 1.5 | 2.0 | 0.43 | 31.8 | 2 | 21 |
| 42 | 99.0 | 144 | 0.5 | 1.5 | 2.0 | 0.90 | 6.9 | 2 | 15 |
| 43 | 99.0 | 120 | 0.3 | 1.5 | 2.0 | 0.79 | 12.6 | 2 | 16 |
| 44 | 99.0 | 40 | 0.5 | 6.0 | 2.0 | 0.91 | 9.5 | 5 | 6,11,21 |
| 45 | 99.0 | 60 | 1.0 | 6.0 | 2.0 | 1.35 | 0.0 | 5 | 22 |
| 46 | 99.0 | 144 | 0.5 | 6.0 | 2.0 | 2.92 | 0.0 | 5 | 15 |
| 47 | 99.0 | 30 | 2.0 | 6.0 | 2.0 | 0.73 | 14.7 | 5 | 23 |

TABLE 5

| (1) Impeller No. | (2) (Hz) | (3) (dB) | (4) (dB) | (5) (dB) | (6) (dB) | (7) (dB) |
|---|---|---|---|---|---|---|
| 11 | 4629.3 | 4.0 | 58.99 | 46.49 | 58.74 | 0.25 |
| 23 | 2480.0 | 8.0 | 54.23 | 39.79 | 54.07 | 0.16 |
| 21 | 3303.3 | 12.0 | 51.58 | 44.78 | 50.56 | 1.02 |
| 11 | 3304.7 | 15.0 | 52.17 | 44.01 | 51.45 | 0.72 |
| 23 | 3467.0 | 35.0 | 78.31 | 78.12 | 64.62 | 13.69 |
| 23 | 2478.5 | 33.0 | 61.40 | 59.98 | 55.85 | 5.55 |
| 22 | 6941.0 | 22.0 | 58.16 | 44.95 | 57.95 | 0.21 |
| 21 | 3300.7 | 17.0 | 54.30 | 48.64 | 52.93 | 1.37 |
| 3 | 11531.7 | 8.0 | 60.85 | 37.00 | 60.83 | 0.02 |
| 3 | 8251.7 | 12.0 | 53.83 | 27.30 | 53.82 | 0.01 |
| 12 | 4952.0 | 10.0 | 49.96 | 36.78 | 49.75 | 0.21 |
| 23 | 2479.0 | 10.0 | 54.61 | 40.88 | 54.42 | 0.19 |
| 23 | 2475.5 | 22.0 | 54.50 | 43.37 | 54.15 | 0.35 |
| 15 | 11875.2 | 8.0 | 51.81 | 25.98 | 51.80 | 0.01 |
| 23 | 3473.0 | 28.0 | 64.39 | 61.69 | 61.05 | 3.34 |
| 15 | 7147.2 | 9.0 | 41.55 | 19.03 | 41.53 | 0.02 |
| 15 | 8251.7 | 11.0 | 54.00 | 27.25 | 53.99 | 0.01 |
| 11 | 4619.3 | 12.0 | 59.37 | 47.60 | 59.07 | 0.30 |
| 23 | 3469.0 | 12.0 | 63.17 | 53.79 | 62.64 | 0.53 |

TABLE 5-continued

| (1) Impeller No. | (2) (Hz) | (3) (dB) | (4) (dB) | (5) (dB) | (6) (dB) | (7) (dB) |
|---|---|---|---|---|---|---|
| 23 | 1193.0 | 15.0 | 40.04 | 32.73 | 39.15 | 0.89 |
| 12 | 4956.0 | 30.0 | 59.13 | 58.25 | 51.76 | 7.37 |
| 6 | 4617.3 | 8.0 | 67.65 | 49.84 | 67.58 | 0.07 |
| 15 | 11880.0 | 8.0 | 53.87 | 26.83 | 53.86 | 0.01 |
| 21 | 4621.3 | 5.0 | 61.05 | 47.75 | 60.84 | 0.21 |
| 15 | 5719.2 | 3.0 | 38.58 | 17.47 | 38.55 | 0.03 |
| 15 | 7144.8 | 7.0 | 42.52 | 19.28 | 42.50 | 0.02 |

(2) Frequency of interference sound
(3) Dominant level of interference sound
(4) A-weighted, ⅓ octave bend overall sound level
(5) ⅓ octave band sound level in the frequency of interference sound
(6) ⅓ octave band overall sound level without (5)
(7) Difference between (4) and (6) ((4) − (6))

We claim:

1. A method for making a multiblade radial fan comprising an impeller and a scroll type casing, comprising the step of forming the impeller and the scroll type casing to satisfy the formula:

$$\theta_z=\tan^{-1}\{0.295\epsilon(1-nt/(2\pi r))(H/H_t)\xi^{1.641}\}$$

where $0.75\leqq\epsilon\leqq1.25$, n=a number of the radially directed blades, t=a thickness of the radially directed blades, r=an outside radius of the impeller, H=a height of the radially directed blades, $H_t$=a height of the scroll type casing, $\xi$=a diameter ratio of the impeller, $\theta_z$=a divergence angle of the scroll type casing.

2. A method for making a multiblade radial fan of claim 1, wherein the impeller and the scroll type casing are formed to further satisfy the formula:

$$3.0°\leqq\theta_z\leqq8.0°.$$

3. A method for making a multiblade radial fan of claim 1, wherein the impeller and the scroll type casing are formed to further satisfy the formula:

$$0.4\leqq\xi\geqq0.8.$$

4. A method for making a multiblade radial fan of claim 1, wherein the impeller and the scroll type casing are further formed to satisfy the correlation expressed by the formula:

$$H/D_1\leqq0.75$$

where $D_1$=an inside diameter of the impeller.

5. A method for making a multiblade radial fan of claim 1, wherein the impeller and the scroll type casing are further formed to satisfy the formula:

$$0.65\leqq H/H_t.$$

6. A multiblade radial fan comprising an impeller and a scroll type casing, wherein the impeller and the scroll type casing to satisfy the formula:

$$\theta_z=\tan^{-1}\{0.295\epsilon(1-nt/(2\pi r))(H/H_t)\xi^{1.641}\}$$

where $0.75\leqq\epsilon\leqq1.25$, n=a number of the radially directed blades, t=a thickness of the radially directed blades, r=an outside radius of the impeller, H=a height of the radially directed blades, $H_t$=a height of the scroll type casing, $\xi$=a diameter ratio of the impeller, $\theta_z$=a divergence angle of the scroll type casing.

7. A multiblade radial fan of claim 6, wherein the impeller and the scroll type casing further satisfy the formula:

$$3.0°\leqq\theta_z\leqq8.0°.$$

8. A multiblade radial fan of claim 6, wherein the impeller and the scroll type casing satisfy the formula:

$$0.4\leqq\xi\leqq0.8.$$

9. A multiblade radial fan of claim 6, wherein the impeller and the scroll type casing the formula:

$$H/D_1\leqq0.75$$

where $D_1$=an inside diameter of the impeller.

10. A multiblade radial fan of claim 6, wherein the impeller and the scroll type casing satisfy the formula:

$$0.65\leqq H/H_t.$$

11. A method for making a multiblade centrifugal fan comprising an impeller having a plurality of blades circumferentially spaced from each other and a scroll type casing accommodating the impeller, comprising forming the scroll type casing such that a tongue located at or outside a radial position where a ratio of a half band width of a jet flow discharged from an interblade channel to a virtual interblade pitch is a certain value near 1.

12. A method for making a multiblade centrifugal fan of claim 11, wherein an inter-blade pitch at a trailing edge of the blades is less than or equal to 5 mm and the number of blades is larger than or equal to 60.

13. A method for making a multiblade centrifugal fan comprising an impeller having a plurality of blades circumferentially spaced from each other and a scroll type casing accommodating the impeller, comprising forming the scroll type casing such that a tongue located at or outside a radial position where a ratio of a half band width of a jet flow discharged from an interblade channel to a virtual interblade pitch at a radial position where half band widths of two adjacent jet flows discharged from two adjacent interblade channels are equal to a virtual interlade pitch is a certain value near 1.

14. A method for making a multiblade centrifugal fan of claim 13, wherein an inter-blade pitch at a trailing edge of the blades is less than or equal to 5 mm and the number of the blades is larger than or equal to 60.

15. A method for making a multiblade centrifugal fan comprising an impeller having a plurality of blades circumferentially spaced from each other and a scroll type casing accommodating the impeller, wherein the impeller and the scroll type casing are formed to satisfy the formula:

$$-A\tau+B<10.0$$

where $\tau=b/\delta_3$, $b=(\delta_3-c)(C_d/X)+c$, $c=C\delta_1$, $\delta_1=\{(2\pi r)/n\}-t$, $\delta_3=2\pi(r+X)/n$, $C_d$=a tongue clearance, n=a number of the blades, t=a thickness of the blades, r=an outside radius of the impeller, and A, B, C, X=constants determined through tests.

16. A method for making a multiblade centrifugal fan comprising an impeller having a plurality of blades circumferentially spaced from each other and a scroll type casing accommodating the impeller, wherein the impeller and the scroll type casing are formed to satisfy the formula:

$$-47.09\tau+50.77<10.0$$

where $\tau=b/\delta_3$, $b=(\delta_3-c)(C_d/X)+c$, $X=0.8\delta_2$, $c=0.3\delta_1$, $\delta_1=\{(2\pi r)/n\}-t$, $\delta_2=2=(2\pi r)/n$, $\delta_3=2\pi(r+X)/n$, $C_d$=a tongue clearance, n=a number of the blades, t=a thickness of the blades, r=an outside radius of the impeller.

17. A multiblade centrifugal fan comprising an impeller having a plurality of blades circumferentially spaced from each other and a scroll type casing accommodating the impeller, wherein the scroll type casing further comprises a tongue located at or outside the a radial position where a ratio of a half band width of a jet flow discharged from an interblade channel to a virtual interblade pitch is a certain value near 1.

18. A multiblade centrifugal fan of claim 17, wherein an inter-blade pitch at a trailing edge of the blades is less than or equal to 5 mm and the number of the blades is larger than or equal to 60.

19. A multiblade centrifugal fan comprising an impeller having a plurality of blades circumferentially spaced from each other and a scroll type casing accommodating the impeller, wherein the scroll type casing further comprises a tongue located at or outside a radial position where a ratio of a half band width of a jet flow discharged from an interblade channel to a virtual interblade pitch at a radial position where half band widths of two adjacent jet flows discharged from two adjacent interblade channels are equal to a virtual interblade pitch is a certain value near 1.

20. A multiblade centrifugal fan of claim 19, wherein an inter-blade pitch at a trailing edge of the blades is less than or equal to 5 mm and the number of the blades is larger than or equal to 60.

21. A multiblade centrifugal fan comprising an impeller having a plurality of blades circumferentially spaced from each other and a scroll type casing accommodating the impeller, wherein the impeller and the scroll type casing satisfy the formula:

$$-A\tau+B<10.0$$

where $\tau=b/\delta_3$, $b=(\delta_3-c)(C_d/X)+c$, $c=C\delta_1$, $\delta_1=\{(2\pi r)/n\}-t$, $\delta_3=2\pi(r+X)/n$, $C_d$=a tongue clearance, n=a number of the blades, t=a thickness of the blades, r=an outside radius of the impeller, and A, B, C, X=constants determined through tests.

22. A multiblade centrifugal fan comprising an impeller having a plurality of blades circumferentially spaced from each other and a scroll type casing accommodating the impeller, wherein the impeller and the scroll type casing satisfy the formula:

$$-47.09\tau+50.77<10.0$$

where $\tau=b/\delta_3$, $b=(\delta_3-c)(C_d/X)+c$, $X=0.8\delta_2$, $c=0.3\delta_1$, $\delta_1=\{(2\pi r)/n\}-t$, $\delta_2=(2\pi r)/n$, $\delta_3=2\pi(r+X)/n$, $C_d$=a tongue clearance, n=a number of the blades, t=a thickness of the blades, r=an outside radius of the impeller.

23. A method for driving an impeller of a multiblade radial fan, comprising the step of driving the impeller so as to make a flow coefficient $\phi$ equal to $$0.295\epsilon(1-nt/(2\pi r))\xi^{1.641}$$

where $0.75\leqq\epsilon\leqq1.25$, n=a number of the radially directed blades, t=a thickness of the radially directed blades, r=an outside radius of the impeller, $\xi$=a diameter ratio of the impeller.

24. A method for driving the impeller of a multiblade radial fan of claim 23, wherein $\xi$ is in the range of $$0.4<\xi<0.8.$$

25. A method for making a multiblade centrifugal fan comprising an impeller having a plurality of blades circumferentially spaced from each other and a scroll type casing accommodating the impeller, wherein the impeller and the scroll type casing are formed to satisfy the formula:

$$\{(\delta_3-c)(C_d/X)+c\}/\delta_3\geqq1$$

where $c=C\delta_1$, $\delta_1=\{(2\pi r)/n\}-t$, $\delta_3=2\pi(r+X)/n$, $C_d$=a tongue clearance, n=a number of the blades, t=a thickness of the blades, r=an outside radius of the impeller, and C, X=constants determined through tests.

26. A method for making a multiblade centrifugal fan of claim 25, wherein an inter-blade pitch at a trailing edge of the blades is less than or equal to 5 mm and the number of blades is larger than or equal to 60.

27. A method for making a multiblade centrifugal fan comprising an impeller having a plurality of blades circumferentially spaced from each other and a scroll type casing accommodating the impeller, wherein the impeller and the scroll type casing are formed to satisfy the formula:

$$\{(\delta_3-c)(C_d/X)+c\}/\delta_3\geqq0.87$$

where $X=0.8\delta_2$, $c=0.3\delta_1$, $\delta_1=\{(2\pi r)/n\}-t$, $\delta_2=(2\pi r)/n$, $\delta_3=2\pi(r+X)/n$, $C_d$=a tongue clearance, n=a number of the blades, t=a thickness of the blades, r=an outside radius of the impeller.

28. A method for making a multiblade centrifugal fan of claim 27, wherein an inter blade pitch at a trailing edge of the blades is less than or equal to 5 mm and the number of the blades is larger than or equal to 60.

29. A multiblade centrifugal fan comprising an impeller having a plurality of blades circumferentially spaced from each other and a scroll type casing accommodating the impeller, wherein the impeller and the scroll type casing satisfy the formula:

$$\{(\delta_3-c)(C_d/X)+c\}/\delta_3\geqq1$$

where $c=C\delta_1$, $\delta_1=\{(2\pi r)/n\}-t$, $\delta_3=2\pi(r+X)/n$, $C_d$=a tongue clearance, n=a number of the blades, t=a thickness of the blades, r=an outside radius of the impeller, and C, X=.

30. A multiblade centrifugal fan of claim 29, wherein an inter-blade pitch at a trailing edge of the blades is less than or equal to 5 mm and the number of the blades is larger than or equal to 60.

31. A multiblade centrifugal fan comprising an impeller having a plurality of blades circumferentially spaced from each other and a scroll type casing accommodating the impeller, wherein the impeller and the scroll type casing satisfy the formula:

$$\{(\delta_3-c)(C_d/X)+c\}/\delta_3\geqq0.87$$

where $X=0.8\delta_2$, $c=0.3\delta_1$, $\delta_1=\{(2\pi r)/n\}-t$, $\delta_2=(2\pi r)/n$, $\delta_3=2\pi(r+X)/n$, $C_d$=a tongue clearance, n=a number of the blades, t=a thickness of the blades, r=an outside radius of the impeller.

32. A multiblade centrifugal fan of claim 31, wherein an inter-blade pitch at a trailing edge of the blades is less than or equal to 5 mm and the number of the blades is larger than or equal to 60.

* * * * *